US012305941B2

(12) United States Patent
Dulude et al.

(10) Patent No.: US 12,305,941 B2
(45) Date of Patent: May 20, 2025

(54) LOCKING MAGAZINE

(71) Applicant: Go Safe Technology, Inc., Stamford, CT (US)

(72) Inventors: Matthew P. Dulude, Granby, CT (US); Michael D. Bush, Somers, CT (US)

(73) Assignee: Go Safe Technology, Inc., Stamford, CT (US)

( * ) Notice: Subject to any disclaimer, the term of this patent is extended or adjusted under 35 U.S.C. 154(b) by 0 days.

(21) Appl. No.: 18/766,079

(22) Filed: Jul. 8, 2024

(65) Prior Publication Data

US 2024/0369317 A1 Nov. 7, 2024

Related U.S. Application Data

(63) Continuation of application No. 17/141,404, filed on Jan. 5, 2021, now Pat. No. 12,055,355, which is a continuation of application No. 17/013,087, filed on Sep. 4, 2020, now Pat. No. 10,914,543, which is a continuation-in-part of application No. 16/299,251, filed on Mar. 12, 2019, now Pat. No. 10,914,542, which is a continuation of application No. (Continued)

(51) Int. Cl.

| | |
|---|---|
| ***F41A 17/46*** | (2006.01) |
| ***F41A 9/64*** | (2006.01) |
| ***F41A 17/06*** | (2006.01) |
| ***F41A 17/34*** | (2006.01) |
| ***F41A 17/38*** | (2006.01) |
| ***F41A 17/48*** | (2006.01) |
| *F41A 9/61* | (2006.01) |

(52) U.S. Cl.
CPC ..... *F41A 17/34* (2013.01); *F41A 9/64* (2013.01); *F41A 17/066* (2013.01); *F41A 17/38* (2013.01); *F41A 17/46* (2013.01); *F41A 17/48* (2013.01); *F41A 9/61* (2013.01)

(58) Field of Classification Search
CPC ..... F41A 17/46; F41A 17/48; F41A 17/34; F41A 17/32; F41A 9/65; F41A 9/61
See application file for complete search history.

(56) References Cited

U.S. PATENT DOCUMENTS 10,260,831 B2 * 4/2019 Biran ..... F41A 9/64
10,914,542 B2 * 2/2021 Biran ..... F41A 17/066
(Continued)

*Primary Examiner* — J. Woodrow Eldred
(74) *Attorney, Agent, or Firm* — Bennet K. Langlotz; Langlotz Patent & Trademark Works, LLC

(57) ABSTRACT

A magazine is provided for a firearm. The magazine comprises a locking mechanism. The locking mechanism has a user interface adapted to enable a user to select between a locked condition and an unlocked condition. The locking mechanism has a rotor movable between a first rotational position when the locking mechanism is in the locked condition and a second rotational position when the locking mechanism is in the unlocked condition. The magazine comprises an elongated shaft connected to the rotor. The magazine comprises a block element connected to the elongated shaft. The block element is adapted to move between a first position when the locking mechanism is in the locked condition in which at least one of firearm operation and magazine extraction are prevented, and a second position when the locking mechanism is in the unlocked condition in which firearm operation and magazine extraction are enabled.

20 Claims, 42 Drawing Sheets

Related U.S. Application Data

16/123,441, filed on Sep. 6, 2018, now Pat. No. 10,260,831, which is a continuation-in-part of application No. 15/258,276, filed on Sep. 7, 2016, now abandoned.

(56) References Cited

U.S. PATENT DOCUMENTS

| | | | | |
|---|---|---|---|---|
| 10,914,543 | B2 * | 2/2021 | Dulude | F41A 17/06 |
| 12,055,355 | B2 * | 8/2024 | Dulude | F41A 17/38 |

* cited by examiner

LOCKING MAGAZINE

CROSS-REFERENCE TO RELATED APPLICATION

This application is continuation of U.S. application Ser. No. 17/141,404, filed Jan. 5, 2021, which is a continuation of U.S. application Ser. No. 17/013,087, filed Sep. 4, 2020 and issued as U.S. Pat. No. 10,914,543, which is a continuation-in-part of U.S. Application Ser. No. 16/299,251, filed Mar. 12, 2019 and issued as U.S. Pat. No. 10,914,542, which a continuation of U.S. application Ser. No. 16/123,441, filed Sep. 6, 2018, now issued as U.S. Pat. No. 10,260,831, which is a continuation-in-part of U.S. application Ser. No. 15/258,276, filed Sep. 7, 2016, which are hereby incorporated by reference in their entirety.

FIELD OF THE INVENTION

The present invention relates to firearms. More particularly, the present invention relates to a magazine for various firearms.

BACKGROUND OF THE INVENTION

In recent years, there has been an increase in the number of accidental, negligent or unauthorized discharge from various firearms, particularly handguns. Such incidents typically occur when the trigger of the firearm is deliberately pulled for a purpose other than shooting, such as dry-fire practice, demonstration or function testing, but the ammunition is unintentionally left in the chamber. Unintentionally leaving a firearm loaded is more likely to occur when the individual handling the gun is poorly trained, and perhaps also with removable-magazine-fed firearms (as the magazine may be removed, giving an unloaded appearance even when a round remains chambered). Since most handguns are designed such that the magazine constantly remains inside, thus keeping the handgun constantly loaded, such accidental or otherwise undesired or unauthorized discharge is more likely to occur.

A second common cause of negligent discharge is placement by the gun-handler of his/her finger on the trigger before deciding to shoot. With the finger so positioned, many activities may cause the finger to compress the trigger unintentionally. For example, if one attempts to holster the firearm with finger on trigger, the holster edge might drive the finger onto the trigger, and discharge is likely.

Accidental discharges not involving a trigger-pull can also occur if the firearm is mechanically unsound: due to poor maintenance, abuse and/or the use of defective ammunition in the gun, may all lead to breakage.

Furthermore, recently there has been a sharp increase in misuse of firearms with unauthorized users firing (for fun or by accident), and particularly youngsters using their parents' firearms. Such incidents cause many injuries (and sometimes fatalities) since there are no means to prevent other people from using a gun of an authorized user.

It would, therefore, be advantageous to provide safety means for firearms so as to prevent unintentional and/or unauthorized firing and/or accidental discharge.

Many of the existing magazine based safety means for firearms may reduce or eliminate the ammunition capacity of a magazine. Many of the existing magazine based safety means for firearms may be difficult and/or time consuming to manipulate between locked and unlocked conditions. Many of the existing magazine based safety means for firearms may require extensive hardware which adds to the weight of a magazine and/or firearm.

What is needed are improved magazines for firearms.

SUMMARY OF THE INVENTION

At least some embodiments of the present invention provide a magazine for a firearm. The magazine comprises an elongated tubular body defining an ammunition compartment. The magazine has an upper end defining an ammunition exit aperture and a lower end opposed to the upper end. The magazine comprises a locking mechanism connected to the lower end of the elongated tubular body. The locking mechanism has a locked condition and an unlocked condition. The locking mechanism has a user interface adapted to enable a user to select between the locked condition and the unlocked condition. The locking mechanism has a rotor movable between a first rotational position when the locking mechanism is in the locked condition and a second rotational position when the locking mechanism is in the unlocked condition. The second rotational position is different than the first rotational position. The magazine comprises an elongated shaft. The elongated shaft has a lower end connected to the rotor, and an upper end opposed to the lower end. The magazine comprises a block element connected proximate to the upper end of the elongated shaft. The block element is adapted to move between a first position when the locking mechanism is in the locked condition in which at least one of firearm operation and magazine extraction are prevented, and a second position when the locking mechanism is in the unlocked condition in which firearm operation and magazine extraction are enabled.

According to some of the various embodiments, the elongated shaft may be a straight element. The elongated shaft may be a cylindrical element. The elongated shaft may have a circular cross section.

According to some of the various embodiments, the upper end of the elongated shaft may be proximate the upper end of the elongated tubular body. The upper end of the elongated shaft may be closer to the upper end of the elongated tubular body than to the lower end of the elongated tubular body.

According to some of the various embodiments, the elongated tubular body may define a shaft passage closely receiving the elongated shaft. The elongated tubular body may have opposed sidewalls, a front wall, and a rear wall. The elongated shaft may be proximate to one of the opposed sidewalls. The elongated shaft may be proximate to the front wall. The elongated shaft may be proximate to the rear wall. The elongated tubular body may have an exterior profile adapted to be closely received in a firearm magazine well. The block element may be within the exterior profile to enable extraction of the magazine when in the second position. The block element may protrude from the exterior profile to prevent extraction of the magazine when in the first position.

According to some of the various embodiments, the block element may be an elongated element extending away from the elongated shaft. The block element may be a planar element having a major surface flush with an external surface of the elongated tubular body when the block element is in the second position. The block element may extend laterally from the elongated shaft. The block element may extend radially from the elongated shaft. The block element may extend transversely from the elongated shaft. The block element may extend perpendicularly from the elongated shaft. The block element may define a block passage receiving the elongated shaft.

According to some of the various embodiments, the firearm may include a trigger element movable between a rest position and a discharge position. When the block element is in the first position, the block element may be adapted to contact the trigger element to prevent motion of the trigger element.

According to some of the various embodiments, the magazine may include a status indicator movable between a first position and a second position based on whether the locking mechanism is in the locked condition or the unlocked condition. The status indicator may be adapted to provide a tactile indication of its condition.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1B:
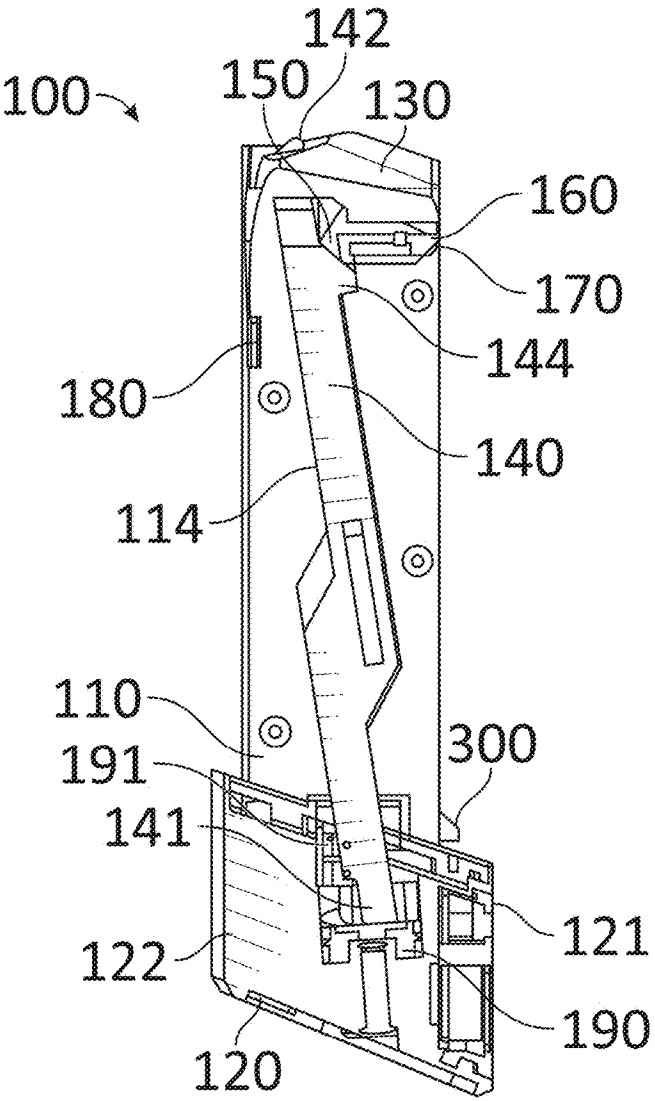
FIG. 1B schematically illustrates a left side cross-sectional view of the discharge blocking device, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF THE CURRENT EMBODIMENT

In the following detailed description, numerous specific details are set forth in order to provide a thorough understanding of embodiments of the invention. However, it will be understood by those of ordinary skill in the art that the embodiments of the invention may be practiced without these specific details. In other instances, well-known methods, procedures, and components have not been described in detail so as not to obscure the embodiments of the invention.

Figure 1A:
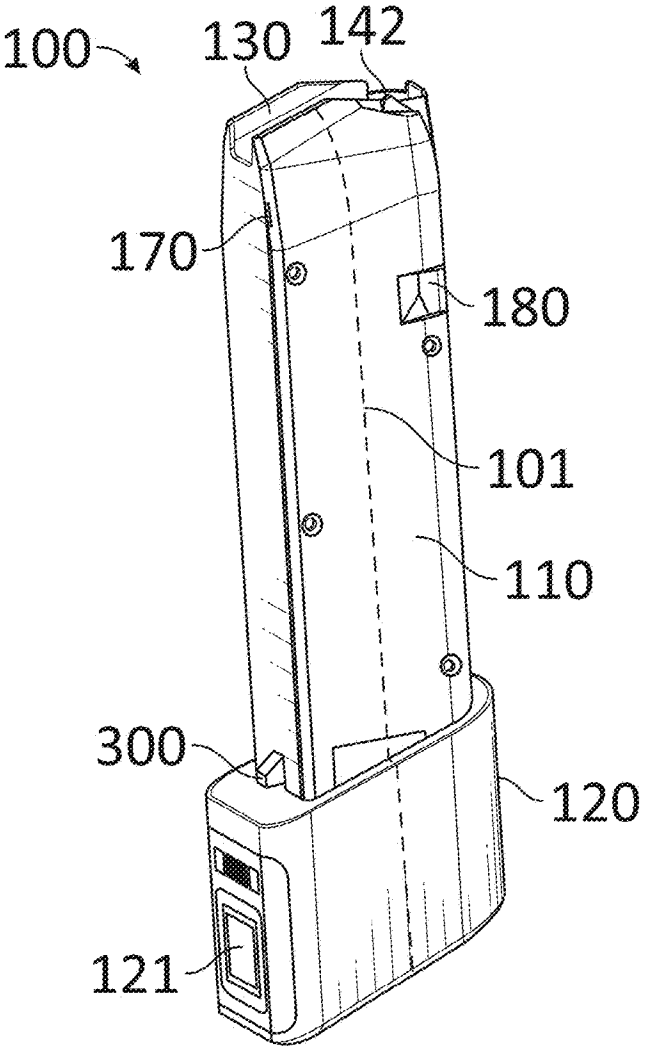
FIG. 1A schematically illustrates a right perspective view of a discharge blocking device, according to some embodiments of the invention.

Reference is now made to FIGS. 1A-1B, which show a discharge blocking device 100, according to some embodiments of the invention. FIG. 1A schematically illustrates a right perspective view (with respect to the shooting direction of the firearm) of a discharge blocking device 100, and FIG. 1B schematically illustrates a left side cross-sectional view of the discharge blocking device 100.

It is appreciated that discharge blocking device 100 (as a safety magazine) according to some embodiments of the invention is adapted to allow a user, operating a firearm, to block the discharge by having a safety mechanism (within the discharge blocking device) set in a locked mode, such that the discharge may be enabled only according to the selection by an authorized user with the safety mechanism. Therefore, in addition to the existing safety selector on the firearm, discharge blocking device 100 may provide further means for controlling the firing mode of the firearm (e.g., locked or unlocked mode), further described hereinafter.

Discharge blocking device 100 may include a cover 110 having a structure that is compatible with some commercially available magazines for firearms, for instance having a shape and dimensions corresponding to and adapted to be inserted into a magazine housing of, for example, a Glock® handgun. Discharge blocking device 100 may further include a base 120 that at least partially covers a safety mechanism that is configured to block the discharge.

In some embodiments, base 120 may have a shape protruding with respect to cover 110, such that easy gripping (of base 120) by a user operating the firearm may be allowed for insertion into and removal from the firearm. It is therefore appreciated that only with the base 120, the difference from commercially available magazines (for example, a Glock® handgun) may be observed, when the safety magazine is inserted into a firearm.

Figure 4A:
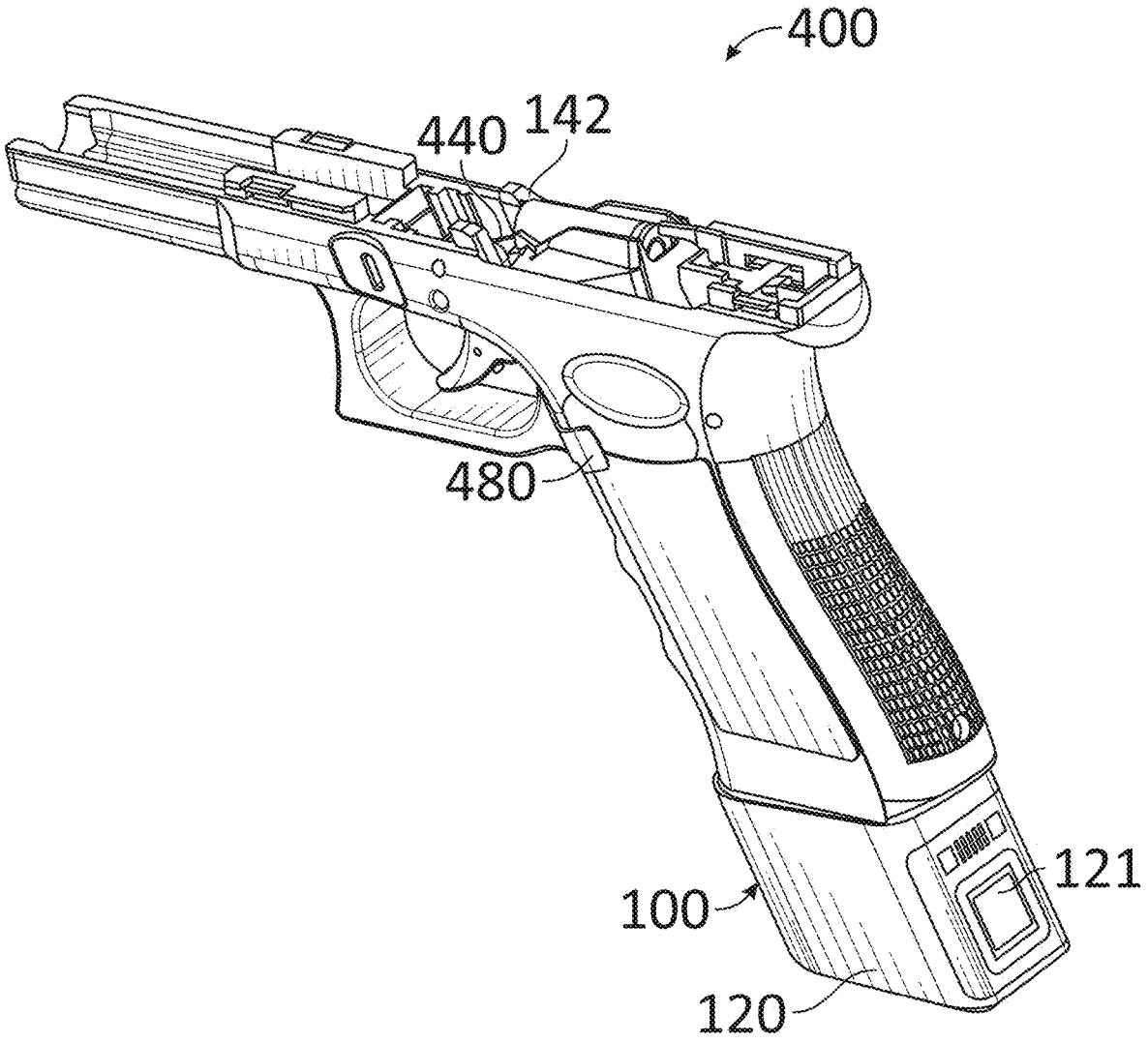
FIG. 4A schematically illustrates a perspective view of the discharge blocking device accommodated in a magazine housing of a firearm, according to a preferred embodiment of the invention.

In some embodiments, cover 110 may have a top segment 130 that is configured to couple with the magazine housing (also referred to as a magazine well) in a compatible firearm (for example as shown in FIG. 4A). Top segment 130 may have an opening for insertion of cartridges therein (e.g., in a single column or stacked), such that the cartridge that is last inserted partially protrudes through top segment 130 in order to engage the firearm upon coupling with the magazine housing. Thus, operation similar to regular magazines for firearms may be enabled as discharge blocking device 100 provides accommodation of cartridges, and also engagement of these cartridges with the corresponding firearm upon coupling.

Figure 4B:
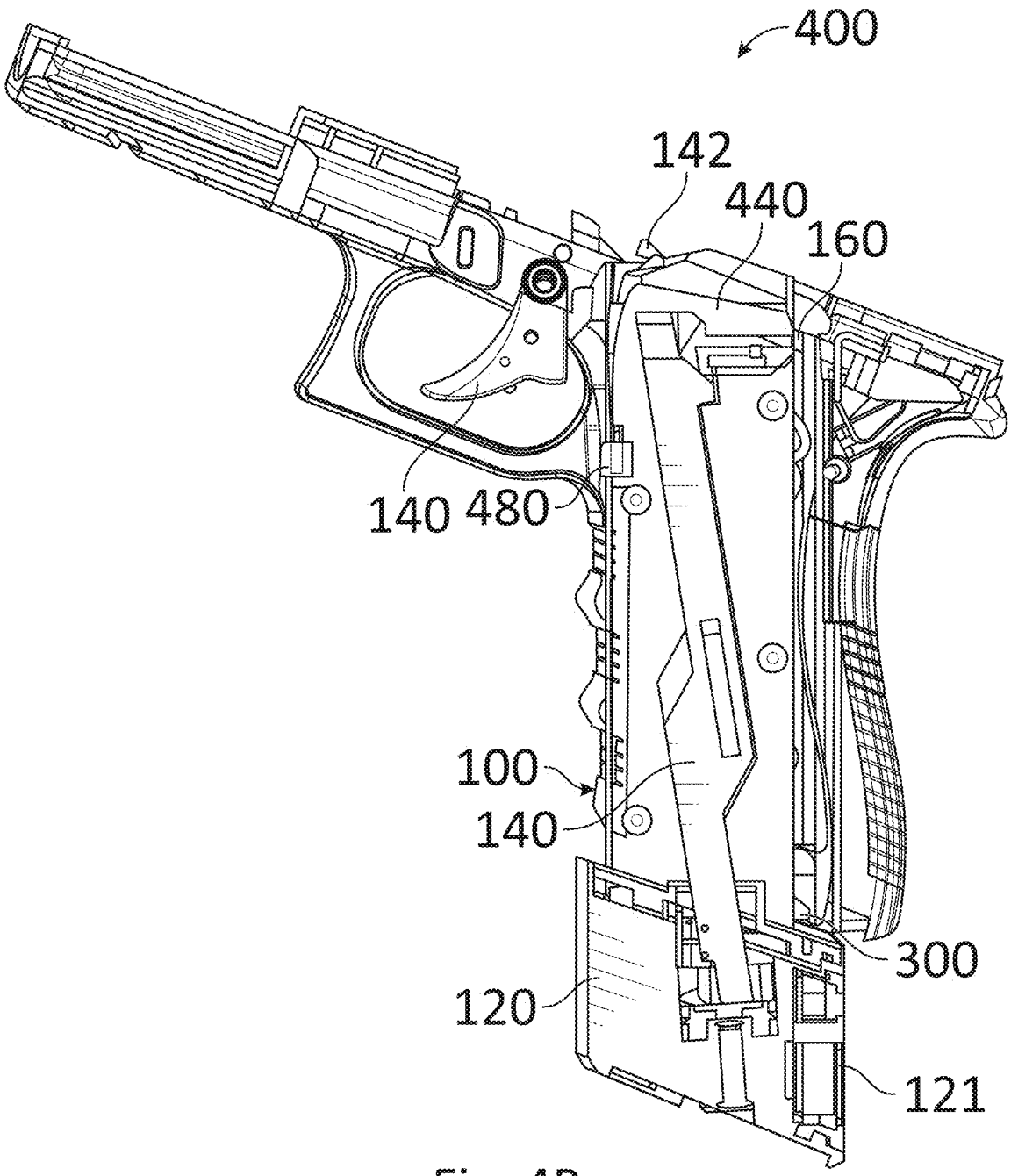
FIG. 4B schematically illustrates a cross-sectional view of the discharge blocking device accommodated in the magazine housing of a firearm, according to a preferred embodiment of the invention.

In some embodiments, cover 110 may further include a recess 180 that corresponds in shape to an external magazine catch 480 (as shown in FIGS. 4A-4B) in order to allow locking the position of discharge blocking device 100 within the magazine housing once the external magazine catch 480 is inserted thereto. Thus, cover 110 may provide features similar to commercially available firearm magazines, as well as enhanced features for blocking discharge upon the selection of an authorized user.

It may be appreciated that a locking element (or latch) 140, accommodated within discharge blocking device 100, may be configured to be capable of at least partially protruding from top segment 130 to block discharge of the firearm due to movement of element 140 from one (stowed) position to another (extended) position. In some embodiments, locking element 140 may be at least partially accommodated within a channel 114 inside cover 110. When discharge blocking device 100 is enabled (e.g., in an unlocked mode) the firearm may be immediately operated, with locking element 140 configured to move within channel 114 between locked and unlocked states. It is noted that the operation of locking element 140, for instance with movement within channel 114, may be configured to allow locking element 140 to protrude from discharge blocking device 100. Protrusion of locking element 140 may be performed in order to engage and/or block a compatible trigger bar of the firearm so as to push the trigger bar into a locked position during transition from unlocked state to locked state and thereby block the discharge.

According to some embodiments, a top portion 142 of locking element 140 may protrude from top segment 130, in order to allow top portion 142 to engage the trigger bar when locking element 140 is in a locked state and top portion 142 protrudes from top segment 130. It may be appreciated that protruding top portion 142 may prevent movement of the trigger bar rearwards, namely towards the back of the barrel of the firearm, and thereby may prevent and/or block the discharge, as further described hereinafter.

According to some embodiments, a side jag 144 of locking element 140 may protrude from channel 114 and be accommodated within volume 150 such that movement of locking element 140 within channel 114 may also move side jag 144 within volume 150 accordingly. Discharge blocking device 100 may further include a wedge 160 that may be built in into cover 110. In some embodiments, wedge 160 may at least partially protrude into volume 150 from a first end, for example when discharge blocking device 100 is in unlocked state. In some embodiments, wedge 160 may at least partially protrude from cover 110, through a compatible window 170, from a second end opposite to the first end, for example when discharge blocking device 100 is in a locked state. It may be appreciated that movement of locking element 140 from unlocked state to locked state (for example causing top portion 142 to protrude from top segment 130) may cause side jag 144 to move within volume 150 so as to engage the first end of wedge 160.

Figure 2B:
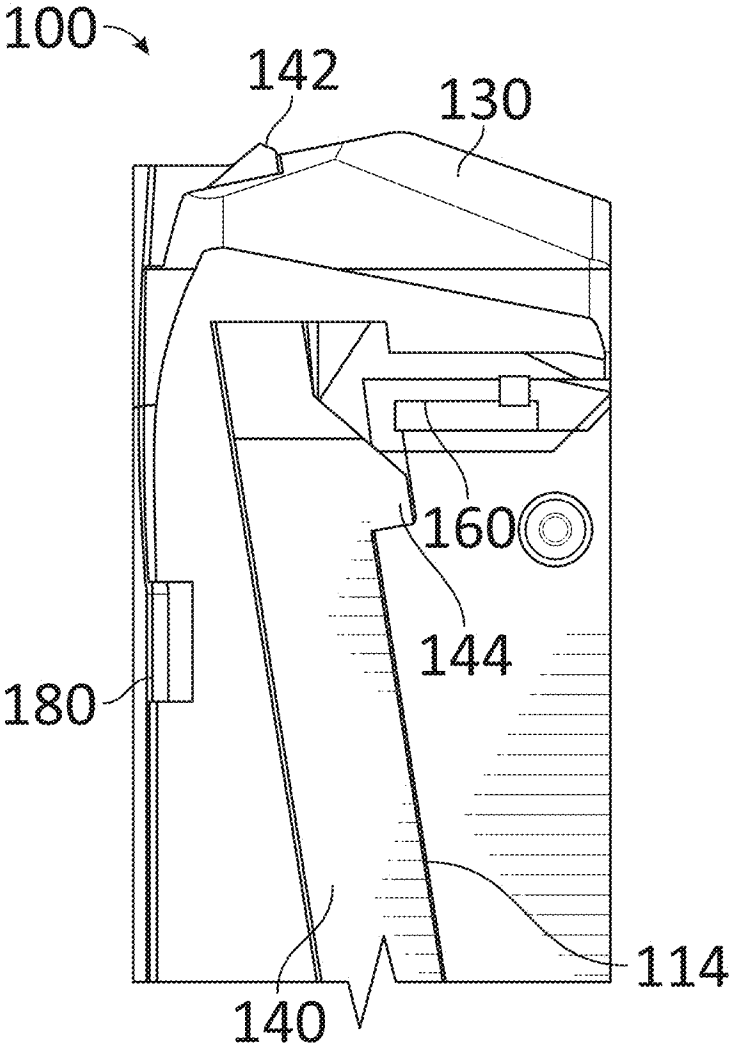
FIG. 2B schematically illustrates a left side partial cross-sectional view of the discharge blocking device in an unlocked state, according to some embodiments of the invention.
Figure 2A:
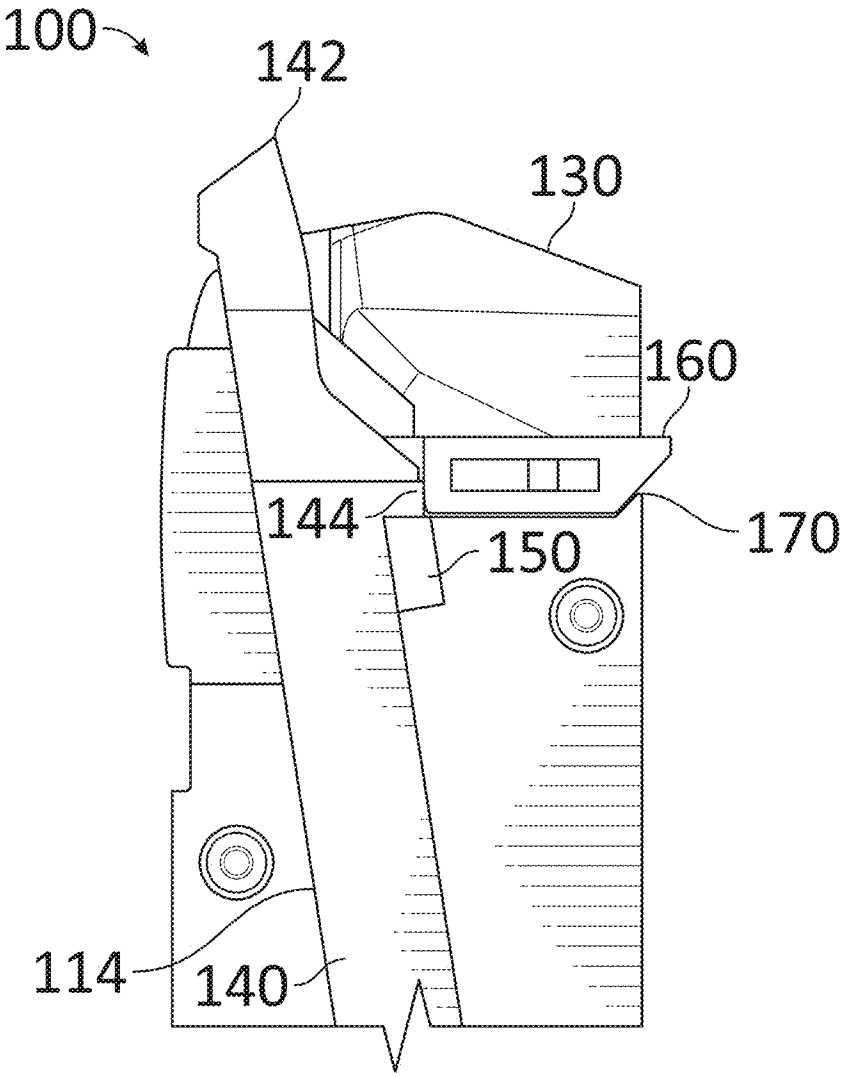
FIG. 2A schematically illustrates a left side partial cross-sectional view of the discharge blocking device in a locked state, according to some embodiments of the invention.

Reference is now made to FIGS. 2A-2B, which schematically illustrate a left side partial cross-sectional view of discharge blocking device 100 in locked and in unlocked states, respectively, according to some embodiments of the invention.

In some embodiments, wedge 160 may have a shape corresponding to the shape of side jag 144, such that movement of side jag 144 from unlocked state (e.g., as shown in FIG. 2B) to locked state (e.g., as shown in FIG. 2A) may at least partially push one end of wedge 160 outwardly from cover 110 in order to at least partially protrude the second end of wedge 160 from window 170, out of cover 110. Thus, in a locked state while top portion 142 may protrude from top segment 130 to engage and/or block the trigger bar, side jag 144 may move the second end of wedge 160 so as to at least partially protrude the second end of wedge 160 from window 170. It may be appreciated that wedge 160 protruding from window 170 may engage with magazine housing and thereby prevent the safety mechanism from being removed from the firearm. In some embodiments, top portion 142 may block movement of the trigger bar backwards at substantially the same time as wedge 160 blocks movement forwards. In some embodiments, wedge 160 protruding from window 170 may lock discharge blocking device 100 to the magazine housing and thereby prevent removal of the discharge blocking device 100, as further described hereinafter.

In some embodiments, in an unlocked state side jag 144 may move within volume 150 such that wedge 160 is not engaged to it, and thereby second end of wedge 160 may not engage the magazine housing (e.g., as shown in FIG. 4B). In some embodiments, wedge 160 may have a spring like effect (e.g., spring loaded) that may enable self-inward return towards volume 150 when not engaged by side jag 144.

Referring back to FIG. 1B, locking element 140 may further include a bottom portion 141 (e.g., on the opposite side of locking element 140 in respect of top portion 142) that may be in contact with a sensor 191 that is configured to detect movement of bottom portion 141 between locked and unlocked modes. For example, sensor 191 may be an optical sensor having an optical path that is blocked when locking element 140 is in unlocked mode. In some embodiments, sensor 191 may be operably coupled to a central controller 310 (e.g., a processor, denoted "PCB" in FIG. 3B) that is configured to electrically control the operation of discharge blocking device 100. In some embodiments, in case of electrical malfunction, manual operation of discharge blocking device 100 may also be possible, as further described hereinafter.

According to some embodiments, bottom portion 141 may be also in contact with a switching element 190 that is configured to allow switching between locked and unlocked modes. Switching element 190 may be operationally coupled to a motor 122 (e.g., accommodated within base 120) capable of electrically and/or mechanically moving locking element 140 (as further described hereinafter) between locked and unlocked modes. In some embodiments, switching element 190 may be of helical shape and/or include a lead screw, which is capable of translating rotational movement into linear movement, so as to allow rotational movement of switching element 190 to be translated into lateral movement of locking element 140. Thus, rotational movement of switching element 190 may move bottom portion 141 coupled thereto and thereby linearly move locking element 140 in channel 114 between locked and unlocked states. In some embodiments, if bottom portion 141 engages the bottom end of switching element 190, then discharge blocking device 100 is in "FIRE" mode and discharge is allowed, whereas if bottom portion 141 engages the top end of switching element 190, then discharge blocking device 100 is in "SAFE" mode (e.g., as shown in FIG. 1B) and discharge is prevented with blocking of the trigger bar.

According to some embodiments, discharge blocking device 100 may further include a user identification segment 121. User identification segment 121 may be operably coupled to the locking mechanism (e.g., inside base 120) within discharge blocking device 100 and thereby coupled to locking element 140 so as to disable the blocking, i.e. switch to "unlocked" mode upon identification of an authorized user. User identification segment 121 may include biometric user identification (e.g., fingerprint identification) unit, password identification means with a dedicated user interface, or any other identification means (for example buttons to be pressed by the user, for example for entering a secret buttons' sequence, and/or wireless communication means such as radio frequency or near field communication). In some embodiments, user identification segment 121 may further include storage of ID data for storing ID data of authorized users. In some embodiments, discharge blocking device 100 may further include at least one indicator that is configured to indicate the locking mode of discharge blocking device 100, e.g., "locked", "unlocked", "error", etc. The user may control the mode of discharge (and thereby change the indication of the indicator) in order to change the mode of discharge blocking device 100, for instance by placing a finger on a fingerprint sensor and identifying via fingerprint in order to switch the device to an "unlocked" mode. In some embodiments, changing from "unlocked" to "locked" mode may be done automatically by the device when the safety device detects an insertion of safety device into magazine housing. It should be noted that user identification segment 121 and the at least one indicator may be electrically coupled to the locking mechanism, e.g., by means of controller 310, so as to allow control of the locking mode of discharge blocking device 100. In some embodiments, a central controller 310 (e.g., a processing unit, as shown in FIG. 3B) may control the operation of discharge blocking device. Specifically, controller, such as controller 310, may control switching between "locked" and "unlocked" modes based on input from user identification segment 121.

In some non-limiting embodiments, discharge blocking device 100 may further include a power storage unit, e.g., a battery, configured to provide power for the locking mechanism, so as to allow operation of the mechanical elements. In some embodiments, a battery status indicator may also be provided with the indicators. It is appreciated that, upon insertion into a magazine housing, discharge blocking device 100 may become automatically in a "locked" state with locking element 140 protruding and blocking the trigger bar of the firearm.

In some embodiments, the locking mechanism may further include a communication unit capable of sending and receiving wireless data (e.g., via Wi-Fi, Bluetooth, GPS, or cellular networks). The communication unit may therefore allow a user to set conditions for the discharge blocking device to become locked or unlocked, as may be desired. For example, once the discharge blocking device detects data that indicates that the firearm is inside an authorized area (for instance data from a GPS device), then the locking is removed and the firearm may be used. Alternatively, a dedicated signal may be wirelessly received by the discharge blocking device such that a user may select that in a particular time the locking is removed, no matter who operates the firearm. For example, a training officer at the police academy may wirelessly remove the locking from multiple firearms that are scheduled for practice.

Figure 3A:
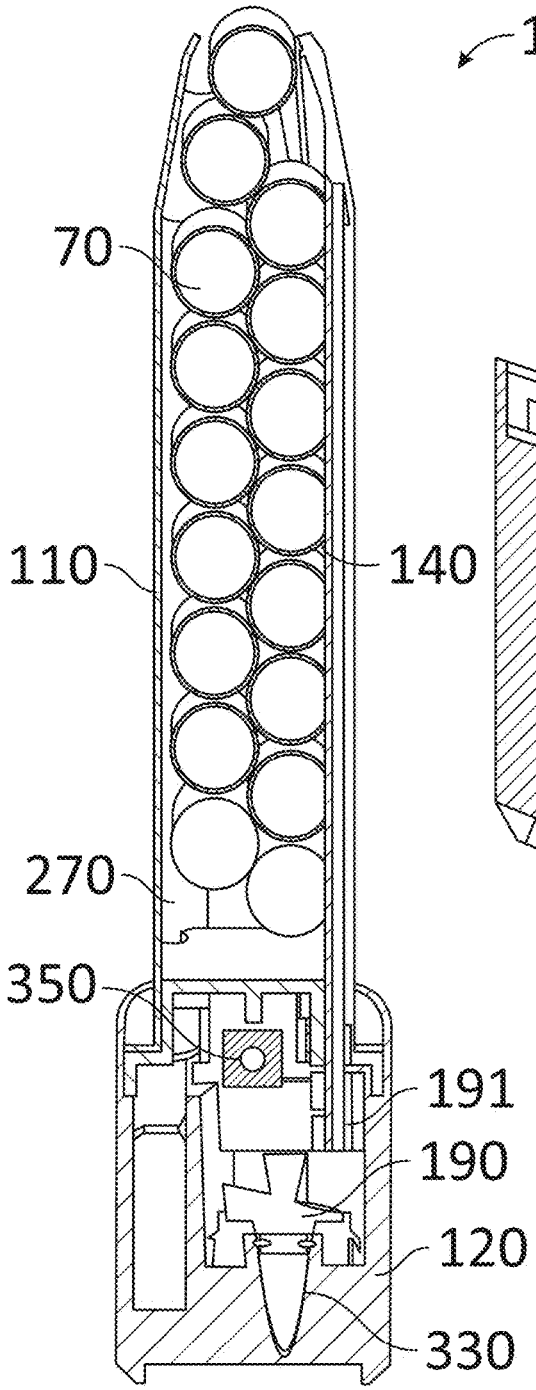
FIG. 3A schematically illustrates a cross-sectional view of the discharge blocking device, according to a preferred embodiment of the invention.
Figure 3B:
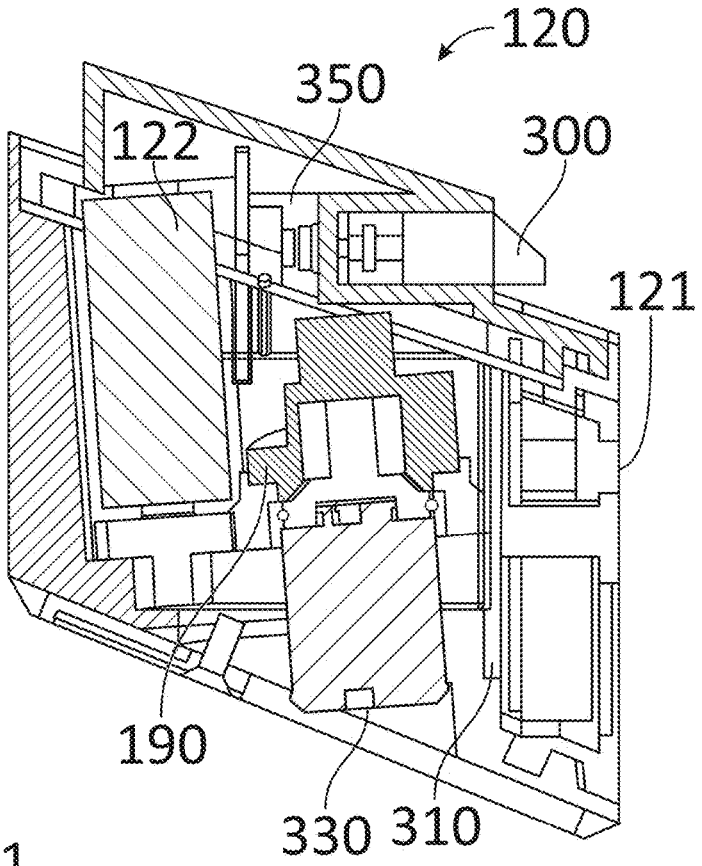
FIG. 3B schematically illustrates a cross-sectional view of the base of the discharge blocking device, according to a preferred embodiment of the invention.

Reference is now made to FIG. 3A, which schematically illustrates a cross-sectional view of discharge blocking device 100, wherein the cross-section plane is performed along imaginary dashed line 101 of FIG. 1A, according to some embodiments of the invention. Discharge blocking device 100 may include a space 270 covered by cover 110 and dedicated for accommodation of cartridges 70 (e.g., fourteen cartridges in a double row) as in a commercially available magazine. In some embodiments, the external structure of cover 110 may correspond to that of a commercially available magazine capable of accommodating cartridges (e.g., in a stacked column), such that, when discharge blocking safety mechanism is provided, for instance locking element 140 embedded into the wall of cover 110, cartridges may be accommodated within discharge blocking device 100. It is noted that discharge blocking device 100 may be operated both as a regular magazine, storing cartridges at dedicated space 270, such that the firearm can be used in the regular fashion, as well as be operated as a discharge blocking device that prevents unwanted (or unauthorized) use of firearm, when in locked mode.

Reference is now made to FIG. 3B, which schematically illustrates a cross-sectional view of base 120, wherein the cross-section is carried out parallel to locking element 140, according to some embodiments of the invention. In some embodiments, base 120 includes a positioning lever 300, embedded therein, which is initially in an "open" state and configured to detect accommodation of discharge blocking device 100 within the magazine housing. Positioning lever 300 may be configured to be capable of protruding from base 120, such that, upon insertion into the magazine housing of a firearm, positioning lever 300 may engage the inner wall of the magazine housing and be forced to move into base 120 (e.g., by means of a loaded spring). Upon accommodation within the magazine housing and detection thereof, positioning lever 300 may move back into base 120 and switch to a "closed" state. In some embodiments, at a "closed" state positioning lever 300 may engage a positioning sensor 350 that is configured to provide a signal (e.g., to central controller 310) corresponding to detected states.

It may be appreciated that positioning lever 300 may provide an initial locking mechanism, that may be configured to disable the operation of the firearm unless in "closed" state. In some embodiments, positioning lever 300 may be coupled to the positioning sensor 350 that is capable of electrically detecting change between "open" and "closed" states.

Upon switching to a "closed" state (i.e., detection of discharge blocking device 100 within the magazine housing) by positioning lever 300, locking element 140 may, according to embodiments of the present invention, be automatically operated to move to a "locked" mode and block the trigger bar of the firearm so as to block any discharge until the user switches to "unlocked" mode. For example, upon insertion into a magazine housing, positioning lever 300 may engage the inner wall of the magazine housing and be forced to move inwardly into base 120 to engage positioning sensor 350. Positioning sensor 350 may then send a signal to central controller 310 indicating that discharge blocking device 100 is in a "closed state" (e.g., within the magazine housing). This may cause control motor 122 to move locking element 140 to a "locked" position blocking the trigger bar. In some embodiments, motor 122 may be coupled to switching element 190 with movable gears such that movement of a first gear coupled to motor 122 may move second gear coupled to switching element 190.

It should be noted that, initially, positioning lever 300 may be in an "open" state and locking element 140 is in "unlocked" mode, such that, upon engagement with the magazine housing positioning lever 300 may switch to "closed" state and thereby locking element 140 moved to a "locked" mode. Thus, discharge blocking device 100 may automatically switch to "locked" mode and prevent discharge upon engagement with the magazine housing.

It may be appreciated that positioning lever 300 and wedge 160 protrude from the back side of cover 110 (adjacent to user identification segment 121), opposite to top portion 142, protruding from the frontal side of cover 110 (the side that points toward the barrel end when inserted into the firearm).

According to some embodiments, discharge blocking device 100 may further include a manual override segment 330 that is configured to allow a user to manually switch between locked and unlocked states, for instance when motor 122 is not responsive, when power source providing power to the control system is lost, and the like. In some embodiments, a user may operate manual override segment 330 using a dedicated key. In some embodiments, a user may connect an external device to control discharge blocking device 100 (e.g., via USB cable), and thereby control the controller, for example managing user settings or upgrading the software.

Reference is now made to FIGS. 4A-4B, which show the discharge blocking device 100 accommodated in a magazine housing of a compatible firearm 400, with top portion of firearm 400 removed. FIG. 4A schematically illustrates a perspective view of discharge blocking device 100 accommodated in the magazine housing of a firearm 400, and FIG. 4B schematically illustrates a cross-sectional view of the same 120, according to some embodiments of the invention.

It may be appreciated that the user cannot squeeze the trigger to discharge the firearm (in a locked mode) since, upon insertion into magazine housing of firearm 400, locking element 140 may prevent any backward movement of trigger bar 440. In order to allow discharge, the user may change the state of discharge blocking device 100 from "locked" to "unlocked", for example by using user identification segment 121 such that locking element 140 moves towards base 120 and no longer protrudes from the discharge blocking device 100, and then trigger bar 440 may be operated to discharge the firearm 400.

Figure 5A:
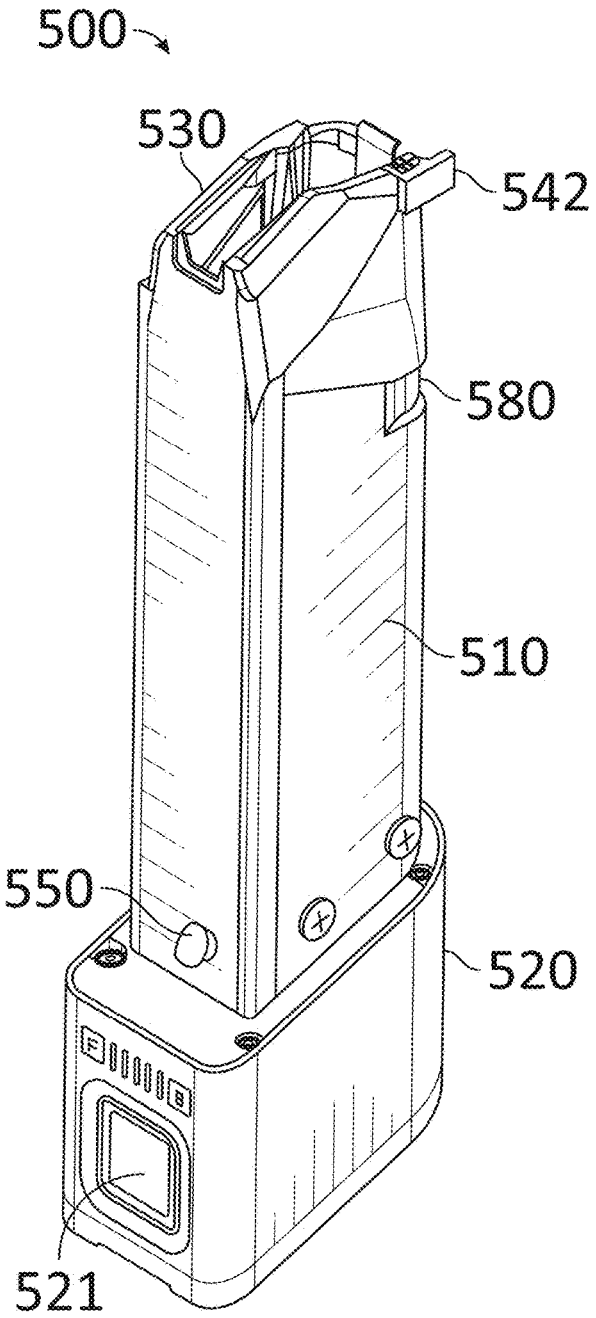
FIG. 5A schematically illustrates a right perspective view of a rotating element discharge blocking device, according to some embodiments of the invention.
Figure 5B:
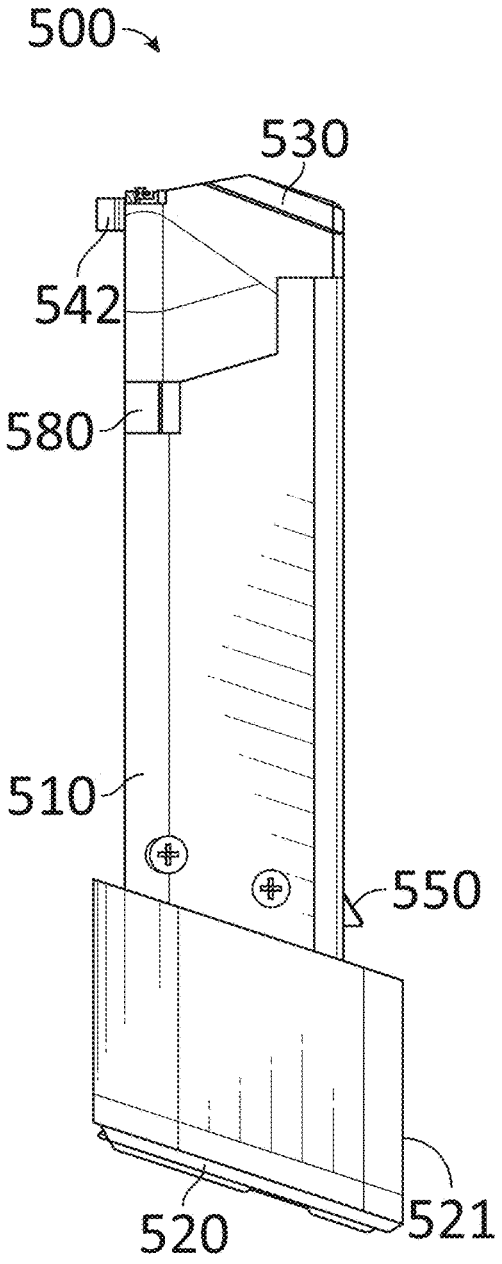
FIG. 5B schematically illustrates a left side view of the rotating element discharge blocking device, according to some embodiments of the invention.

Reference is now made to FIGS. 5A-5B, which show a rotating element discharge blocking device 500 in a locked mode. FIG. 5A schematically illustrates a right perspective view (with respect to the shooting direction of the firearm) of a rotating element discharge blocking device 500, and FIG. 5B schematically illustrates a left side view of the rotating element discharge blocking device 500, according to some embodiments of the invention.

It is appreciated that rotating element discharge blocking device 500 (as a safety magazine) according to the invention is adapted to allow a user, operating a firearm, to block the discharge by having the safety mechanism (within the discharge blocking device) in a locked mode, such that the discharge may be enabled only according to the selection by an authorized user with the safety mechanism. Therefore, in addition to the existing safety selector on the firearm, rotating element discharge blocking device 500 may provide further means for controlling the firing mode of the firearm (e.g., locked or unlocked mode), further described hereinafter.

Discharge blocking device 500 may include a cover 510 having a structure that is compatible with some commercially available magazines for firearms, for instance having a shape and dimensions corresponding to and adapted to be inserted into a magazine housing of, for example, a Glock® handgun. Discharge blocking device 500 may further include a base 520 that at least partially covers a safety mechanism that is configured to block the discharge.

In some embodiments, base 520 may have a shape protruding with respect to cover 510, such that easy gripping (of base 520) by a user operating the firearm may be allowed for insertion into and removal from the firearm. It is, therefore, appreciated that only with the base 520, the difference from commercially available magazines (for example, a Glock® handgun) may be observed, when the safety magazine is inserted into a firearm.

In some embodiments, cover 510 may have a top segment 530 that is configured to couple with the magazine housing in a compatible firearm. Top segment 530 may have an opening for insertion of cartridges therein (e.g., in a single column or stacked), such that the cartridge that is last inserted partially protrudes through top segment 530 in order to engage the firearm upon coupling with the magazine housing. Thus, operation similar to regular magazines for firearms may be enabled as rotating element discharge blocking device 500 provides accommodation of cartridges, and also engagement of these cartridges with the corresponding firearm upon coupling.

In some embodiments, cover 510 may further include a recess 580 that corresponds in shape to an external magazine catch in order to allow locking the position of rotating element discharge blocking device 500 within the magazine housing once the external magazine catch is inserted thereto. Thus, cover 510 may provide features similar to commercially available firearm magazines, as well as enhanced features for blocking discharge upon the selection of an authorized user.

According to some embodiments, rotating element discharge blocking device 500 may further include a positioning switch 550 which is initially in an "open" state and configured to detect accommodation of rotating element discharge blocking device 500 within the magazine housing. Positioning switch 550 (e.g., spring loaded) may be configured to be capable of protruding from base 520, such that upon insertion into the magazine housing of a firearm, positioning switch 550 may engage the inner wall of the magazine housing and be forced to move into base 520. Upon accommodation within the magazine housing and detection thereof, positioning switch 550 may move back into base 520 and switch to a "closed" state. In some embodiments, at a "closed" state positioning switch 550 may engage a corresponding positioning sensor 555 (e.g., as shown in FIG. 6B) that is configured to provide a signal (e.g., to the central controller) corresponding to detected states.

Figure 6A:
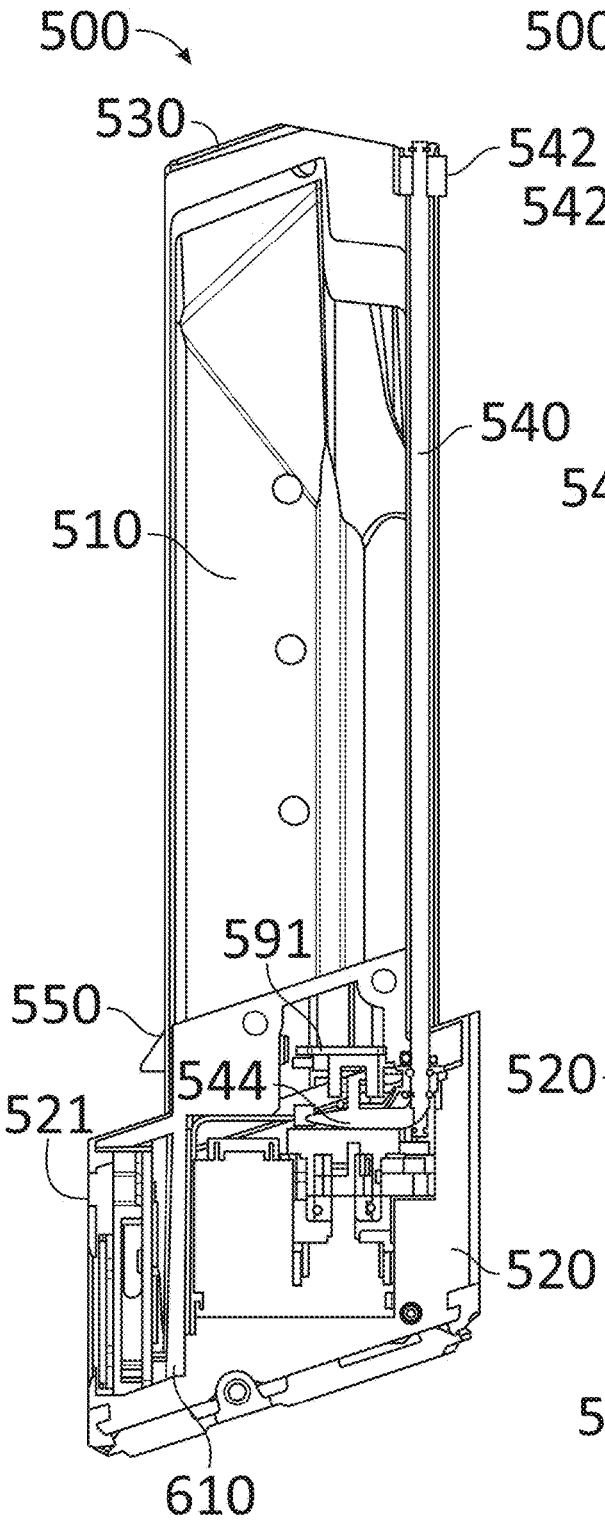
FIG. 6A schematically illustrates a right side cross-sectional view of the rotating element discharge blocking device, according to a preferred embodiment of the invention.
Figure 6B:
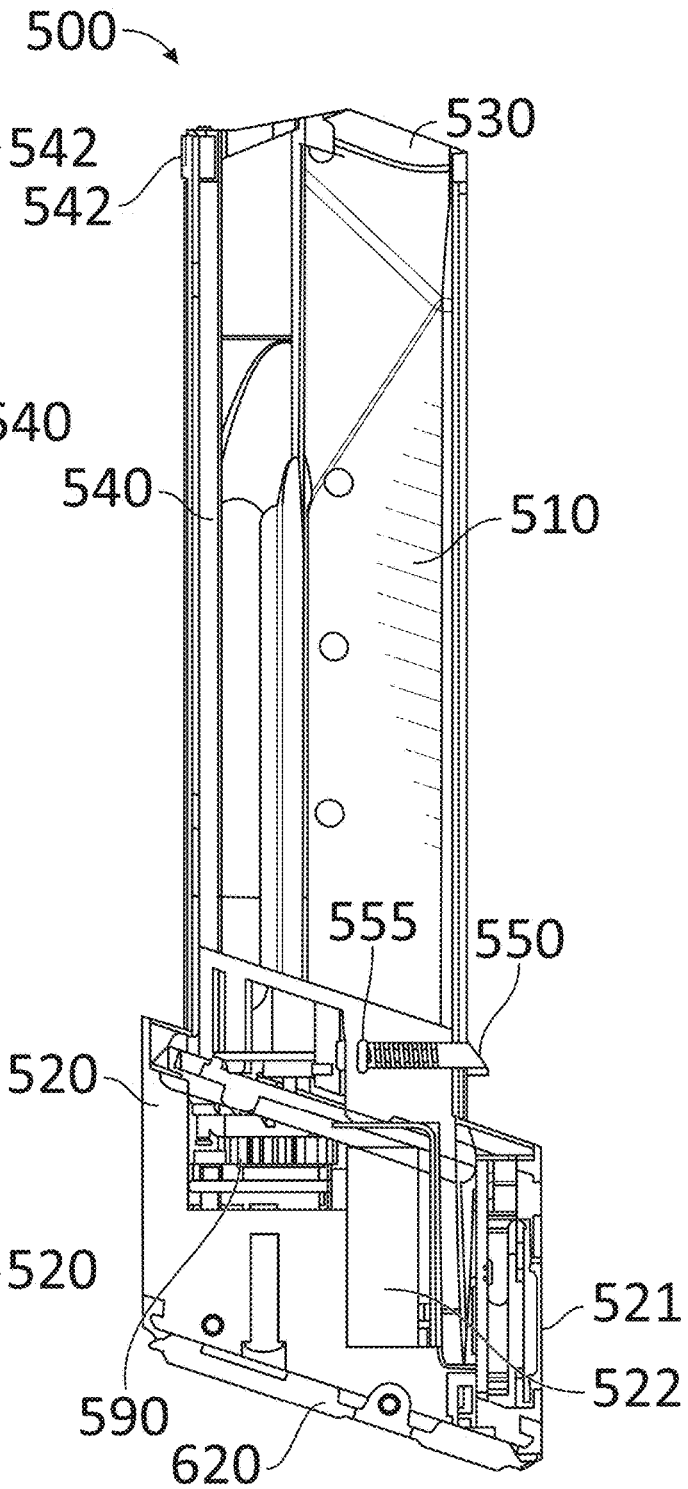
FIG. 6B schematically illustrates a left side cross-sectional view of the rotating element discharge blocking device, according to a preferred embodiment of the invention.

Upon switching to a "closed" state (i.e., detection of rotating element discharge blocking device 500 within the magazine housing) by positioning switch 550, a rotating locking element 540 (e.g., as shown in FIGS. 6A-6B) may be automatically operated to move to a "locked" mode and block the trigger bar of the firearm so as to block any discharge until an authorized user switches to "unlocked" mode. For example, upon insertion into a magazine housing, positioning switch 550 may engage the inner wall of the magazine housing and move back into base 520 to engage the positioning sensor 555 (e.g., as shown in FIG. 6B). A corresponding signal may then be sent to the central controller that rotating element discharge blocking device 500 is in a "closed state" (e.g., within the magazine housing) so as to move rotating projection 542 to a "locked" position blocking the trigger bar. In some embodiments, in a locked position, rotating projection 542 may prevent extraction of rotating element discharge blocking device 500 from the firearm and thereby prevent ejection of discharge blocking device 500 (and replacement with a standard magazine) until returned to unlocked position.

It should be noted that, initially, positioning switch 550 may be in an "open" state and rotating locking element 540 is in "unlocked" mode, such that upon engagement with the magazine housing positioning switch 550 may switch to "closed" state and thereby rotating projection 542 moved to a "locked" mode. Thus, rotating element discharge blocking device 500 may automatically switch to "locked" mode and prevent discharge upon engagement with the magazine housing.

According to some embodiments, rotating element discharge blocking device 500 may further include a user identification segment 521. User identification segment 521 may be operably coupled to the locking mechanism (e.g., inside base 520) within rotating element discharge blocking device 500 configured to disable the blocking, i.e., switch to "unlocked" mode upon identification of an authorized user. User identification segment 521 may include biometric user identification (e.g., fingerprint identification), password identification with a dedicated user interface, wireless communication means such as radio frequency or near field communication, or any other identification means (for example buttons to be pressed by the user). In some embodiments, user identification segment 521 may further include storage of ID data for storing ID data of authorized users. In some embodiments, rotating element discharge blocking device 500 may further include at least one indicator that is configured to indicate the locking mode of rotating element discharge blocking device 500, e.g., "locked", "unlocked", "error", etc. In some embodiments, mode of discharge (and thereby change the indication of the indicator) in order to change the mode of discharge blocking device 500, for instance by placing a finger on a fingerprint sensor and identifying via fingerprint in order to switch the device to an "unlocked" mode. In some embodiments, changing from "unlocked" to "locked" mode may be done automatically by the device when the safety device detects an insertion of safety device into magazine housing.

It should be noted that user identification segment 521 and indicator may be electrically coupled to the locking mechanism so as to allow control of the locking mode of rotating element discharge blocking device 500. In some embodiments, a central controller (e.g., a processing unit) may control the operation of rotating element discharge blocking device 500. Specifically, such a controller may control switching between "locked" and "unlocked" modes based on input from user identification segment 521.

In some non-limiting embodiments, rotating element discharge blocking device 500 may further include a power storage unit, e.g., a battery, configured to provide power for the locking mechanism, so as to allow operation of the mechanical elements. In some embodiments, a battery status indicator may also be provided with the indicators. It is appreciated that, upon insertion into a magazine housing, rotating element discharge blocking device 500 may be activated automatically and set to a "locked" state with a rotating projection 542 of locking element 540, protruding and blocking the trigger bar of the firearm, as further described in FIGS. 7A-7B.

In some embodiments, the locking mechanism (e.g., within base 520) may further include a communication unit capable of sending and receiving wireless data (e.g., via Wi-Fi, Bluetooth, GPS, or cellular networks). The communication unit may therefore allow a user to set conditions for the discharge blocking device to become locked or unlocked, as may be desired. For example, once the discharge blocking device detects data that indicates that the firearm is inside an authorized area (for instance data from a GPS device), then the locking is removed and the firearm may be used. Alternatively, a dedicated signal may be wirelessly received by the discharge blocking device such that a user may select that in a particular time the locking is removed, no matter who operates the firearm. For example, a training officer at the police academy may wirelessly remove the locking from multiple firearms that are scheduled for practice.

Reference is now made to FIGS. 6A-6B, which show a cross-sectional view of the rotating element discharge blocking device 500 in an unlocked mode. FIG. 6A schematically illustrates a right side cross-sectional view (with respect to the shooting direction of the firearm) of the rotating element discharge blocking device 500, and FIG. 6B schematically illustrates a left side cross-sectional view of the rotating element discharge blocking device 500, according to some embodiments of the invention.

It may be appreciated that a rotating projection 542 of rotating locking element 540, accommodated within rotating element discharge blocking device 500, may be configured to be capable of protruding from top segment 130 to block discharge of the firearm. In some embodiments, rotating locking element 540 may be at least partially accommodated within a wall inside cover 510. When rotating element discharge blocking device 500 is enabled (e.g., in an unlocked mode) the firearm may be immediately operated, where rotating locking element 540 may be configured to allow movement between locked and unlocked states. It is noted that the operation of rotating locking element 540 may be configured to allow rotating locking element 540 to rotatably protrude from rotating element discharge blocking device 500 in order to engage and/or block a compatible trigger bar of the firearm so as to push the trigger bar into a locked position during transition from unlocked state to locked state and thereby block the discharge. It may be appreciated that rotating projection 542 may prevent movement of the trigger bar rearwards, namely towards the back of the barrel of the firearm, and thereby may prevent and/or block the discharge, as further described in FIGS. 7A-7B.

In various embodiments, rotating locking element 540 may be accommodated within the wall of cover 510. In some embodiments, rotating locking element 540 may be a rotatable rod configured to rotate rotating projection 542 between locked and unlocked states the rod and accommodated within a corner of cover 510, thereby occupying minimal space and allowing accommodation of bullets within a dedicated space inside cover 510, thereby allowing use of standard magazines. It may be appreciated that rotating locking element may rotate about an axis that is aligned with the longitudinal dimension of the cover.

Figure 8:
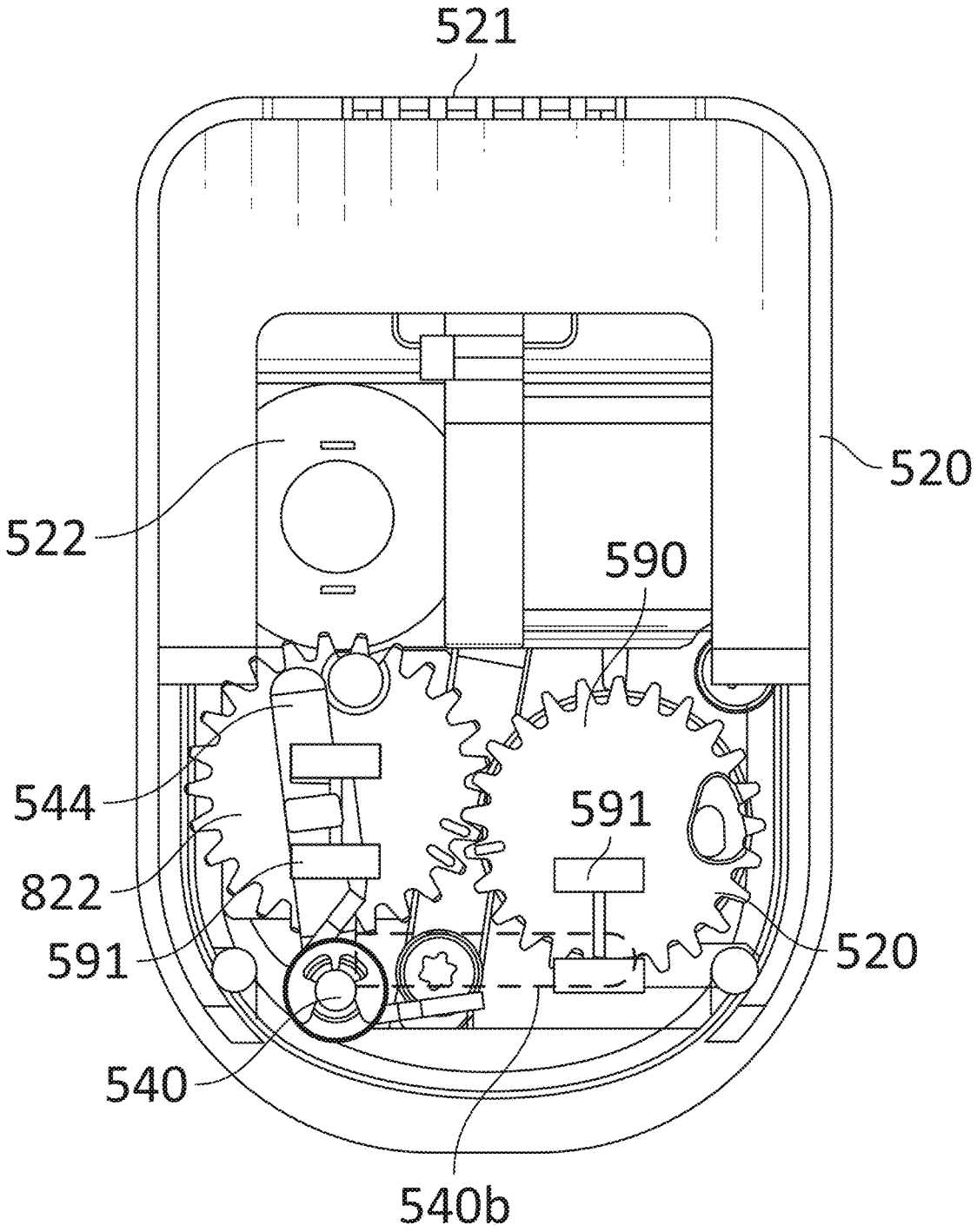
FIG. 8 schematically illustrates a cross-sectional view of rotating element discharge blocking device, according to a preferred embodiment of the invention.

In various embodiments, rotating locking element 540 may further include a bottom portion 544 that may be in contact with a sensor 591 that is configured to detect movement of bottom portion 544 between locked and unlocked modes, as further described in FIG. 8. In some embodiments, sensor 591 may be operably coupled to a central controller 610 that is configured to electrically control the operation of discharge blocking device 500. In some embodiments, in case of electrical malfunction, manual operation of rotating element discharge blocking device 500 may also be possible, as further described hereinafter.

According to some embodiments, bottom portion 544 may be also in contact with a switching element 590 that is configured to allow switching between locked and unlocked modes. Switching element 590 may be operationally coupled to a motor 522 (e.g., accommodated within base 120) capable of electrically and/or mechanically moving rotating locking element 540 (as further described in FIG. 8) between locked and unlocked modes. In some embodiments, rotational movement of switching element 590 may move bottom portion 544 coupled thereto and thereby rotate locking element 540 between locked and unlocked states.

According to some embodiments, base 520 may include a bottom cover 620 configured to cover a manual override segment that is configured to allow a user to manually switch between locked and unlocked states, for instance when motor 522 is not responsive. In some embodiments, a user may operate the manual override segment using a dedicated key. In some embodiments, a user may connect an external device to control discharge blocking device 500 (e.g., via USB cable), and thereby control the controller, for example managing user settings or upgrading the software.

Figure 7A:
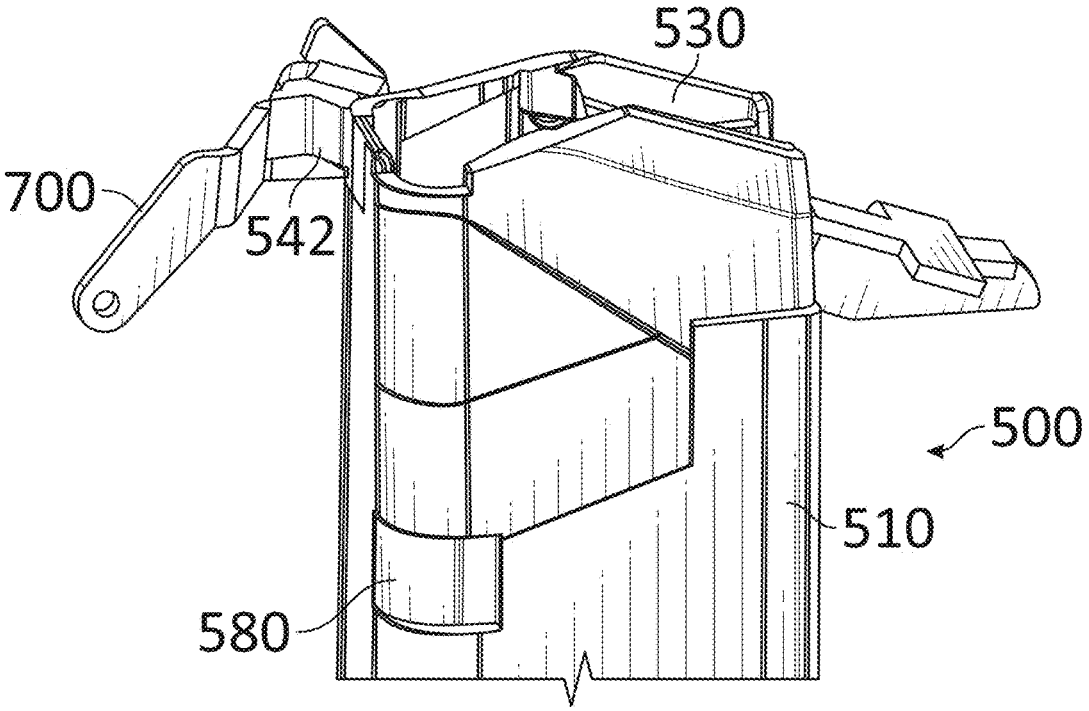
FIG. 7A schematically illustrates a partial perspective view of the rotating element discharge blocking device adjacent to a trigger bar in a locked mode, according to a preferred embodiment of the invention.
Figure 7B:
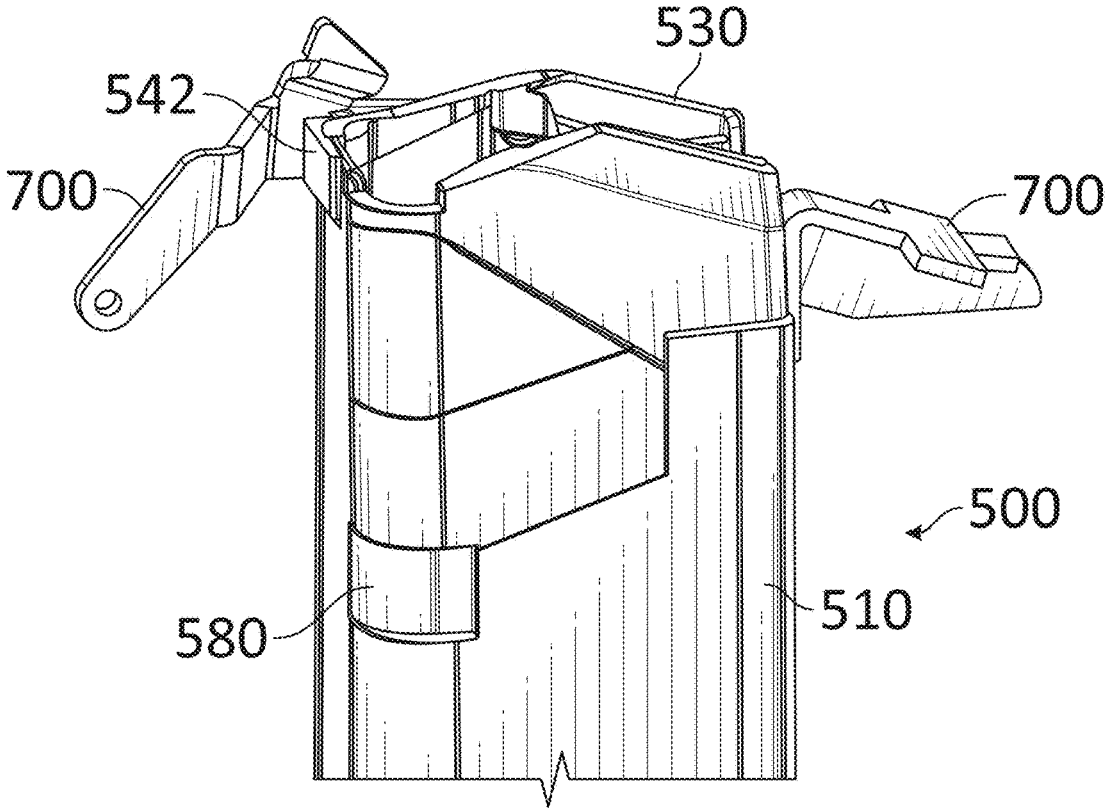
FIG. 7B schematically illustrates a partial perspective view of the rotating element discharge blocking device adjacent to a trigger bar in an unlocked mode, according to a preferred embodiment of the invention.

Reference is now made to FIGS. 7A-7B, which schematically illustrate a partial perspective view of rotating element discharge blocking device 500 adjacent to a trigger bar 700 in locked and unlocked modes, respectively, according to some embodiments of the invention. In various embodiments, rotation of rotating locking element 540 may rotate rotating projection 542 and thereby allow blocking of trigger bar 700.

It may be appreciated that the user cannot squeeze the trigger to discharge the firearm (in a locked mode) since upon insertion into magazine housing of a compatible firearm, rotating projection 542 of rotating locking element 540 may prevent any backward movement of trigger bar 700. In order to allow discharge, an authorized user may change the state of discharge blocking device 500 from "locked" to "unlocked", for example by using user identification segment 521 such that rotating projection 542 moves towards cover 510 and no longer projects from the discharge blocking device 500, and then trigger bar 700 may be operated to discharge the firearm 400.

Reference is now made to FIG. 8, which schematically illustrates a cross-sectional view of rotating element discharge blocking device 500, showing the locking mechanism within base 520 wherein the cross-section is carried out perpendicular to user identification segment 521, according to some embodiments of the invention. Base 520 may include a motor gear 822 operably coupled to motor 522, wherein central controller 610 is configured to send a signal to motor 522 to rotate motor gear 822. In some embodiments, motor gear 822 may be rotated manually, for instance using the manual override segment.

In some embodiments, motor gear 822 may be coupled to switching element 590 (e.g., a gear) such that rotation of motor gear 822 may consequently rotate switching element 590. In some embodiments, motor gear 822 may be operably coupled to bottom portion 544 of rotating locking element 540 such that rotation of motor gear 822 may also move bottom portion 544. It may be appreciated that FIG. 8 shows rotating element discharge blocking device 500 in an unlocked mode with bottom portion 544 adjacent to motor gear 822, and a dashed line indicated the position of bottom portion **540*b* in a locked mode, being adjacent to switching element 590**.

In some embodiments, switching from unlocked mode to locked mode may move motor gear 822 (and consequently rotate switching element 590) so as to move bottom portion 544 from being adjacent to motor gear 822 to being adjacent to switching element 590, and vice versa. It may be appreciated that movement of bottom portion 544 may accordingly rotate rotating locking element 540 and thereby rotate rotating projection 542 to switch between locked and unlocked modes.

Figure 9:
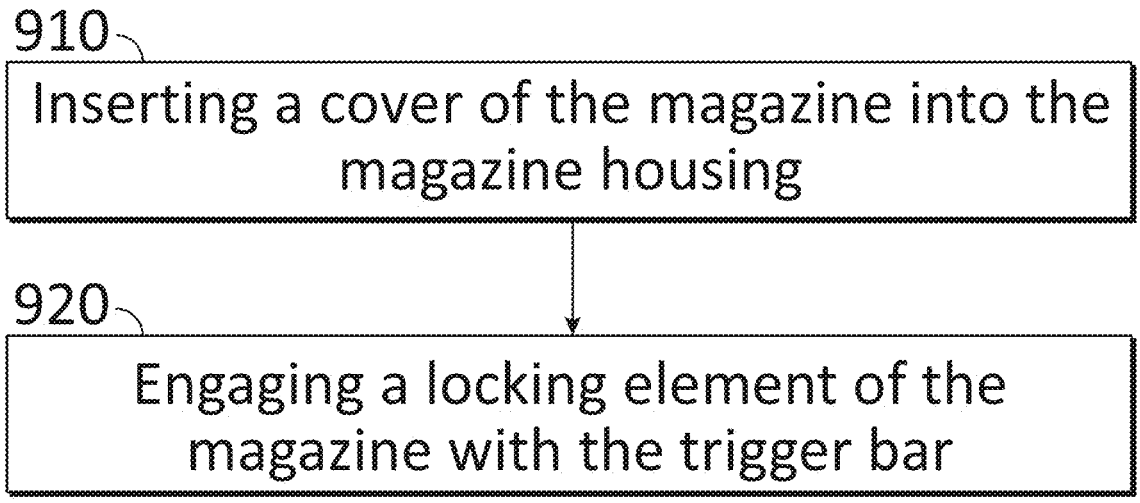
FIG. 9 shows a flow chart for a method of blocking discharge in a firearm, according to a preferred embodiment of the invention.

Reference is now made to FIG. 9, which shows a flow chart for a method of blocking discharge in a firearm, according to some embodiments of the invention. The method may include inserting a cover of the magazine into the magazine housing 910 and then engaging a locking element of the magazine with the trigger bar 920.

According to some of the various embodiments, a magazine may comprise an elongated tubular body. At least a portion of an upper end of the elongated tubular body may comprise a structure that is compatible with some commercially available magazines for firearms, for instance having a shape and dimensions corresponding to and adapted to be inserted into a magazine well of, for example, a Glock®, Smith&Wesson®, Ruger®, or SIG SAUER® handgun. At least a portion of a lower end of the elongated tubular body may be adapted to at least partially house a locking mechanism, a central controller, a user interface, at least one sensor, at least one indicator, at least one status indicator, a switching element, a motor, a motor gear, a rotor, a ball screw, a linear actuator, a Nitinol wire, a pulley, a lower end of an elongated shaft, combinations thereof, and/or the like.

Figure 10:
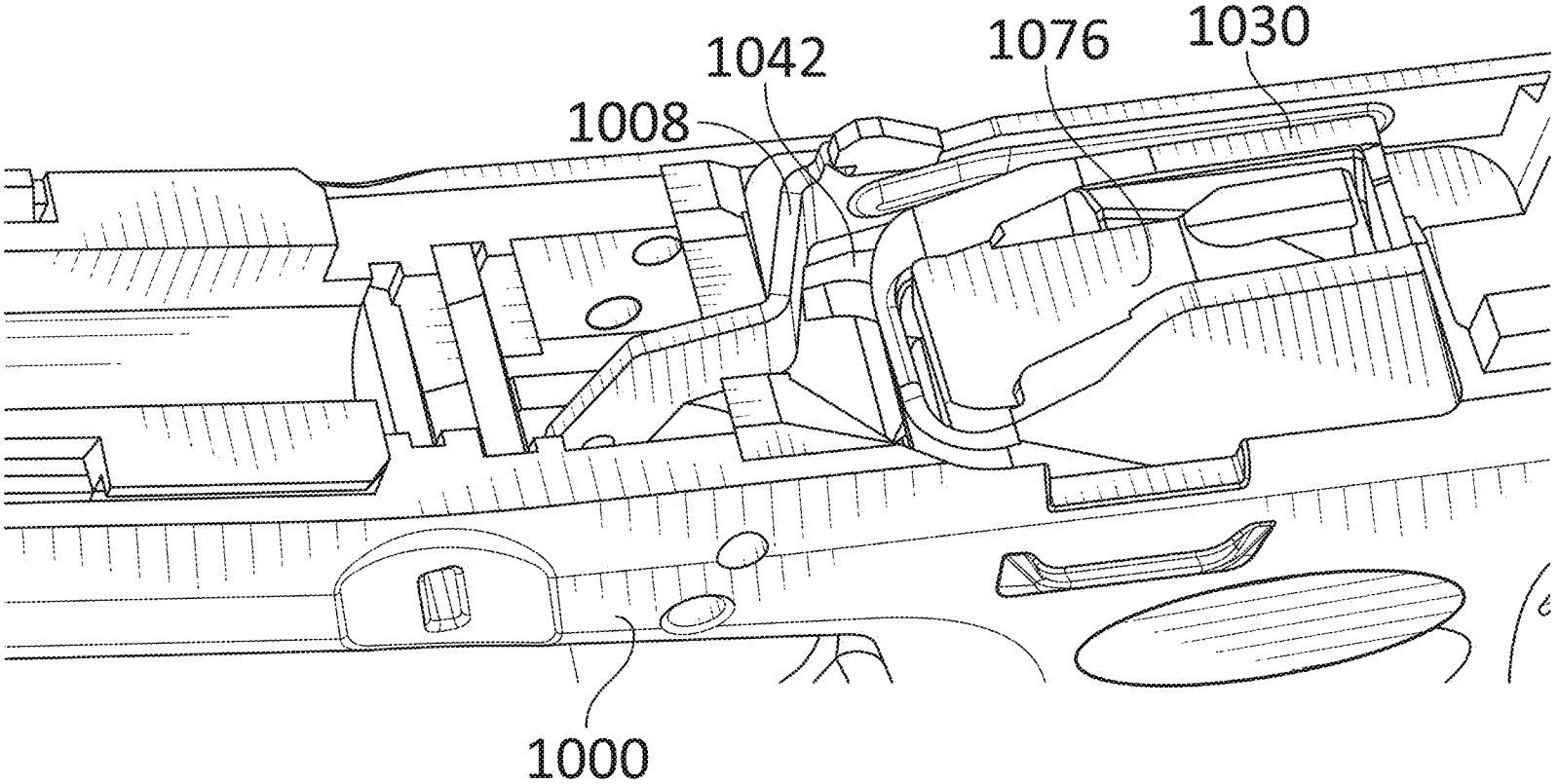
FIG. 10 schematically illustrates a magazine installed in a receiver of an example firearm and in a locked condition, according to some of the various embodiments.

Reference is now made to FIG. 10, which schematically illustrates a magazine installed in a receiver 1000 of an example firearm and in a locked condition, according to some of the various embodiments. The magazine may comprise an elongated tubular body. The elongated tubular body may comprise an exterior profile adapted to be closely received in a magazine well of the receiver 1000. The elongated tubular body may comprise an upper end 1030. The magazine may comprise a follower 1076, and a block element 1042. The block element 1042 may be moved into a first position (as shown) when a locking mechanism is in a locked condition. The firearm may comprise a trigger bar 1008. The trigger bar may be movable between a rest position (as shown) and a discharge position. Operation of the firearm may be prevented when the block element 1042 is in the first position. In the first position, the block element 1042 may be adapted to contact the trigger bar 1008 to prevent motion of the trigger bar 1008. Extraction of the magazine may be prevented when the block element 1042 is in the first position. In the first position, the block element 1042 may protrude from the exterior profile to prevent extraction of the magazine. In the first position, the block element 1042 may be adapted to contact a portion of the firearm to prevent extraction of the magazine.

Figure 11:
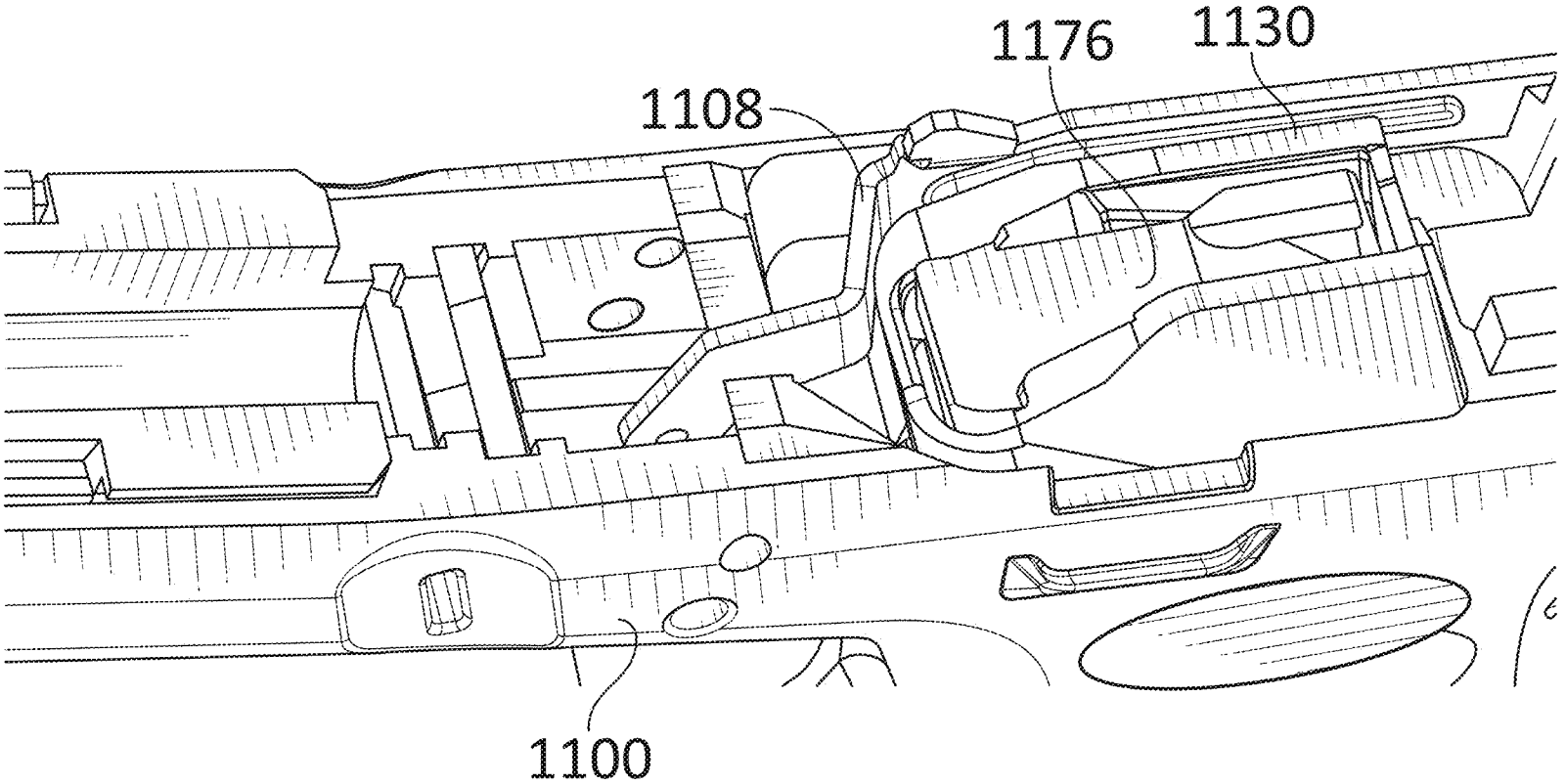
FIG. 11 schematically illustrates a magazine installed in a receiver of an example firearm and in an unlocked condition, according to some of the various embodiments.

Reference is now made to FIG. 11, which schematically illustrates a magazine installed in a receiver 1100 of an example firearm and in an unlocked condition, according to some of the various embodiments. The magazine may comprise an elongated tubular body. The elongated tubular body may comprise an exterior profile adapted to be closely received in a magazine well of the receiver 1100. The elongated tubular body may comprise an upper end 1130. The magazine may comprise a follower 1176, and a block element (hidden from view due to the top portion of the magazine). The block element may be moved into a second position (as shown) when a locking mechanism is in an unlocked condition. The firearm may comprise a trigger bar 1108. The trigger bar may be movable between a rest position and a discharge position (as shown). Operation of the firearm may be enabled when the block element is in the second position. In the second position, the block element may be within the exterior profile to enable extraction of the magazine. In the second position, the block element may be adapted to prevent contact with the trigger bar 1108 to enable motion of the trigger bar 1108. Extraction of the magazine may be enabled when the block element is in the second position.

Figure 12:
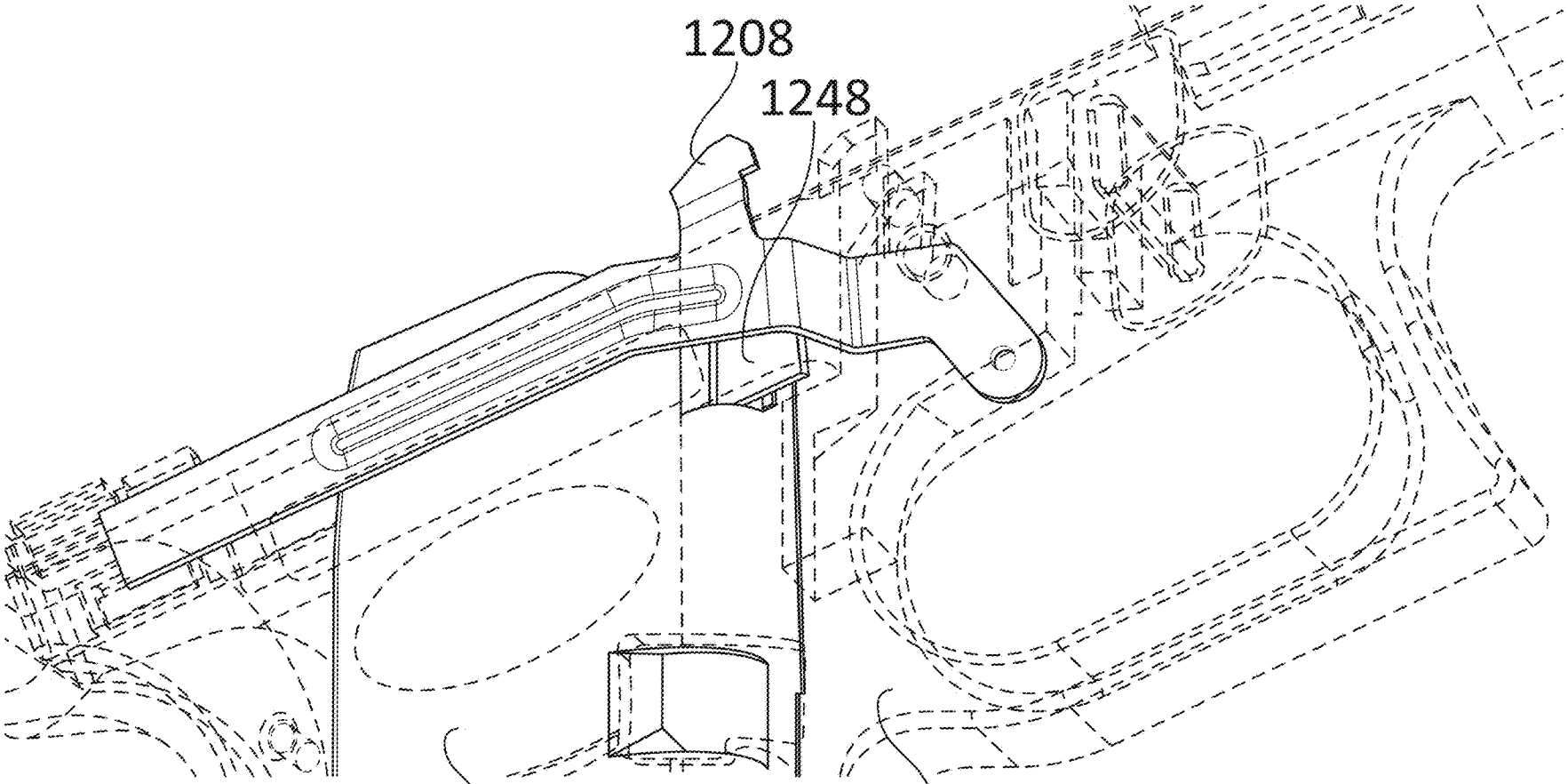
FIG. 12 schematically illustrates a magazine installed in a receiver of an example firearm and in a locked condition, according to some of the various embodiments.

Reference is now made to FIG. 12, which schematically illustrates a magazine 1206 installed in a receiver 1200 of an example firearm and in a locked condition, according to some of the various embodiments. The magazine 1206 may comprise a block element. The block element may be a planar element. The block element may comprise a major surface 1248. The block element may be moved into a first position (as shown) when a locking mechanism is in a locked condition. The firearm may comprise a trigger bar 1208. Operation of the firearm may be prevented when the block element is in the first position. In the first position, the block element may be adapted to contact the trigger bar 1208 to prevent motion of the trigger bar 1208. Extraction of the magazine may be prevented when the block element is in the first position. In the first position, the block element may be adapted to contact a portion of the firearm to prevent extraction of the magazine.

Figure 13:
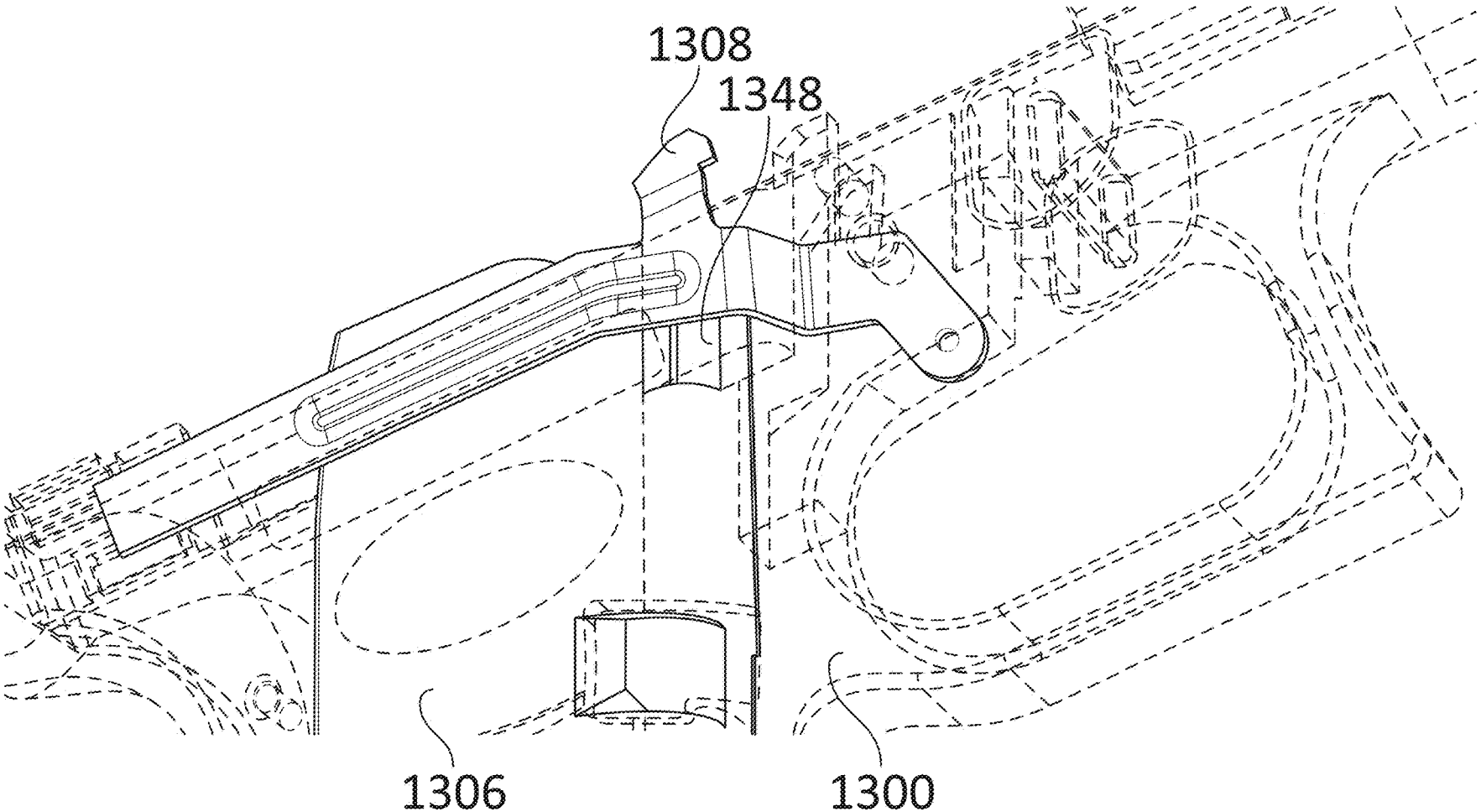
FIG. 13 schematically illustrates a magazine installed in a receiver of an example firearm and in an unlocked condition, according to some of the various embodiments.

Reference is now made to FIG. 13, which schematically illustrates a magazine 1306 installed in a receiver 1300 of an example firearm and in an unlocked condition, according to some of the various embodiments. The magazine may comprise a block element. The block element may be moved into a second position (as shown) when a locking mechanism is in an unlocked condition. The block element may be a planar element. The block element may comprise a major surface 1348. The major surface 1348 may be flush with an external surface of an elongated tubular body of the magazine 1306 when the block element is in the second position. The firearm may comprise a trigger bar 1308. Operation of the firearm may be enabled when the block element is in the second position. In the second position, the block element may be adapted to prevent contact with the trigger bar 1308 to enable motion of the trigger bar 1308. Extraction of the magazine may be enabled when the block element is in the second position.

Figure 14:
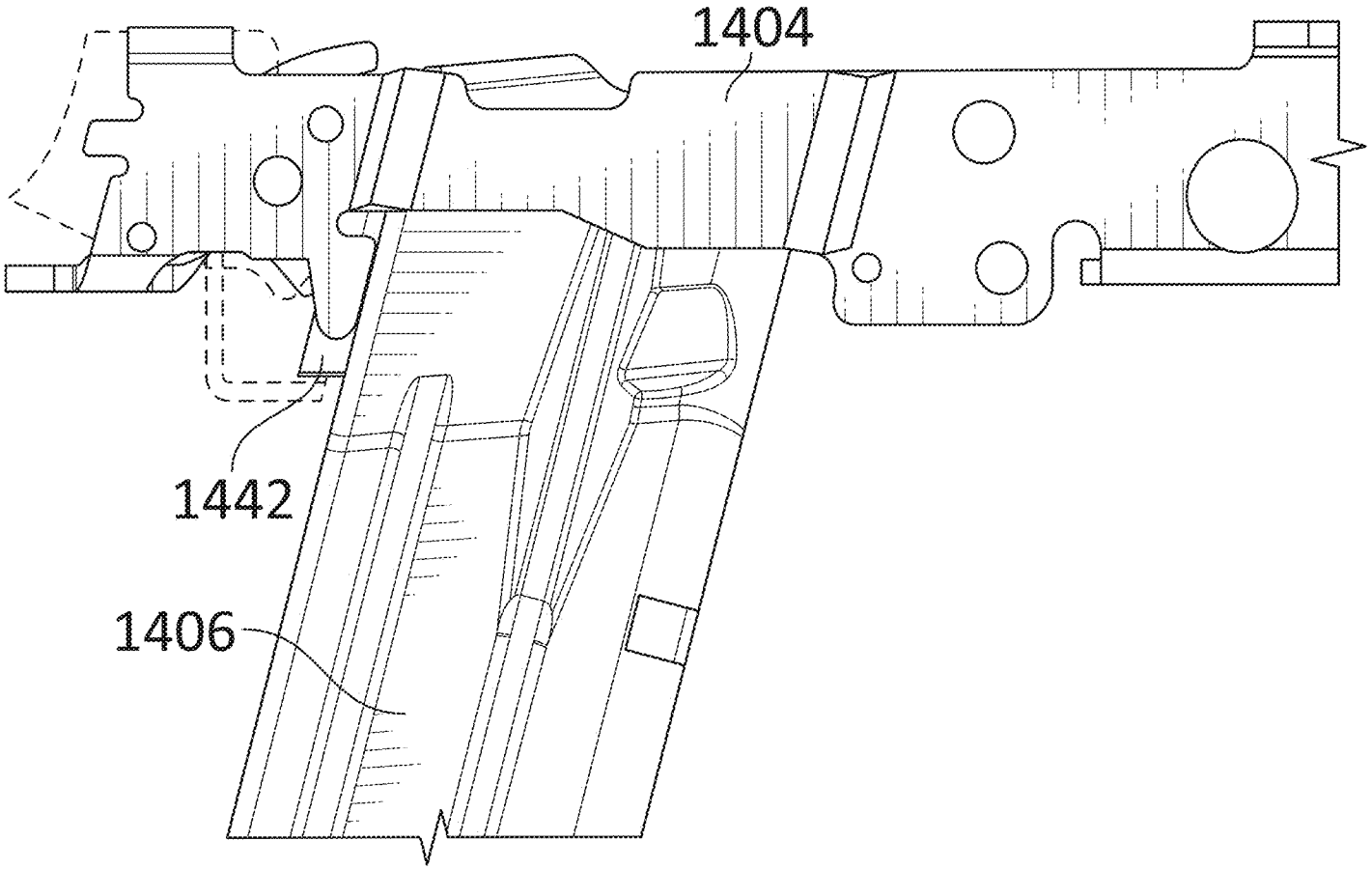
FIG. 14 schematically illustrates a magazine installed in a frame of an example firearm and in a locked condition, according to some of the various embodiments.

Reference is now made to FIG. 14, which schematically illustrates a magazine 1406 installed in a frame 1404 of an example firearm and in a locked condition, according to some of the various embodiments. In this example, the grip module and other components of the firearm have been removed for illustrative purposes. The magazine 1406 may comprise a block element 1442. The block element 1442 may be moved into a first position (as shown) when a locking mechanism is in a locked condition. Extraction of the magazine 1406 may be prevented when the block element 1442 is in the first position. In the first position, the block element may be adapted to contact a portion of the firearm (e.g. a shelf in the frame 1404) to prevent extraction of the magazine.

Figure 15:
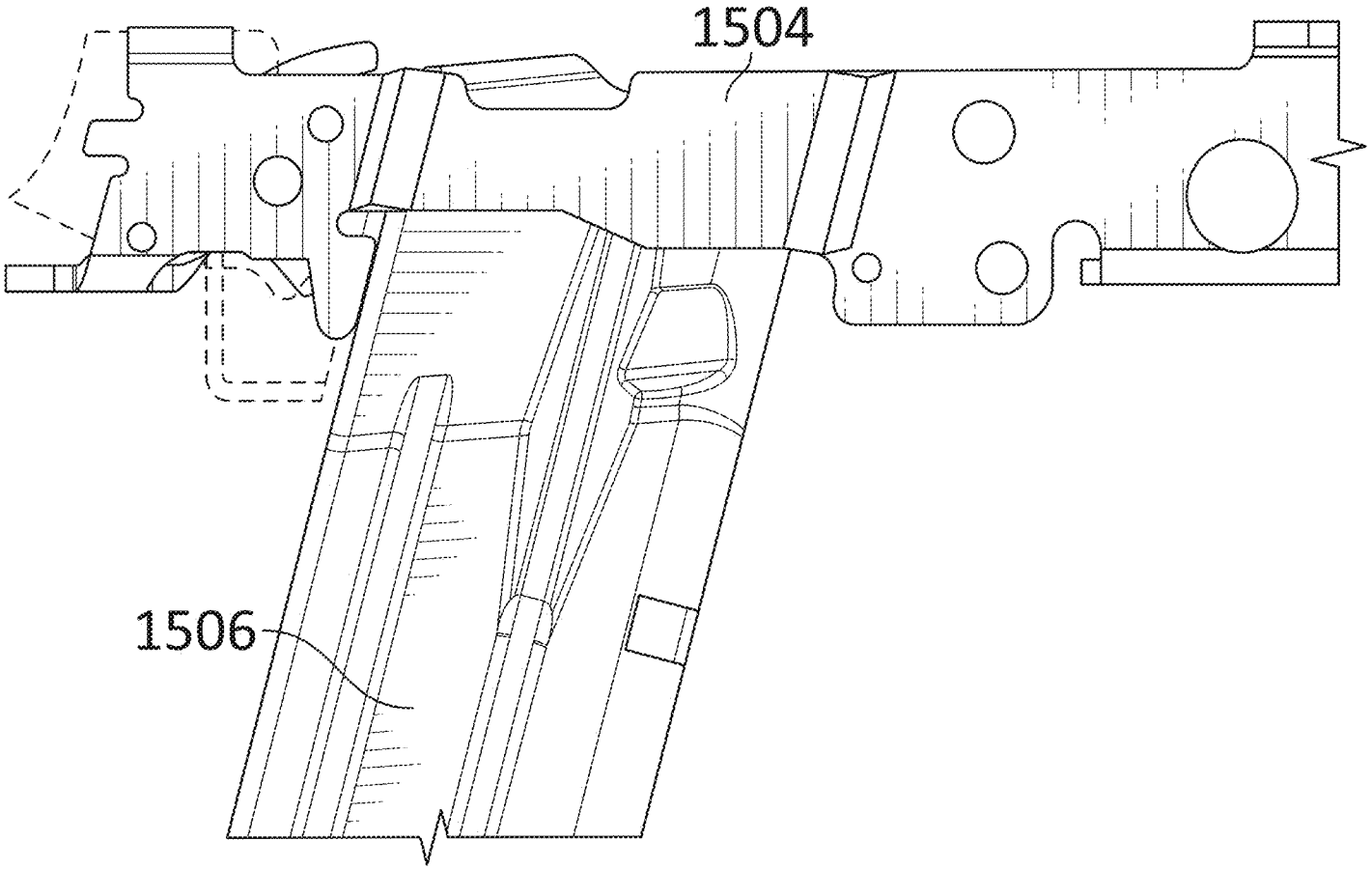
FIG. 15 schematically illustrates a magazine installed in a frame of an example firearm and in an unlocked condition, according to some of the various embodiments.

Reference is now made to FIG. 15, which schematically illustrates a magazine 1506 installed in a frame 1504 of an example firearm and in an unlocked condition, according to some of the various embodiments. In this example, the grip module and other components of the firearm have been removed for illustrative purposes. The magazine 1506 may comprise a block element. The block element may be moved into a second position (as shown) when a locking mechanism is in an unlocked condition.

Figure 16B:
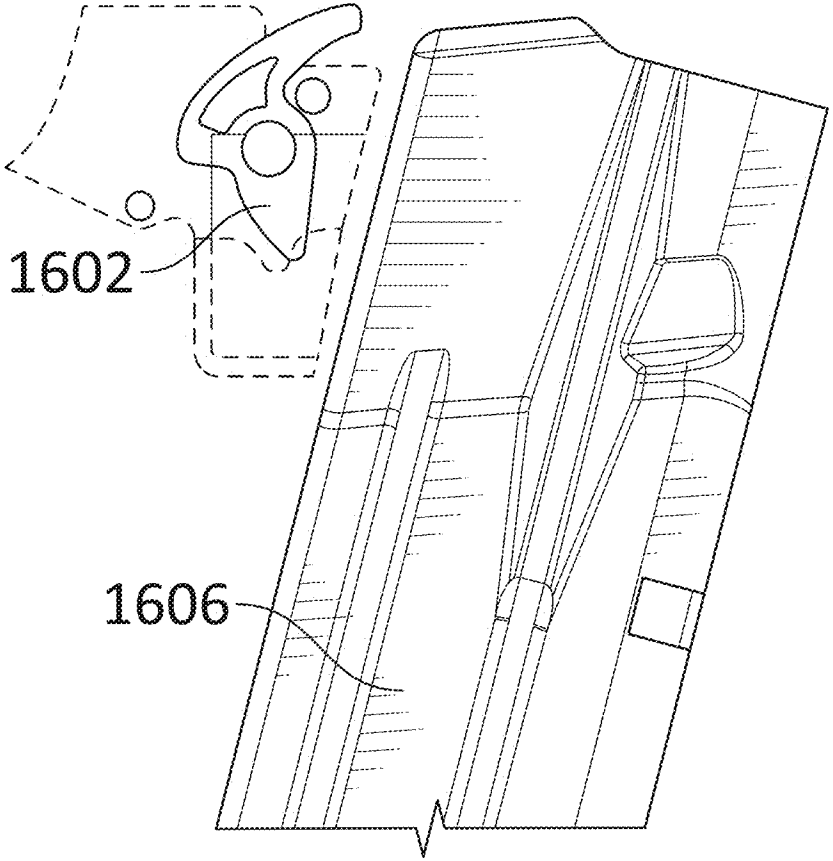
FIG. 16B schematically illustrates a magazine in an unlocked condition and a trigger element of an example firearm, according to some of the various embodiments.
Figure 16A:
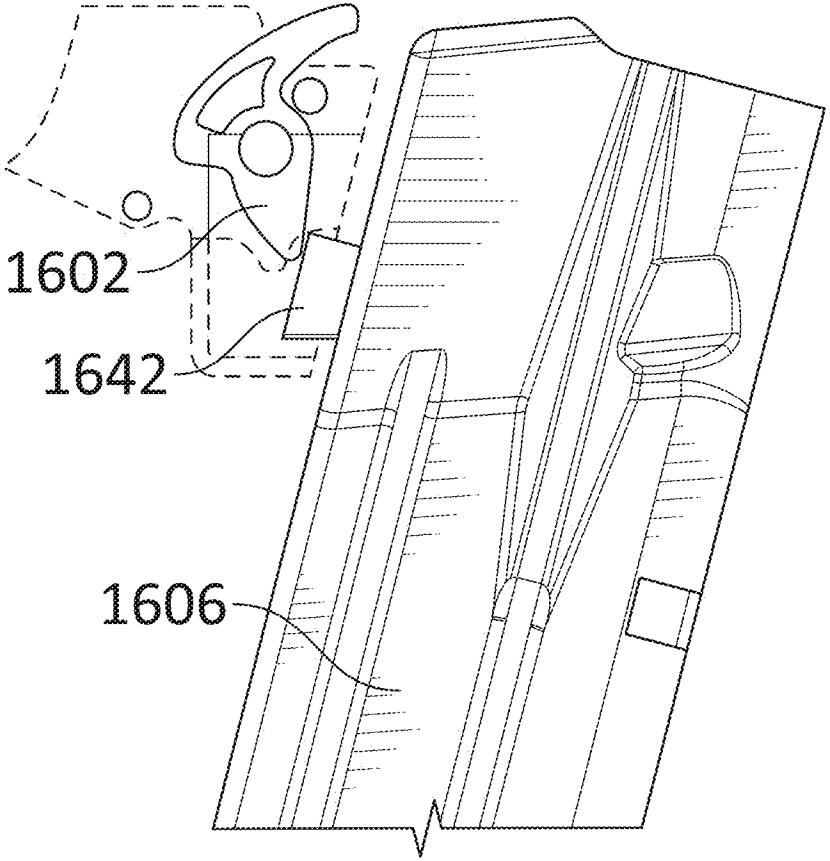
FIG. 16A schematically illustrates a magazine in a locked condition and a trigger element of an example firearm, according to some of the various embodiments.

Reference is now made to FIG. 16A, which schematically illustrates a magazine 1606 in a locked condition and a trigger element 1602 of an example firearm, according to some of the various embodiments. In this example, the frame and other components of the firearm have been removed for illustrative purposes. The magazine 1606 may comprise a block element 1642. The block element 1642 may be moved into a first position (as shown) when a locking mechanism is in a locked condition. The firearm may comprise the trigger element 1602. The trigger element 1602 may be movable between a rest position (as shown) and a discharge position. For the purposes of this disclosure, the trigger element 1602 may comprise any component employed by the firearm in a discharge sequence including, but not limited to, a trigger, a trigger bar, a hammer, a safety, a firing pin, a firing pin safety, a firing pin safety lever, a sear, a striker, combinations thereof, and/or the like. Operation of the firearm may be prevented when the block element 1642 is in the first position. In the first position, the block element 1642 may be adapted to contact the trigger element 1602 to prevent motion of the trigger element 1602. Extraction of the magazine 1606 may be prevented when the block element 1642 is in the first position. In the first position, the block element 1642 may be adapted to contact a portion of the firearm to prevent extraction of the magazine 1606.

Reference is now made to FIG. 16B, which schematically illustrates a magazine 1606 in an unlocked condition and a trigger element 1602 of an example firearm, according to some of the various embodiments. In this example, the frame and other components of the firearm have been removed for illustrative purposes. The magazine 1606 may comprise a block element. The block element may be moved into a second position (as shown) when a locking mechanism is in an unlocked condition. The firearm may comprise the trigger element 1602. The trigger element 1602 may be movable between a rest position (as shown) and a discharge position. Operation of the firearm may be enabled when the block element is in the second position. In the second position, the block element may be adapted to prevent contact with the trigger element 1602 to enable motion of the trigger element 1602. Extraction of the magazine 1606 may be enabled when the block element is in the second position.

Figure 17:
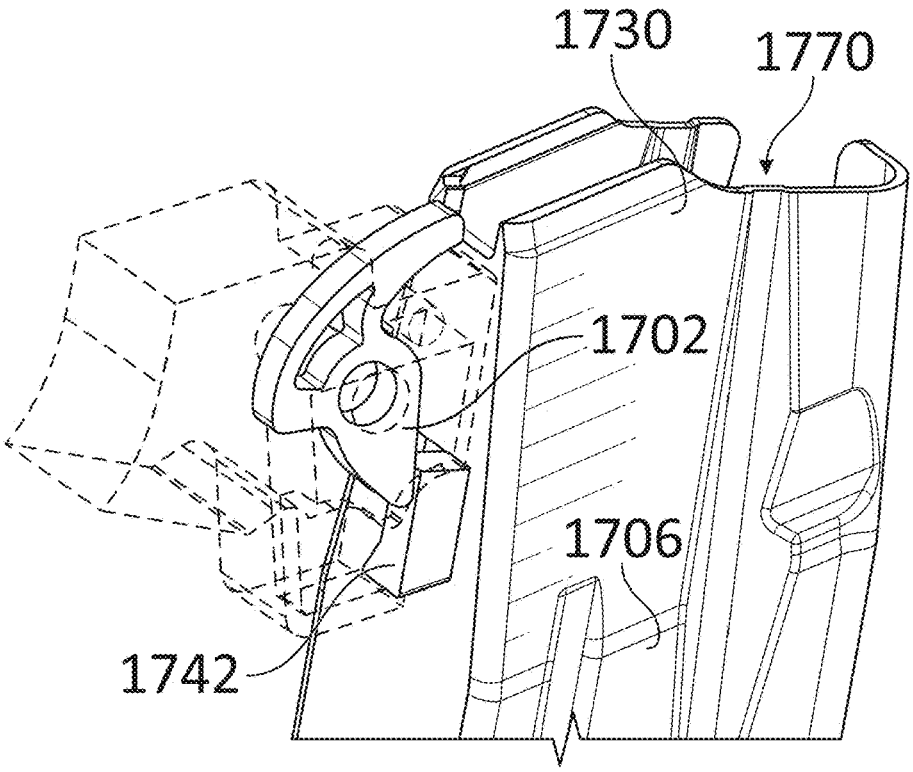
FIG. 17 schematically illustrates a magazine in a locked condition and a trigger element of an example firearm, according to some of the various embodiments.

Reference is now made to FIG. 17, which schematically illustrates a magazine 1706 in a locked condition and a trigger element 1702 of an example firearm, according to some of the various embodiments. In this example, the frame and other components of the firearm have been removed for illustrative purposes. The magazine 1706 may comprise an elongated tubular body. The elongated tubular body may comprise an upper end 1730. The clongated tubular body may define an ammunition compartment 1770. The upper end 1730 may define an ammunition exit aperture. The magazine 1706 may comprise a block element 1742. The block element 1742 may be moved into a first position (as shown) when a locking mechanism is in a locked condition. The firearm may comprise a trigger element 1702. The trigger element 1702 may be movable between a rest position (as shown) and a discharge position. Operation of the firearm may be prevented when the block element 1742 is in the first position. In the first position, the block element 1742 may be adapted to contact the trigger element 1702 to prevent motion of the trigger element 1702. Extraction of the magazine 1706 may be prevented when the block element 1742 is in the first position. In the first position, the block element 1742 may be adapted to contact a portion of the firearm to prevent extraction of the magazine.

Figure 18:
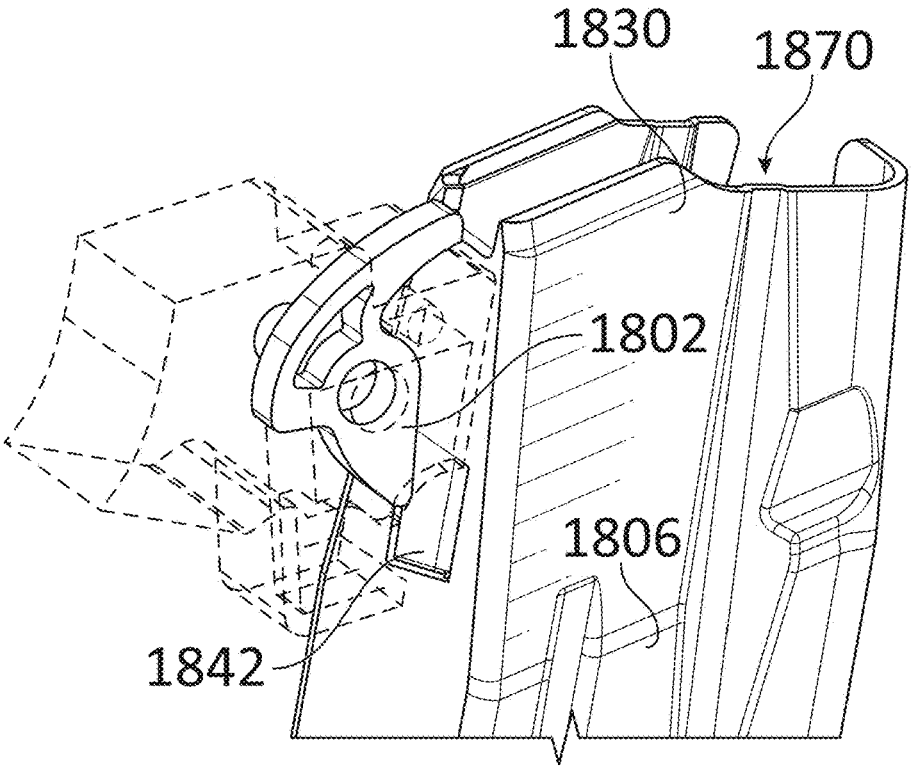
FIG. 18 schematically illustrates a magazine in an unlocked condition and a trigger element of an example firearm, according to some of the various embodiments.

Reference is now made to FIG. 18, which schematically illustrates a magazine 1806 in an unlocked condition and a trigger element 1802 of an example firearm, according to some of the various embodiments. In this example, the frame and other components of the firearm have been removed for illustrative purposes. The magazine 1806 may comprise an elongated tubular body. The elongated tubular body may comprise an upper end 1830. The elongated tubular body may define an ammunition compartment 1870. The upper end 1830 may define an ammunition exit aperture. The magazine 1806 may comprise a block element 1842. The block element 1842 may be moved into a second position (as shown) when a locking mechanism is in an unlocked condition. The firearm may comprise the trigger element 1802. Operation of the firearm may be enabled when the block element 1842 is in the second position. In the second position, the block element 1842 may be adapted to prevent contact with the trigger element 1802 to enable motion of the trigger element 1802. Extraction of the magazine 1806 may be enabled when the block element 1842 is in the second position.

Figure 19A:
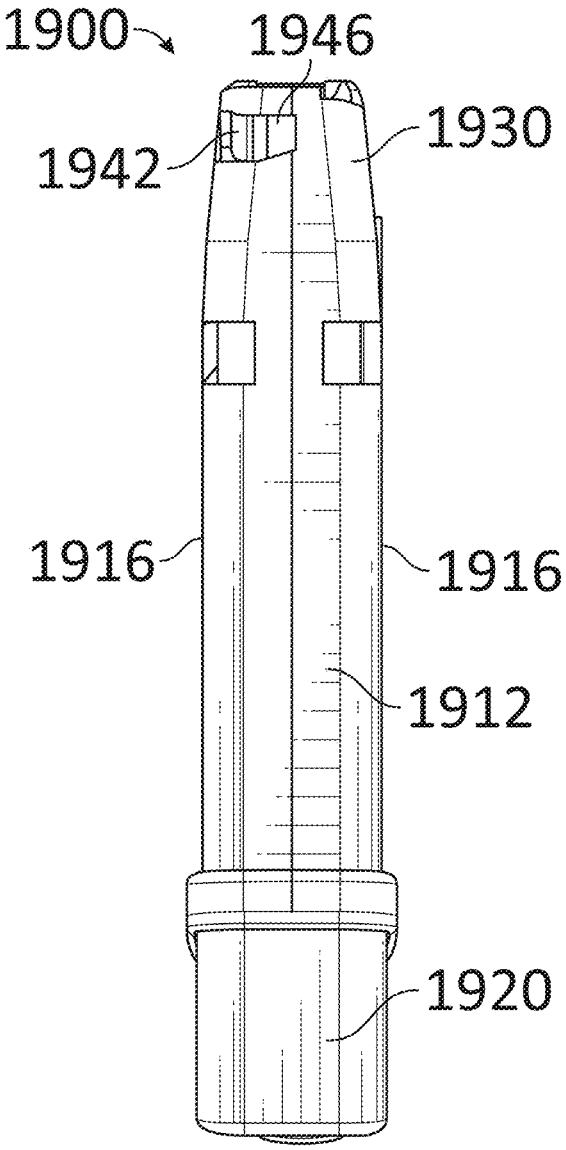
FIG. 19A schematically illustrates a front view of a magazine in a locked condition, according to some of the various embodiments.

Reference is now made to FIG. 19A, which schematically illustrates a magazine 1900 in a locked condition, according to some of the various embodiments. The magazine 1900 may comprise an elongated tubular body. The elongated tubular body may comprise an upper end 1930, a lower end 1920, and a block recess 1946. The lower end 1920 may be opposed to the upper end 1930. The elongated tubular body may comprise opposed sidewalls 1916, a front wall 1912, and a rear wall. The magazine 1900 may comprise a block element 1942. The block element 1942 may be moved into a first position (as shown) when a locking mechanism of the magazine 1900 is in a locked condition.

Figure 19B:
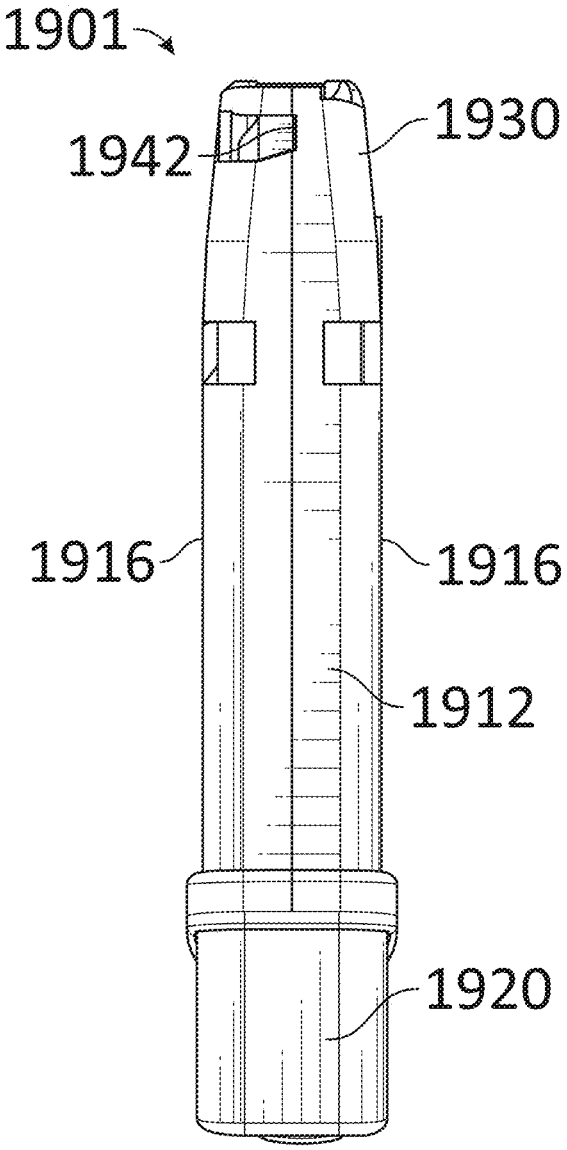
FIG. 19B schematically illustrates a front view of a magazine in an unlocked condition, according to some of the various embodiments.

Reference is now made to FIG. 19B, which schematically illustrates a magazine 1901 in an unlocked condition, according to some of the various embodiments. The magazine 1901 may comprise an elongated tubular body. The elongated tubular body may comprise an upper end 1930, a lower end 1920, and a block recess. The lower end 1920 may be opposed to the upper end 1930. The elongated tubular body may comprise opposed sidewalls 1916, a front wall 1912, and a rear wall. The magazine 1901 may comprise a block element 1942. The block element 1942 may be moved into a second position (as shown) when a locking mechanism of the magazine 1901 is in an unlocked condition. The block recess may be configured to house the block element 1942 when in the second position (as shown).

Figure 20B:
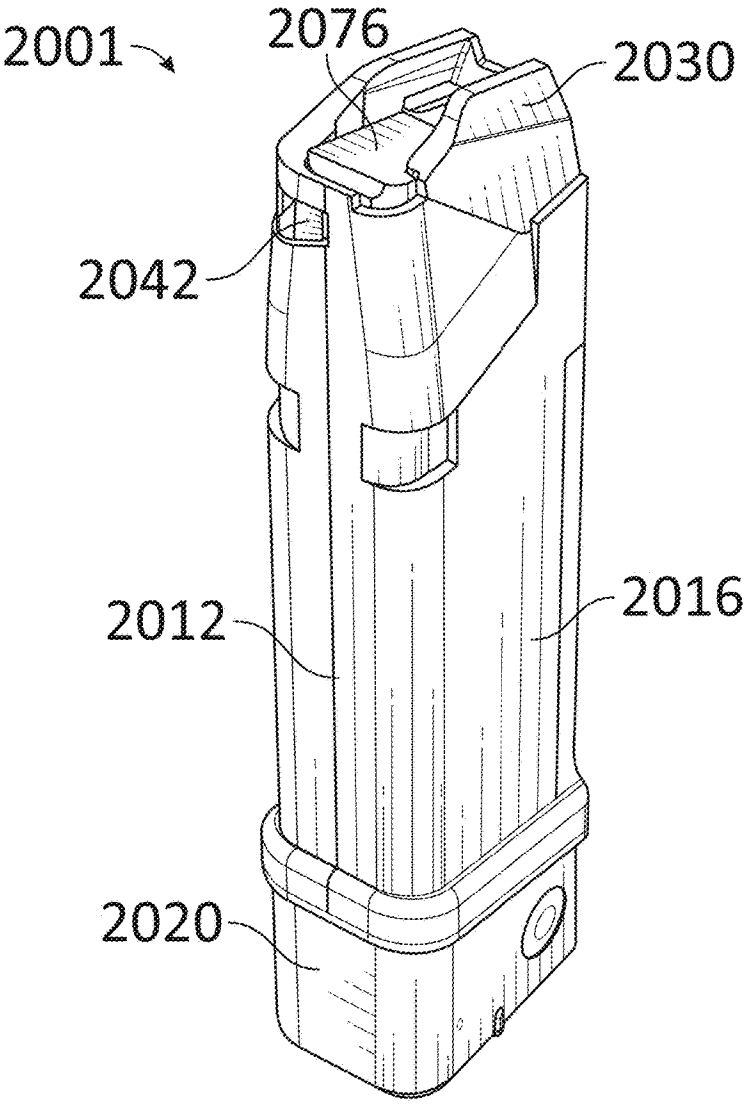
FIG. 20B schematically illustrates a magazine in an unlocked condition, according to some of the various embodiments.
Figure 20A:
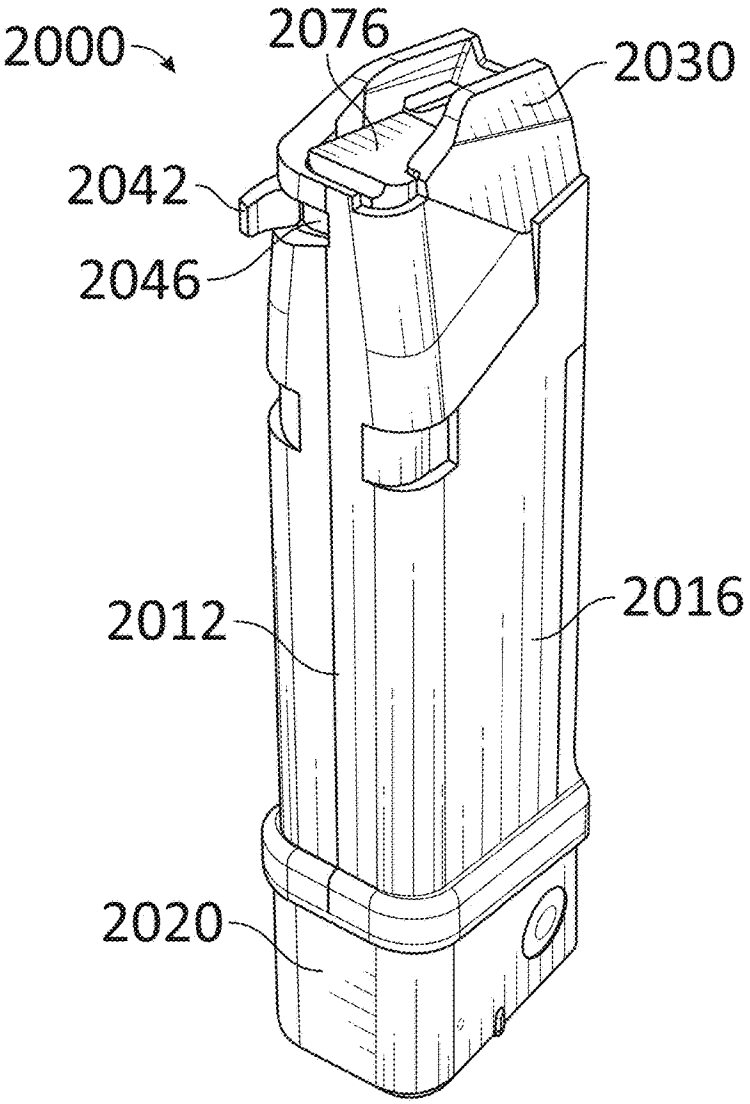
FIG. 20A schematically illustrates a magazine in a locked condition, according to some of the various embodiments.

Reference is now made to FIG. 20A, which schematically illustrates a magazine 2000 in a locked condition, according to some of the various embodiments. The magazine 2000 may comprise an elongated tubular body and a follower 2076. The elongated tubular body may comprise an upper end 2030, a lower end 2020, and a block recess 2046. The lower end 2020 may be opposed to the upper end 2030. The elongated tubular body may comprise opposed sidewalls 2016, a front wall 2012, and a rear wall. The magazine 2000 may comprise a block element 2042. The block element 2042 may be moved into a first position (as shown) when a locking mechanism of the magazine 2000 is in a locked condition.

Reference is now made to FIG. 20B, which schematically illustrates a magazine 2001 in an unlocked condition, according to some of the various embodiments. The magazine 2001 may comprise an elongated tubular body and a follower 2076. The elongated tubular body may comprise an upper end 2030, a lower end 2020, and a block recess. The lower end 2020 may be opposed to the upper end 2030. The elongated tubular body may comprise opposed sidewalls 2016, a front wall 2012, and a rear wall. The magazine 2001 may comprise a block element 2042. The block element 2042 may be moved into a second position (as shown) when a locking mechanism of the magazine 2001 is in an unlocked condition.

Figure 21A:
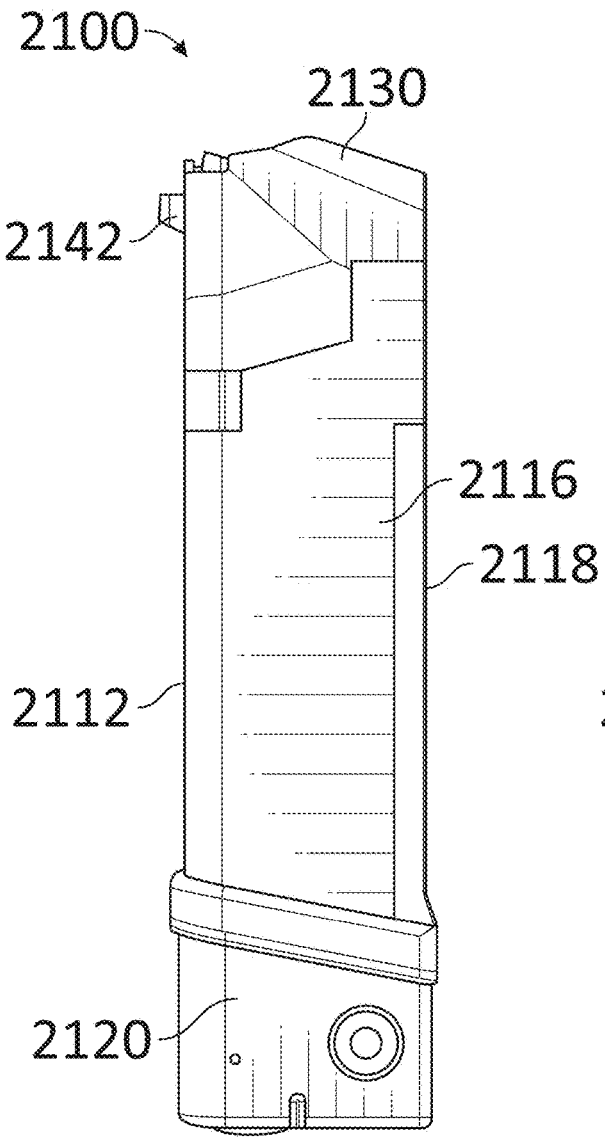
FIG. 21A schematically illustrates a side view of a magazine in a locked condition, according to some of the various embodiments.

Reference is now made to FIG. 21A, which schematically illustrates a side view of a magazine 2100 in a locked condition, according to some of the various embodiments. The magazine 2100 may comprise an elongated tubular body. The elongated tubular body may comprise an upper end 2130 and a lower end 2120. The lower end 2120 may be opposed to the upper end 2130. The elongated tubular body may comprise opposed sidewalls 2116, a front wall 2112, and a rear wall 2118. The magazine 2100 may comprise a block element 2142. The block element 2142 may be moved into a first position (as shown) when a locking mechanism of the magazine 2100 is in a locked condition.

Figure 21B:
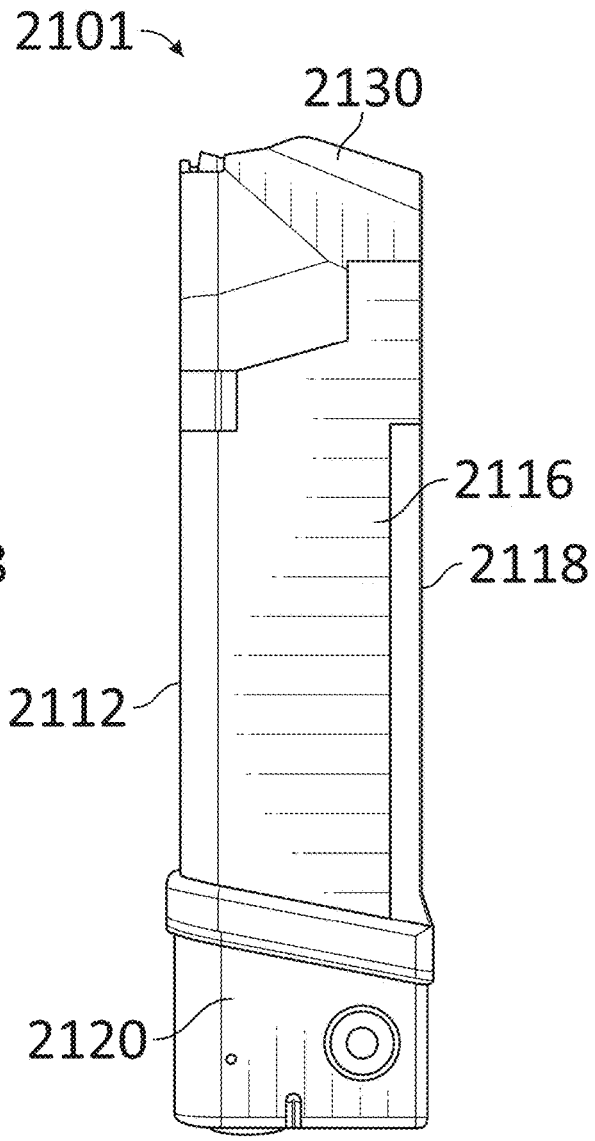
FIG. 21B schematically illustrates a side view of a magazine in an unlocked condition, according to some of the various embodiments.

Reference is now made to FIG. 21B, which schematically illustrates a side view of a magazine 2101 in an unlocked condition, according to some of the various embodiments. The magazine 2101 may comprise an elongated tubular body. The elongated tubular body may comprise an upper end 2130 and a lower end 2120. The lower end 2120 may be opposed to the upper end 2130. The elongated tubular body may comprise opposed sidewalls 2116, a front wall 2112, and a rear wall 2118. The magazine 2101 may comprise a block element. The block element may be moved into a second position (as shown) when a locking mechanism of the magazine 2101 is in an unlocked condition.

Figure 22A:
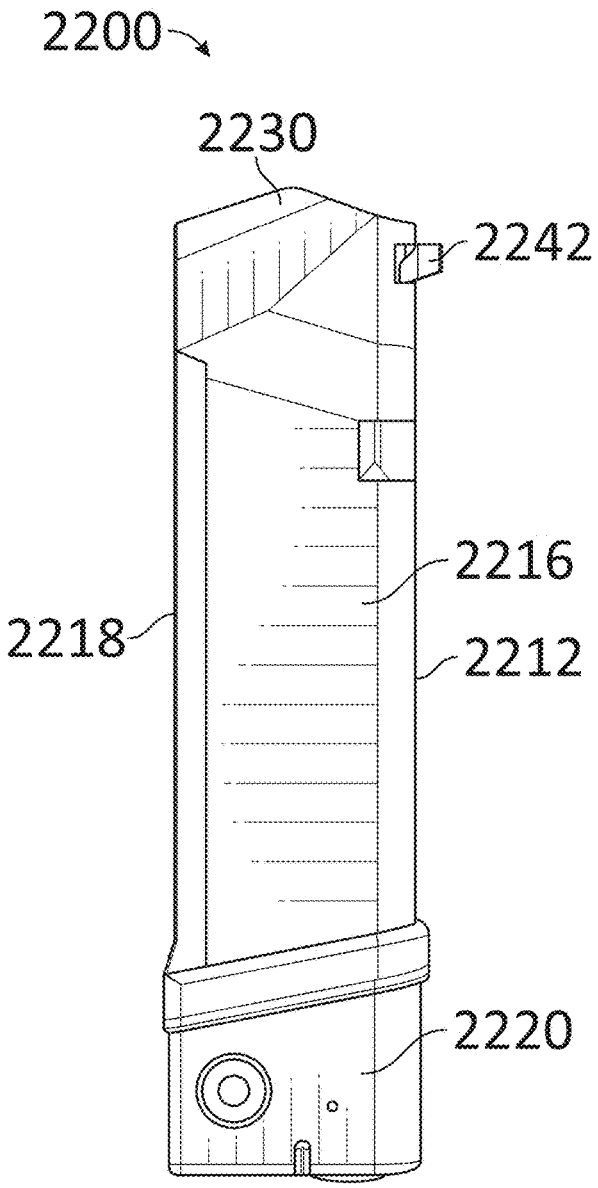
FIG. 22A schematically illustrates a side view of a magazine in a locked condition, according to some of the various embodiments.

Reference is now made to FIG. 22A, which schematically illustrates a side view of a magazine 2200 in a locked condition, according to some of the various embodiments. The magazine 2200 may comprise an elongated tubular body. The elongated tubular body may comprise an upper end 2230 and a lower end 2220. The lower end 2220 may be opposed to the upper end 2230. The elongated tubular body may comprise opposed sidewalls 2216, a front wall 2212, and a rear wall 2218. The magazine 2200 may comprise a block element 2242. The block element 2242 may be moved into a first position (as shown) when a locking mechanism of the magazine 2200 is in a locked condition.

Figure 22B:
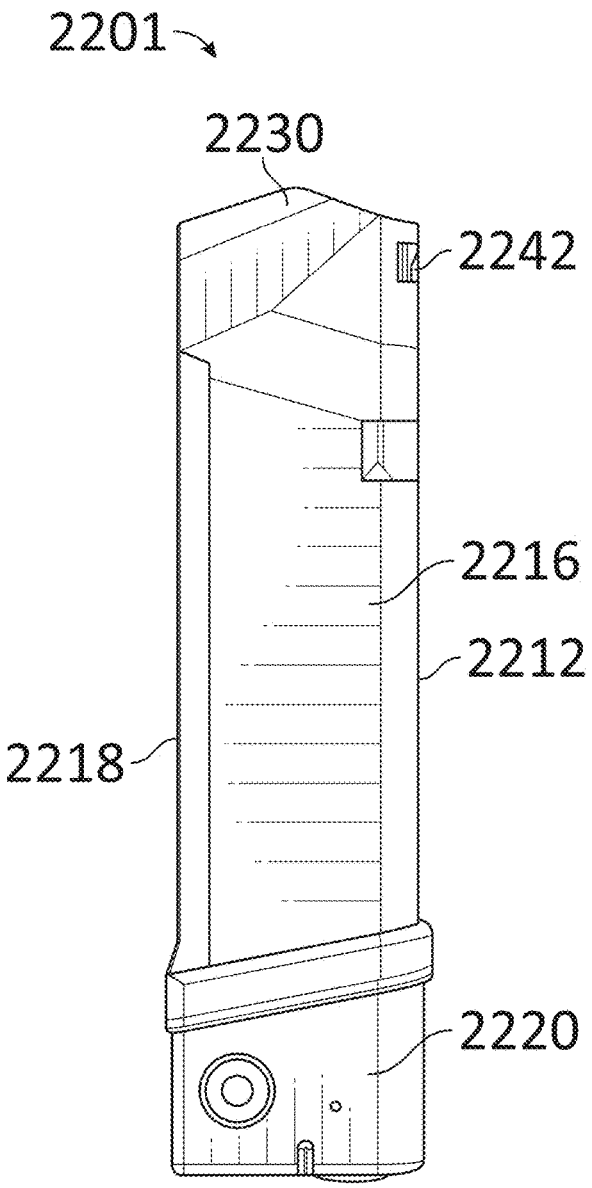
FIG. 22B schematically illustrates a side view of a magazine in an unlocked condition, according to some of the various embodiments.

Reference is now made to FIG. 22B, which schematically illustrates a side view of a magazine 2201 in an unlocked condition, according to some of the various embodiments. The magazine 2201 may comprise an elongated tubular body. The elongated tubular body may comprise an upper end 2230 and a lower end 2220. The lower end 2220 may be opposed to the upper end 2230. The elongated tubular body may comprise opposed sidewalls 2216, a front wall 2212, and a rear wall 2218. The magazine 2201 may comprise a block element 2242. The block element 2242 may be moved into a second position (as shown) when a locking mechanism of the magazine 2201 is in an unlocked condition.

Figure 23A:
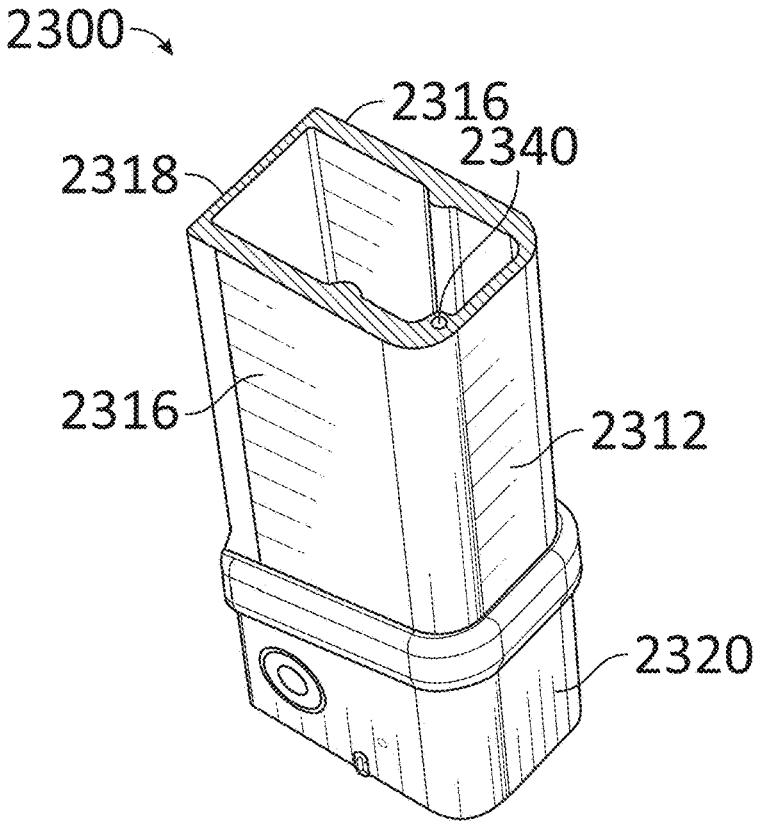
FIG. 23A schematically illustrates a cross-sectional view of a lower portion of a magazine, according to some of the various embodiments.

Reference is now made to FIG. 23A, which schematically illustrates a cross-sectional view of a lower portion of a magazine 2300, according to some of the various embodiments. The magazine 2300 may comprise an elongated tubular body. The elongated tubular body may comprise a lower end 2320. The elongated tubular body may comprise opposed sidewalls 2316, a front wall 2312, and a rear wall 2318. The magazine 2300 may comprise an elongated shaft 2340. The elongated shaft 2340 may comprise a lower end connected to a locking mechanism of the magazine 2300. The elongated tubular body may define a shaft passage closely receiving the elongated shaft 2340. The elongated shaft 2340 may be proximate to one of the opposed sidewalls 2316 and to the front wall 2312.

Figure 23B:
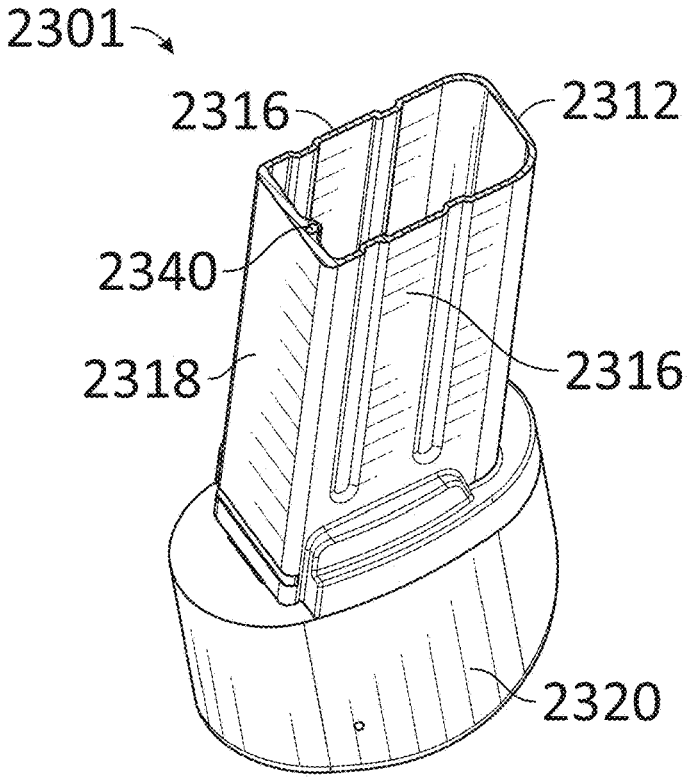
FIG. 23B schematically illustrates a cross-sectional view of a lower portion of a magazine, according to some of the various embodiments.

Reference is now made to FIG. 23B, which schematically illustrates a cross-sectional view of a lower portion of a magazine 2301, according to some of the various embodiments. The magazine 2301 may comprise an elongated tubular body. The elongated tubular body may comprise a lower end 2320. The elongated tubular body may comprise opposed sidewalls 2316, a front wall 2312, and a rear wall 2318. The magazine 2301 may comprise an elongated shaft 2340. The elongated shaft 2340 may comprise a lower end connected to a locking mechanism of the magazine 2301. The elongated tubular body may define a shaft passage closely receiving the elongated shaft 2340. The elongated shaft 2340 may be proximate to the rear wall 2318.

Figure 24:
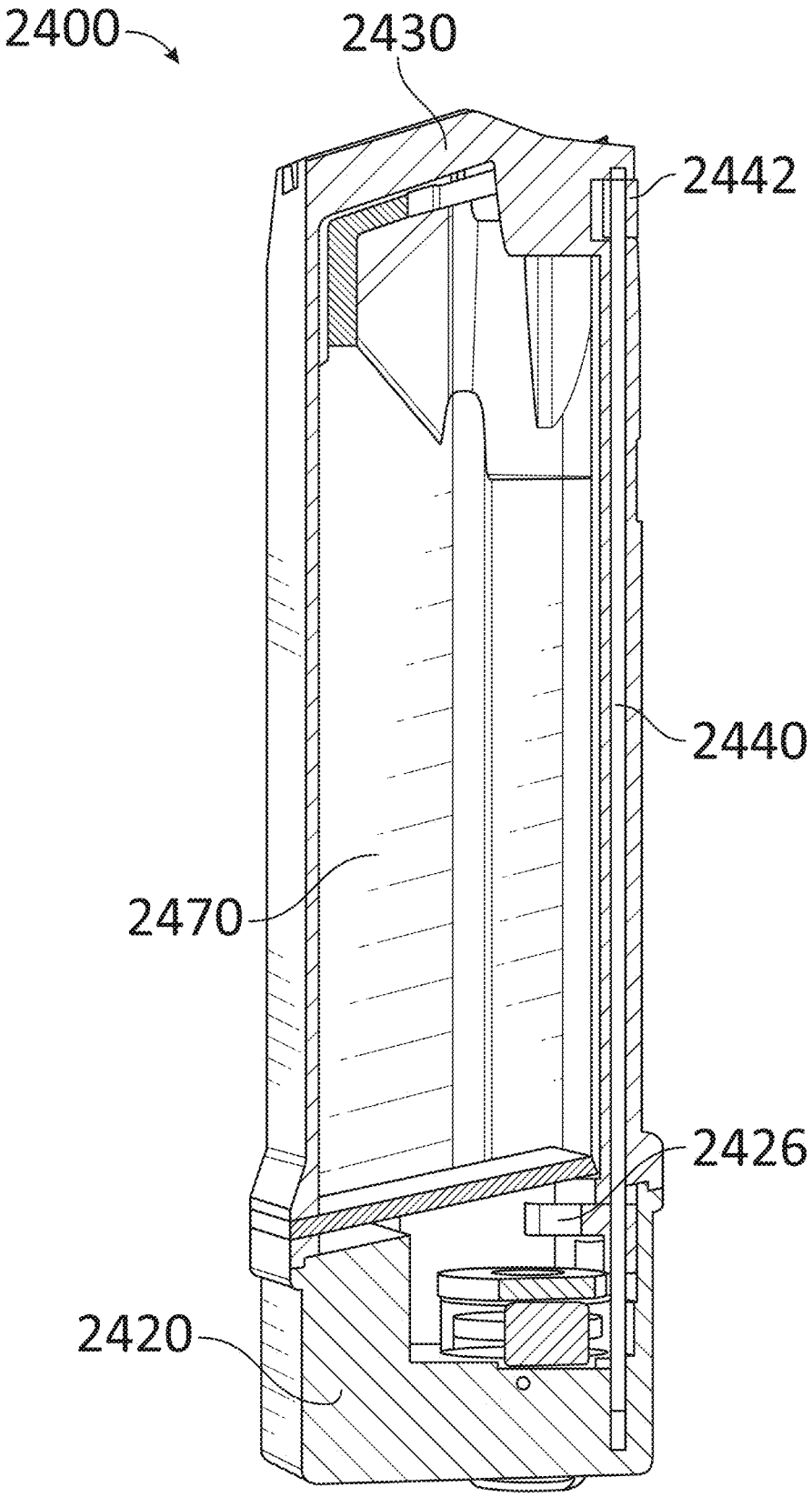
FIG. 24 schematically illustrates a cross-sectional view of a magazine in an unlocked condition, according to some of the various embodiments.

Reference is now made to FIG. 24, which schematically illustrates a cross-sectional view of a magazine 2400 in an unlocked condition, according to some of the various embodiments. The magazine 2400 may comprise an elongated tubular body. The elongated tubular body may comprise an upper end 2430 and a lower end 2420. The elongated tubular body may define an ammunition compartment 2470. The magazine 2400 may comprise a locking mechanism connected to the lower end 2420 of the elongated tubular body. The locking mechanism may comprise a locked condition and an unlocked condition (as shown). The locking mechanism may comprise a rotor 2426. The rotor 2426 may be movable between a first rotational position when the locking mechanism is in the locked condition, and a second rotational position (as shown) when the locking mechanism is in the unlocked condition. The second rotational position may be different than the first rotational position. The magazine 2400 may comprise an elongated shaft 2440. The elongated shaft 2440 may comprise a lower end and an upper end opposed to the lower end. The lower end of the elongated shaft 2440 may be connected to the rotor 2426. The upper end of the elongated shaft 2440 may be proximate the upper end 2430 of the elongated tubular body. The magazine 2400 may comprise a block element 2442. The block element 2442 may be connected proximate to the upper end of the elongated shaft 2440. The block element 2442 may be an elongated element extending away from the elongated shaft 2440. The block element 2442 may be adapted to move between a first position when the locking mechanism is in the locked condition, and a second position (as shown) when the locking mechanism is in the unlocked condition.

According to some of the various embodiments, a magazine may comprise a locking mechanism. The locking mechanism may comprise a rotating mechanism or rotor. The rotating mechanism may be movable between a first rotational position when the locking mechanism is in a locked condition and a second rotational position when the locking mechanism is in an unlocked condition. The rotating mechanism may be connected to an elongated shaft. Persons of ordinary skill in the art will recognize other locking mechanism configurations adapted to rotate the elongated shaft between a locked condition and an unlocked condition. For example, the locking mechanism may comprise a ball screw adapted to threadably connect to the elongated shaft. The ball screw may be driven by a linear actuator. For example, the locking mechanism may comprise a Nitinol wire adapted to contract with electrical current. The Nitinol wire may be connected to one or more pulleys. The Nitinol wire and/or one of the one or more pulleys may be connected to the elongated shaft. A torsional spring may be employed to return the elongated shaft to the previous condition (locked or unlocked).

Figure 25:
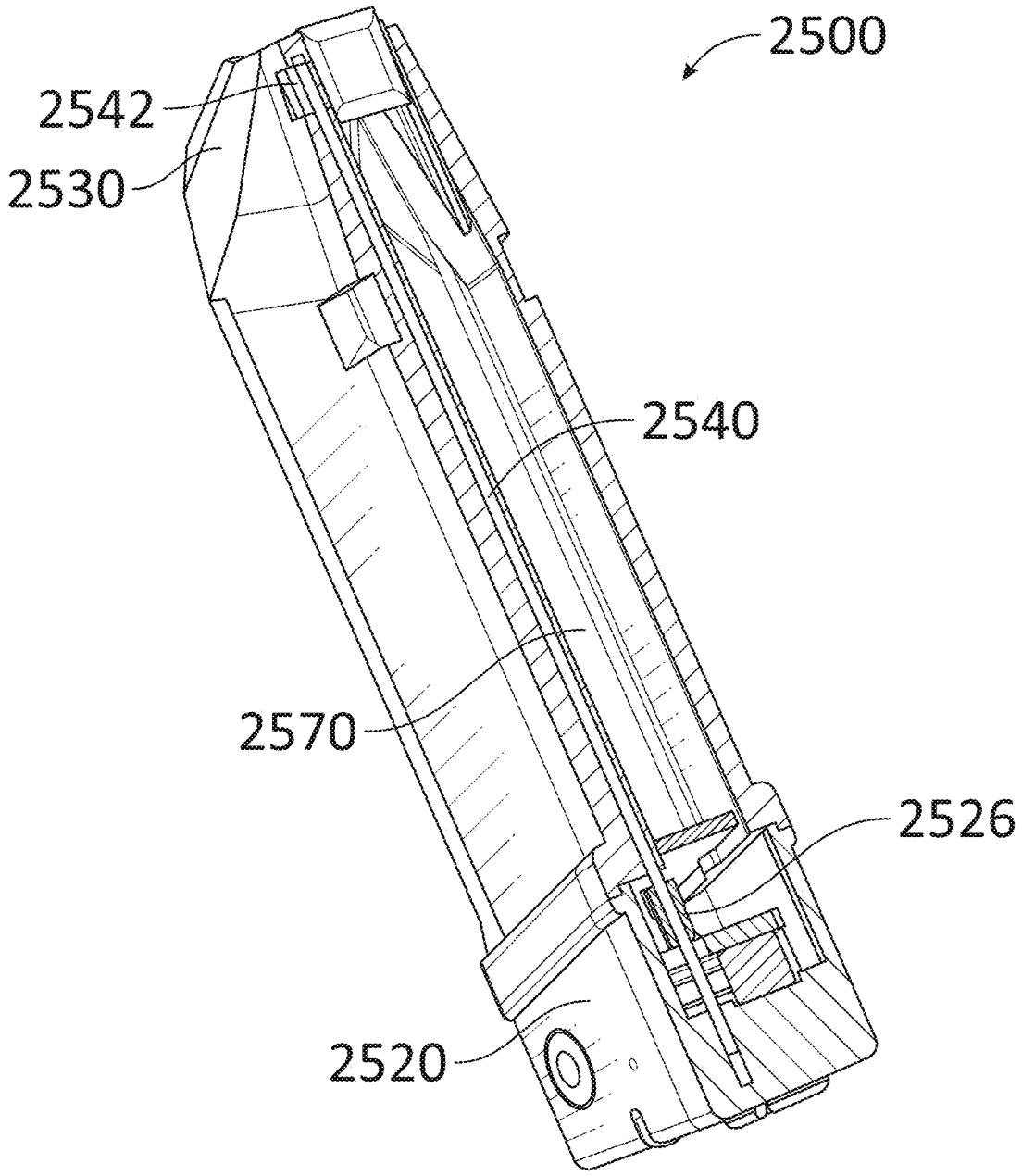
FIG. 25 schematically illustrates a cross-sectional view of a magazine in an unlocked condition, according to some of the various embodiments.

Reference is now made to FIG. 25, which schematically illustrates a cross-sectional view of a magazine 2500 in an unlocked condition, according to some of the various embodiments. The magazine 2500 may comprise an elongated tubular body. The elongated tubular body may comprise an upper end 2530 and a lower end 2520. The elongated tubular body may define an ammunition compartment 2570. The magazine 2500 may comprise a locking mechanism connected to the lower end 2520 of the elongated tubular body. The locking mechanism may comprise a locked condition and an unlocked condition (as shown). The locking mechanism may comprise a rotor 2526. The rotor 2526 may be movable between a first rotational position when the locking mechanism is in the locked condition, and a second rotational position (as shown) when the locking mechanism is in the unlocked condition. The second rotational position may be different than the first rotational position. The magazine 2500 may comprise an elongated shaft 2540. The elongated shaft 2540 may comprise a lower end and an upper end opposed to the lower end. The lower end of the elongated shaft 2540 may be connected to the rotor 2526. The upper end of the elongated shaft 2540 may be proximate the upper end 2530 of the elongated tubular body. The magazine 2500 may comprise a block element 2542. The block element 2542 may be connected proximate to the upper end of the elongated shaft 2540. The block element 2542 may be an elongated element extending away from the elongated shaft 2540. The block element 2542 may be adapted to move between a first position when the locking mechanism is in the locked condition, and a second position (as shown) when the locking mechanism is in the unlocked condition.

Figure 26:
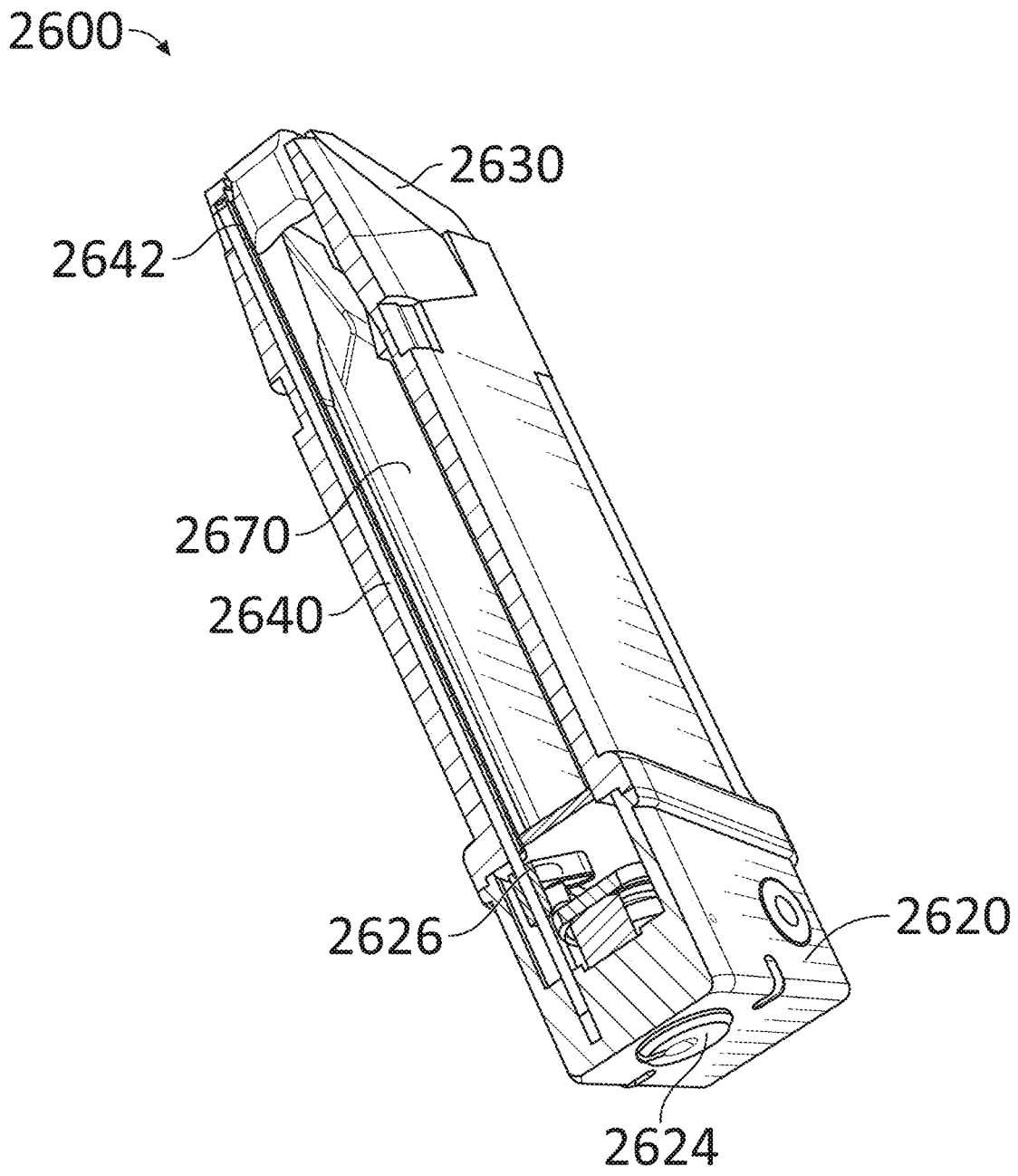
FIG. 26 schematically illustrates a cross-sectional view of a magazine in an unlocked condition, according to some of the various embodiments.

Reference is now made to FIG. 26, which schematically illustrates a cross-sectional view of a magazine 2600 in an unlocked condition, according to some of the various embodiments. The magazine 2600 may comprise an elongated tubular body. The elongated tubular body may comprise an upper end 2630 and a lower end 2620. The elongated tubular body may define an ammunition compartment 2670. The magazine 2600 may comprise a locking mechanism connected to the lower end 2620 of the elongated tubular body. The locking mechanism may comprise a locked condition and an unlocked condition (as shown). The locking mechanism may comprise a rotor 2626. The rotor 2626 may be movable between a first rotational position when the locking mechanism is in the locked condition, and a second rotational position (as shown) when the locking mechanism is in the unlocked condition. The second rotational position may be different than the first rotational position. The locking mechanism may comprise a user interface 2624. The user interface 2624 may be adapted to enable a user to select between the locked condition and the unlocked condition. The magazine 2600 may comprise an elongated shaft 2640. The elongated shaft 2640 may comprise a lower end and an upper end opposed to the lower end. The lower end of the elongated shaft 2640 may be connected to the rotor 2626. The upper end of the elongated shaft 2640 may be proximate the upper end 2630 of the elongated tubular body. The magazine 2600 may comprise a block element 2642. The block element 2642 may be connected proximate to the upper end of the elongated shaft 2640. The block element 2642 may be an elongated element extending away from the elongated shaft 2640. The block element 2642 may be adapted to move between a first position when the locking mechanism is in the locked condition, and a second position (as shown) when the locking mechanism is in the unlocked condition.

Figure 27B:
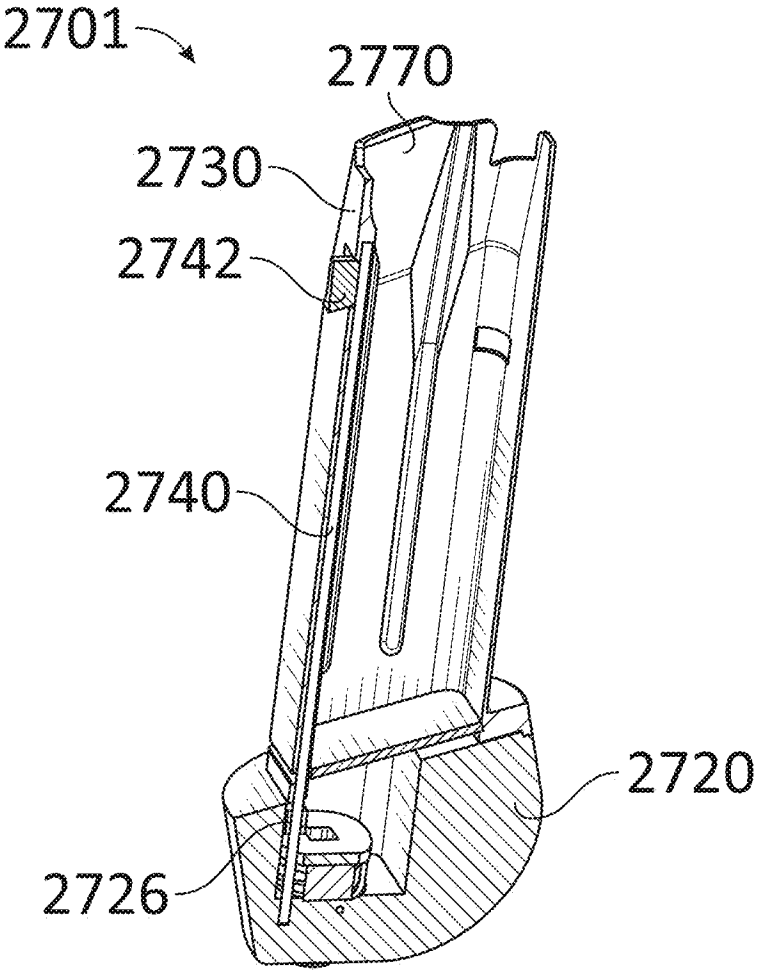
FIG. 27B schematically illustrates a cross-sectional view of a magazine in a locked condition, according to some of the various embodiments.
Figure 27A:
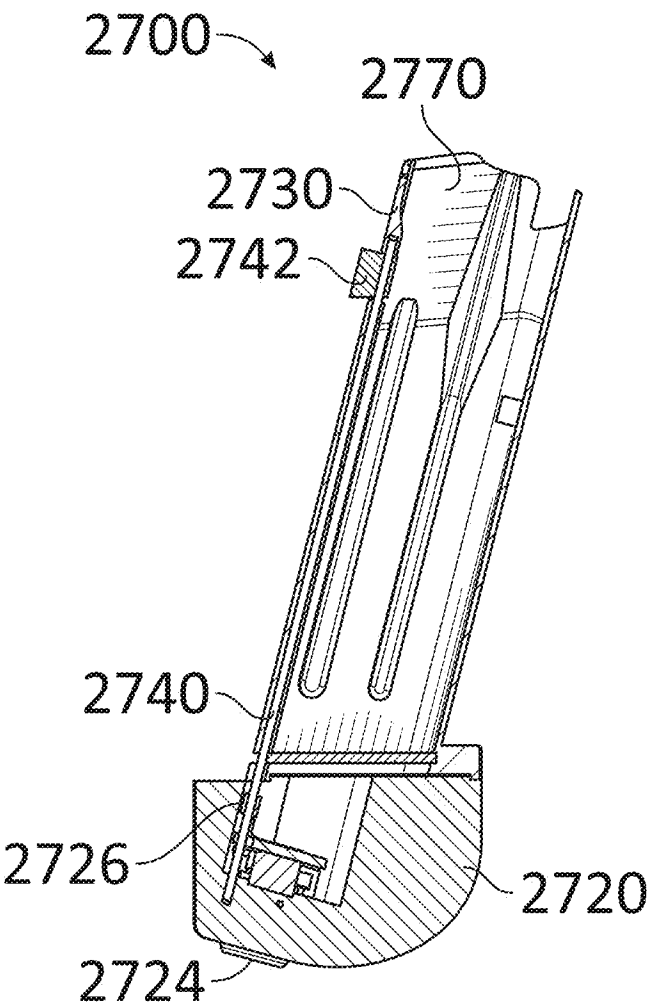
FIG. 27A schematically illustrates a cross-sectional view of a magazine in a locked condition, according to some of the various embodiments.

Reference is now made to FIG. 27A, which schematically illustrates a cross-sectional view of a magazine 2700 in a locked condition, according to some of the various embodiments. The magazine 2700 may comprise an elongated tubular body. The elongated tubular body may comprise an upper end 2730 and a lower end 2720. The elongated tubular body may define an ammunition compartment 2770. The magazine 2700 may comprise a locking mechanism connected to the lower end 2730 of the elongated tubular body. The locking mechanism may comprise a locked condition (as shown) and an unlocked condition. The locking mechanism may comprise a rotor 2726. The rotor 2726 may be movable between a first rotational position (as shown) when the locking mechanism is in the locked condition, and a second rotational position when the locking mechanism is in the unlocked condition. The second rotational position may be different than the first rotational position. The locking mechanism may comprise a user interface 2724. The magazine 2700 may comprise an elongated shaft 2740. The elongated shaft 2740 may comprise a lower end and an upper end opposed to the lower end. The lower end of the elongated shaft 2740 may be connected to the rotor 2726. The upper end of the elongated shaft 2740 may be proximate the upper end 2730 of the elongated tubular body. The magazine 2700 may comprise a block element 2742. The block element 2742 may be connected proximate to the upper end of the elongated shaft 2740. The block element 2742 may be adapted to move between a first position (as shown) when the locking mechanism is in the locked condition, and a second position when the locking mechanism is in the unlocked condition.

Reference is now made to FIG. 27B, which schematically illustrates a cross-sectional view of a magazine 2701 in a locked condition, according to some of the various embodiments. The magazine 2701 may comprise an elongated tubular body. The elongated tubular body may comprise an upper end 2730 and a lower end 2720. The elongated tubular body may define an ammunition compartment 2770. The magazine 2701 may comprise a locking mechanism connected to the lower end 2720 of the elongated tubular body. The locking mechanism may comprise a locked condition (as shown) and an unlocked condition. The locking mechanism may comprise a rotor 2726. The rotor 2726 may be movable between a first rotational position (as shown) when the locking mechanism is in the locked condition, and a second rotational position when the locking mechanism is in the unlocked condition. The second rotational position may be different than the first rotational position. The magazine 2701 may comprise an elongated shaft 2740. The elongated shaft 2740 may comprise a lower end and an upper end opposed to the lower end. The lower end of the elongated shaft 2740 may be connected to the rotor 2726. The upper end of the elongated shaft 2740 may be proximate the upper end 2730 of the elongated tubular body. The magazine 2701 may comprise a block element 2742. The block element 2742 may be connected proximate to the upper end of the elongated shaft 2740. The block element 2742 may be adapted to move between a first position (as shown) when the locking mechanism is in the locked condition, and a second position when the locking mechanism is in the unlocked condition.

Figure 28A:
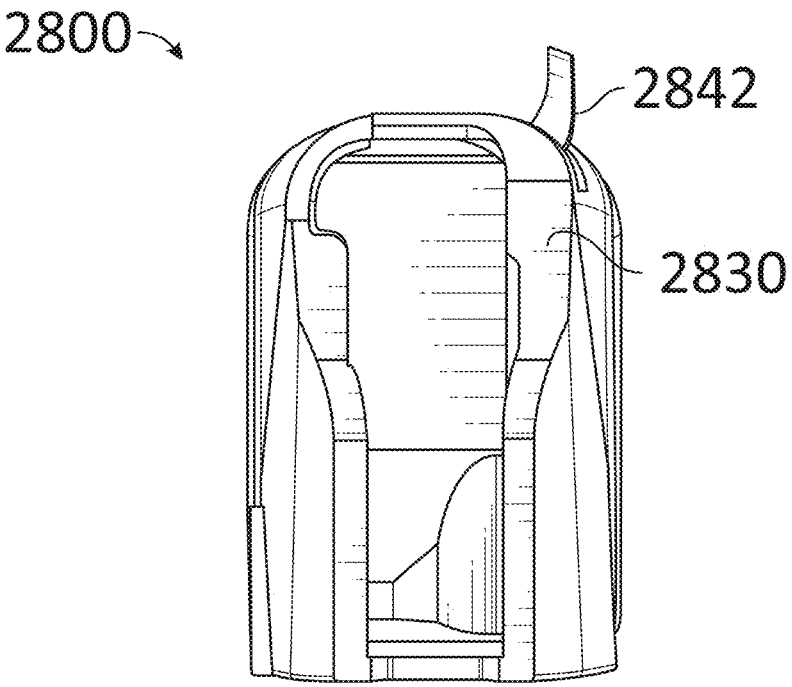
FIG. 28A schematically illustrates a top view of a magazine in a locked condition, according to some of the various embodiments.

Reference is now made to FIG. 28A, which schematically illustrates a top view of a magazine 2800 in a locked condition, according to some of the various embodiments. The magazine 2800 may comprise an elongated tubular body. The elongated tubular body may comprise an upper end 2830. The magazine 2800 may comprise a block element 2842. The block element 2842 may be adapted to move between a first position (as shown) when a locking mechanism is in the locked condition, and a second position when the locking mechanism is in the unlocked condition.

Figure 28B:
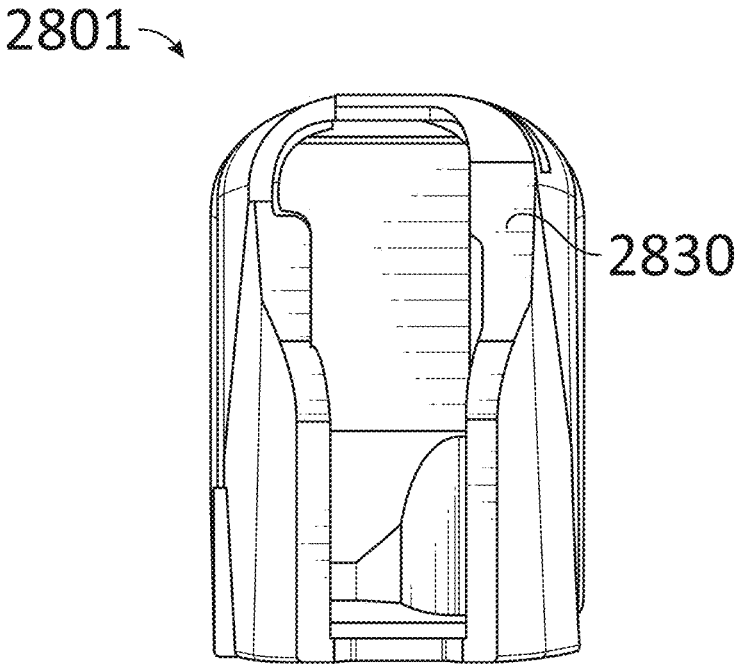
FIG. 28B schematically illustrates a top view of a magazine in an unlocked condition, according to some of the various embodiments.

Reference is now made to FIG. 28B, which schematically illustrates a top view of a magazine 2801 in an unlocked condition, according to some of the various embodiments. The magazine 2801 may comprise an elongated tubular body. The elongated tubular body may comprise an upper end 2830. The magazine 2801 may comprise a block element. The block element may be adapted to move between a first position when a locking mechanism is in the locked condition, and a second position (as shown) when the locking mechanism is in the unlocked condition.

Figure 29A:
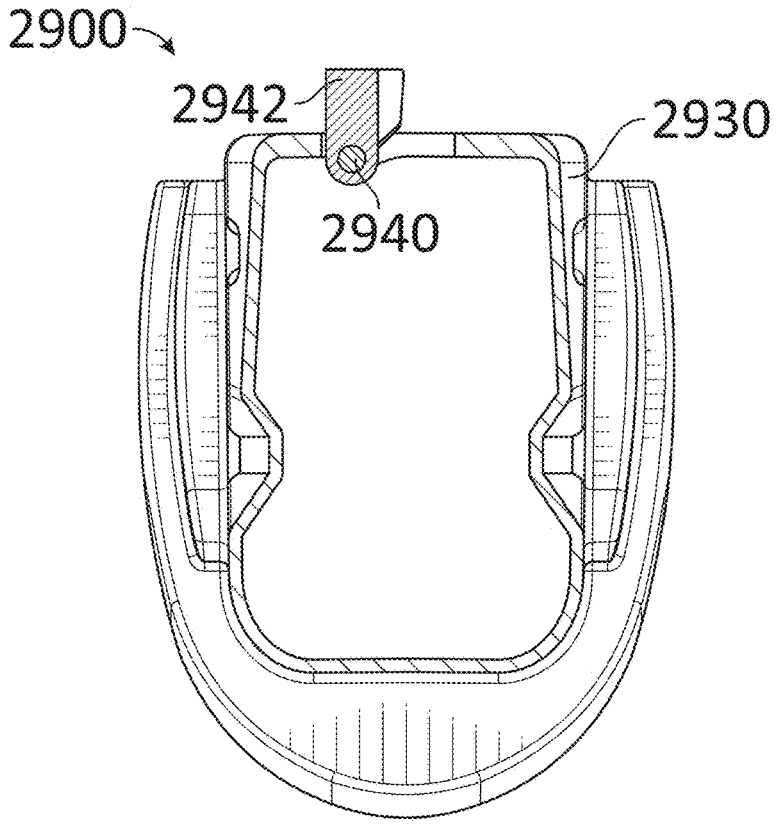
FIG. 29A schematically illustrates a cross-sectional top view of a magazine in a locked condition, according to some of the various embodiments.

Reference is now made to FIG. 29A, which schematically illustrates a cross-sectional top view of a magazine 2900 in a locked condition, according to some of the various embodiments. The magazine 2900 may comprise an elongated tubular body. The elongated tubular body may comprise an upper end 2930. The magazine 2900 may comprise an clongated shaft 2940. The elongated shaft 2940 may comprise an upper end. The upper end of the elongated shaft 2940 may be proximate the upper end 2930 of the elongated tubular body. The magazine 2900 may comprise a block element 2942. The block element 2942 may be connected proximate to the upper end of the elongated shaft 2940. The block element 2942 may be adapted to move between a first position (as shown) when a locking mechanism is in the locked condition, and a second position when the locking mechanism is in the unlocked condition.

Figure 29B:
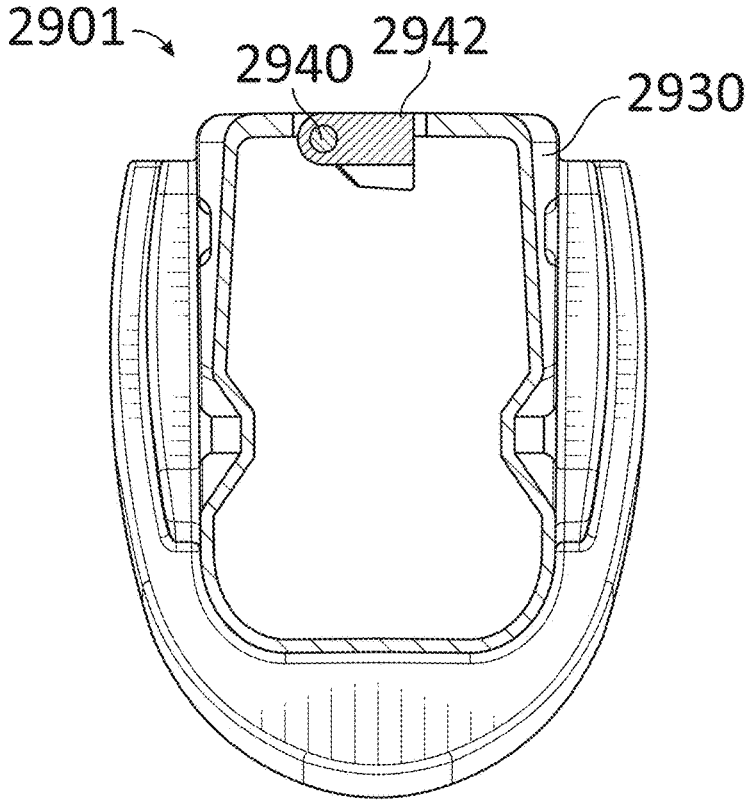
FIG. 29B schematically illustrates a cross-sectional top view of a magazine in an unlocked condition, according to some of the various embodiments.

Reference is now made to FIG. 29B, which schematically illustrates a cross-sectional top view of a magazine 2901 in an unlocked condition, according to some of the various embodiments. The magazine 2901 may comprise an elongated tubular body. The elongated tubular body may comprise an upper end 2930. The magazine 2901 may comprise an elongated shaft 2940. The elongated shaft 2940 may comprise an upper end. The upper end of the elongated shaft 2940 may be proximate the upper end 2930 of the elongated tubular body. The magazine 2901 may comprise a block element 2942. The block element 2942 may be connected proximate to the upper end of the elongated shaft 2940. The block element 2942 may be adapted to move between a first position when a locking mechanism is in the locked condition, and a second position (as shown) when the locking mechanism is in the unlocked condition.

Figure 30A:
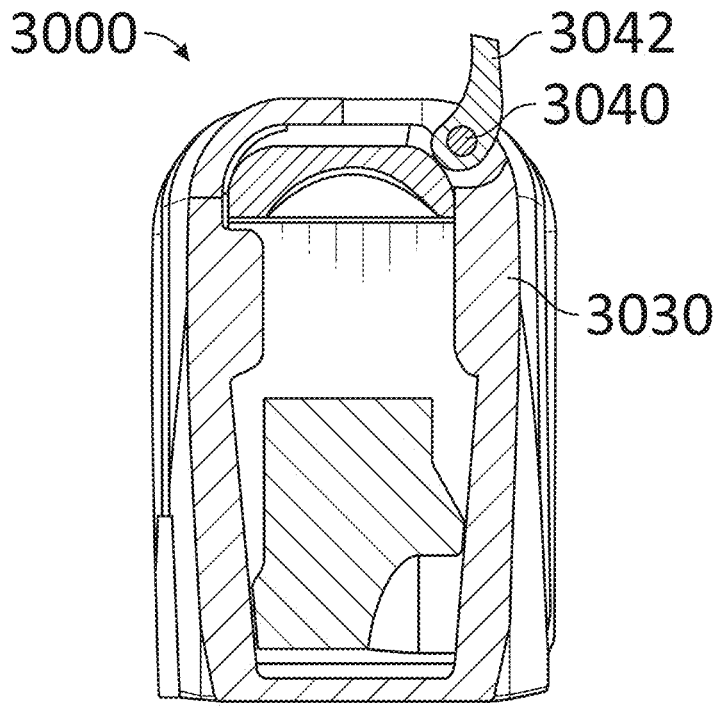
FIG. 30A schematically illustrates a cross-sectional top view of a magazine in a locked condition, according to some of the various embodiments.

Reference is now made to FIG. 30A, which schematically illustrates a cross-sectional top view of a magazine 3000 in a locked condition, according to some of the various embodiments. The magazine 3000 may comprise an elongated tubular body. The elongated tubular body may comprise an upper end 3030. The magazine 3000 may comprise an elongated shaft 3040. The elongated shaft 3040 may comprise an upper end. The upper end of the elongated shaft 3040 may be proximate the upper end 3030 of the elongated tubular body. The magazine 3000 may comprise a block element 3042. The block element 3042 may be connected proximate to the upper end of the elongated shaft 3040. The block element 3042 may be adapted to move between a first position (as shown) when a locking mechanism is in the locked condition, and a second position when the locking mechanism is in the unlocked condition.

Figure 30B:
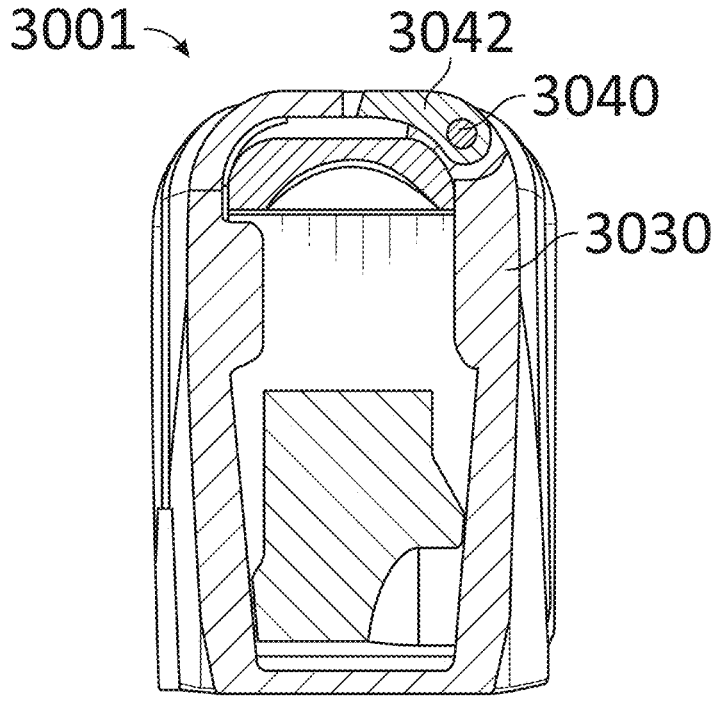
FIG. 30B schematically illustrates a cross-sectional top view of a magazine in an unlocked condition, according to some of the various embodiments.

Reference is now made to FIG. 30B, which schematically illustrates a cross-sectional top view of a magazine 3001 in an unlocked condition, according to some of the various embodiments. The magazine 3001 may comprise an elongated tubular body. The elongated tubular body may comprise an upper end 3030. The magazine 3001 may comprise an clongated shaft 3040. The elongated shaft 3040 may comprise an upper end. The upper end of the elongated shaft 3040 may be proximate the upper end 3030 of the elongated tubular body. The magazine 3001 may comprise a block element 3042. The block element 3042 may be connected proximate to the upper end of the elongated shaft 3040. The block element 3042 may be adapted to move between a first position when a locking mechanism is in the locked condition, and a second position (as shown) when the locking mechanism is in the unlocked condition.

Figure 31:
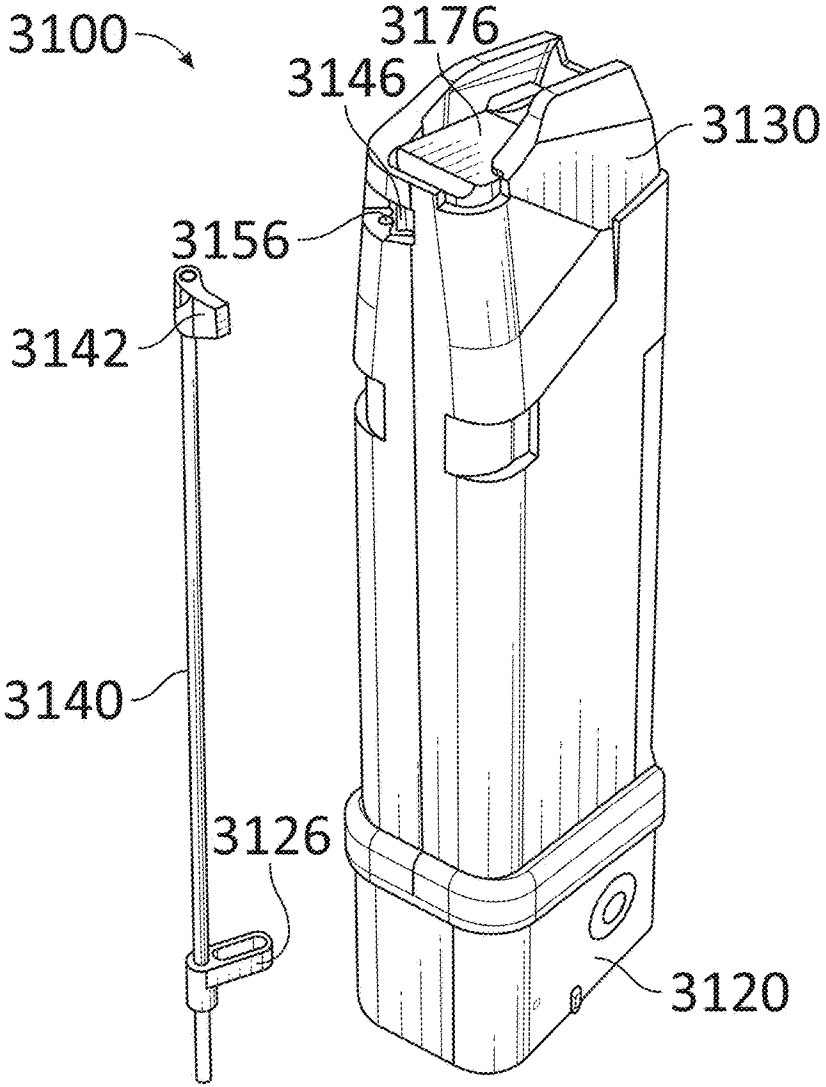
FIG. 31 schematically illustrates an exploded view of a magazine, according to some of the various embodiments.

Reference is now made to FIG. 31, which schematically illustrates an exploded view of a magazine 3100, according to some of the various embodiments. The magazine 3100 may comprise an clongated tubular body and a follower 3176. The elongated tubular body may comprise an upper end 3130, a lower end 3120, and a block recess 3146. The magazine 3100 may comprise an elongated shaft 3140, a block element 3142, and a rotor 3126. The elongated tubular body may define a shaft passage 3156. The shaft passage 3156 may be adapted to closely receive the elongated shaft 3140. The block element 3142 may define a block passage. The block passage may be adapted to closely receive the elongated shaft 3140. The rotor 3126 may define a rotor passage. The rotor passage may be adapted to closely receive the elongated shaft 3140.

Figure 32:
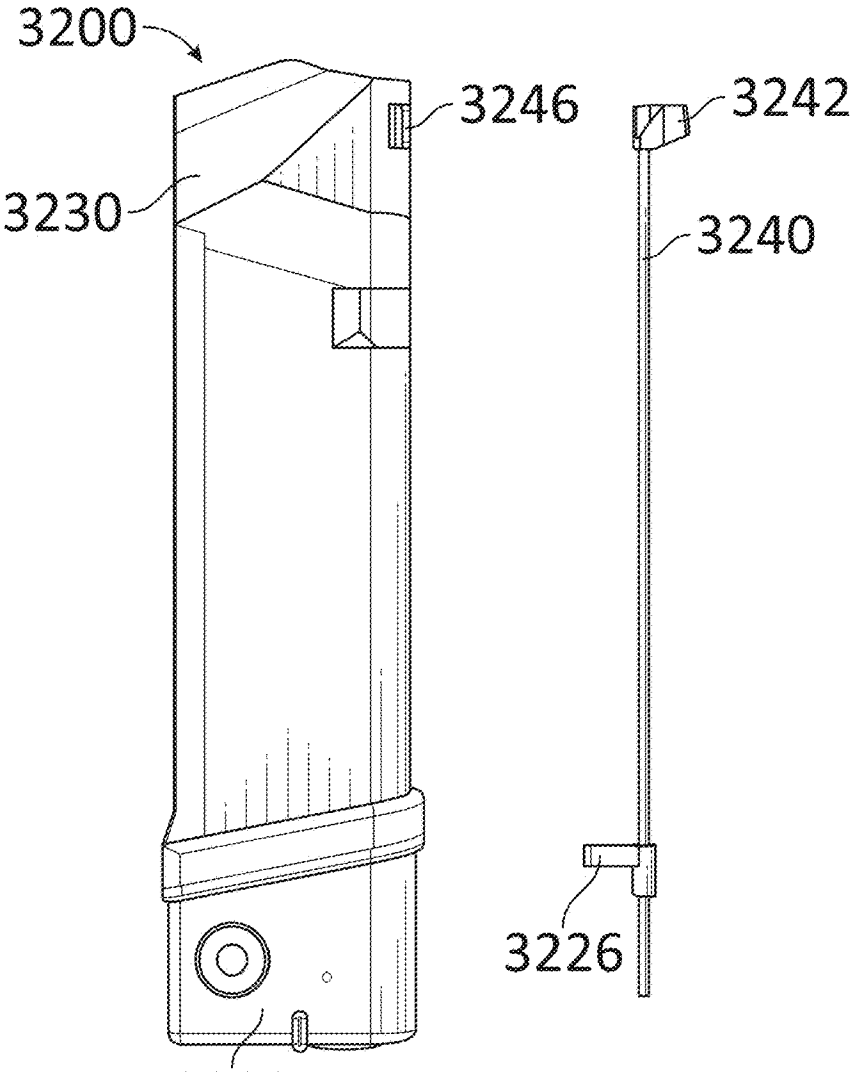
FIG. 32 schematically illustrates an exploded view of a magazine, according to some of the various embodiments.

Reference is now made to FIG. 32, which schematically illustrates an exploded view of a magazine 3200, according to some of the various embodiments. The magazine 3200 may comprise an elongated tubular body. The elongated tubular body may comprise an upper end 3230, a lower end 3220, and a block recess 3246. The magazine 3200 may comprise an elongated shaft 3240, a block element 3242, and a rotor 3226. The elongated tubular body may define a shaft passage. The shaft passage may be adapted to closely receive the elongated shaft 3240. The block element 3242 may define a block passage. The block passage may be adapted to closely receive the elongated shaft 3240. The rotor 3226 may define a rotor passage. The rotor passage may be adapted to closely receive the elongated shaft 3240.

According to some of the various embodiments, a magazine may comprise an elongated tubular body. The elongated tubular body may comprise an upper end and a lower end. The magazine may comprise at least one status indicator. The at least one status indicator may be disposed to the lower end. The at least one status indicator may be movable between a first position and a second position based on whether a locking mechanism is in a locked condition or an unlocked condition. The at least one status indicator may be adapted to provide a tactile indication of its condition. The condition of at least one status indicator may be based on its position, the condition of the locking mechanism, the position of a block element, combinations thereof, and/or the like. For example, a status indicator may be adapted to project past the exterior surface of the elongated body in a first position, and retract beneath the exterior surface of the elongated body in a second position. For example, a status indicator may comprise a pivot and a lever. The lever may be adapted to pivot through a range of degrees (e.g. a range of 45 or 90 degrees) from the first position to the second position. A plurality of status indicators may be disposed to the lower end. The plurality of status indicators may be adapted to accommodate a variety of user firearm grip positions and/or ambidextrous use of a firearm with the magazine installed. The at least one status indicator may be coupled to at least one indicator. The at least one indicator may be adapted to present one of: a safe condition and a fire condition. The condition of the at least one indicator may be based on the condition of the locking mechanism, the position of the block element, combinations thereof, and/or the like.

Figure 33C:
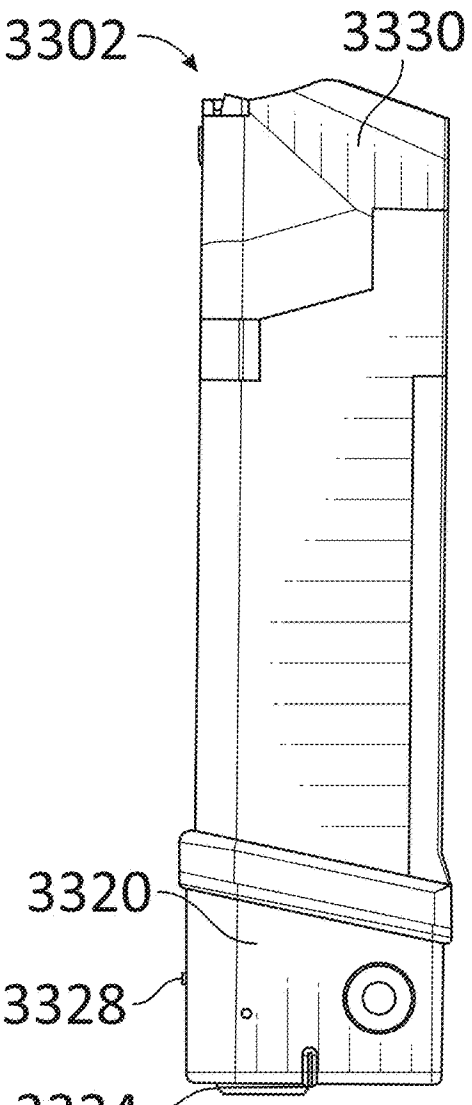
FIGS. 33A, 33B, and 33C schematically illustrate various views of a magazine in an unlocked condition with a status indicator, according to some of the various embodiments.
Figure 33B:
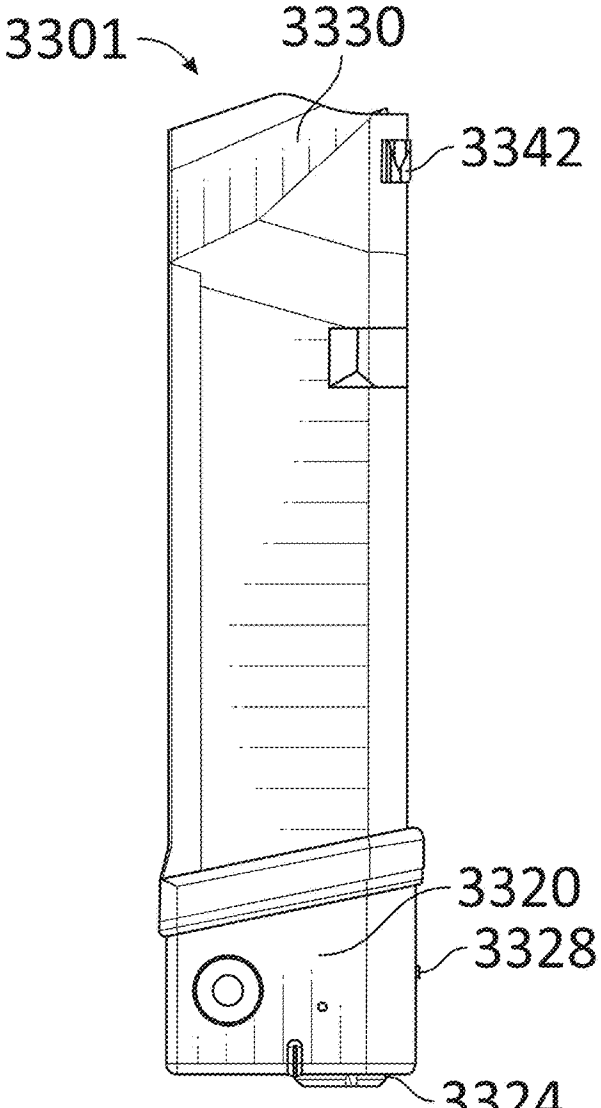
Figure 33A:
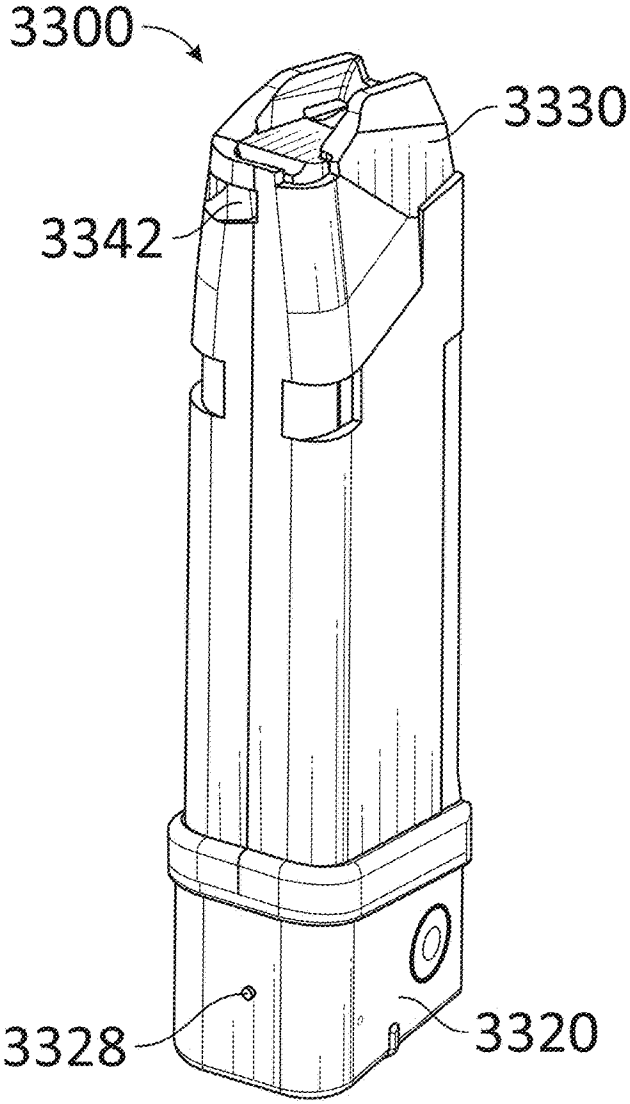

Reference is now made to FIGS. 33A, 33B, and 33C, which schematically illustrate various views of a magazine (e.g. 3300, 3301, and 3302) in an unlocked condition with a status indicator 3328, according to some of the various embodiments. The magazine (e.g. 3300, 3301, and 3302) may comprise an elongated tubular body. The elongated tubular body may comprise an upper end 3330 and a lower end 3320. The magazine (e.g. 3300, 3301, and 3302) may comprise a block element 3342 and the status indicator 3328. The status indicator may be movable between a first position (as shown) and a second position based on whether a locking mechanism is in a locked condition or an unlocked condition. The block element 3342 may be adapted to move between a first position when a locking mechanism is in the locked condition, and a second position (as shown) when the locking mechanism is in the unlocked condition. The magazine (e.g. 3301 and 3302) may comprise a user interface 3324.

Figure 34:
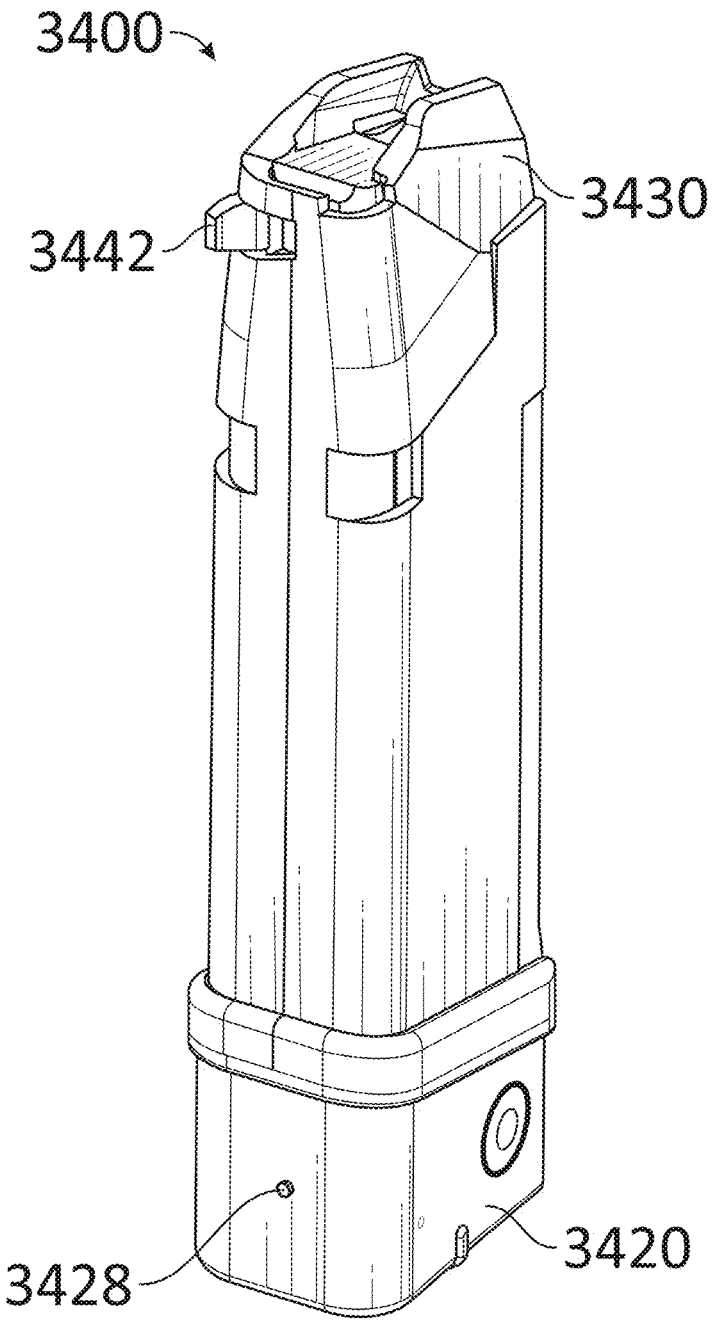
FIG. 34 schematically illustrates an isometric view of a magazine in a locked condition with a status indicator, according to some of the various embodiments.

Reference is now made to FIG. 34, which schematically illustrates an isometric view of a magazine 3400 in a locked condition with a status indicator 3428, according to some of the various embodiments. The magazine 3400 may comprise an elongated tubular body. The elongated tubular body may comprise an upper end 3430 and a lower end 3420. The magazine 3400 may comprise a block element 3442 and the status indicator 3428. The status indicator may be movable between a first position and a second position (as shown) based on whether a locking mechanism is in a locked condition or an unlocked condition. The block element 3442 may be adapted to move between a first position when a locking mechanism is in the locked condition (as shown), and a second position when the locking mechanism is in the unlocked condition.

Figure 35C:
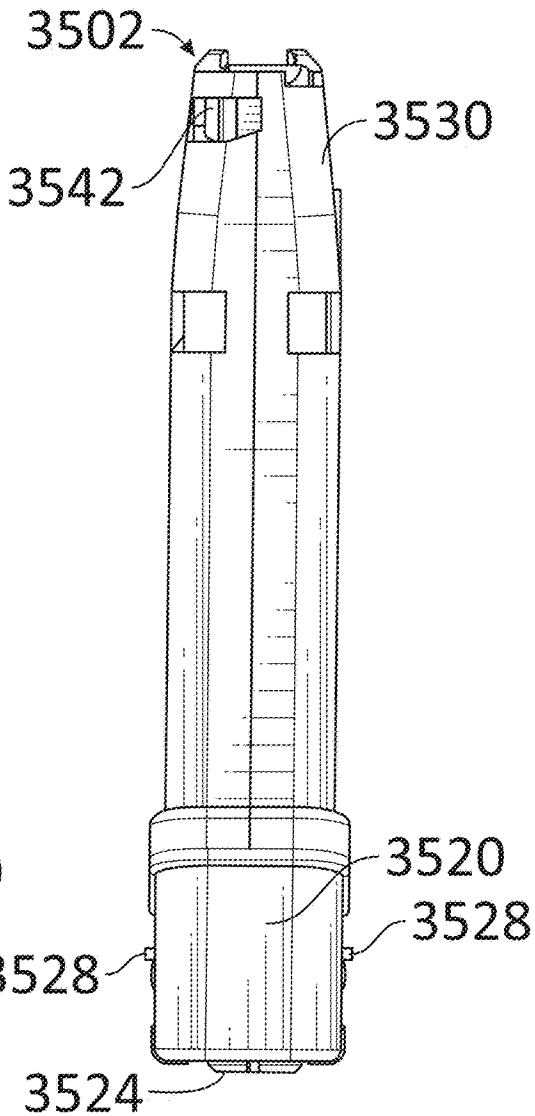
FIGS. 35A, 35B, and 35C schematically illustrate various views of a magazine in a locked condition with a plurality of status indicators, according to some of the various embodiments.
Figure 35B:
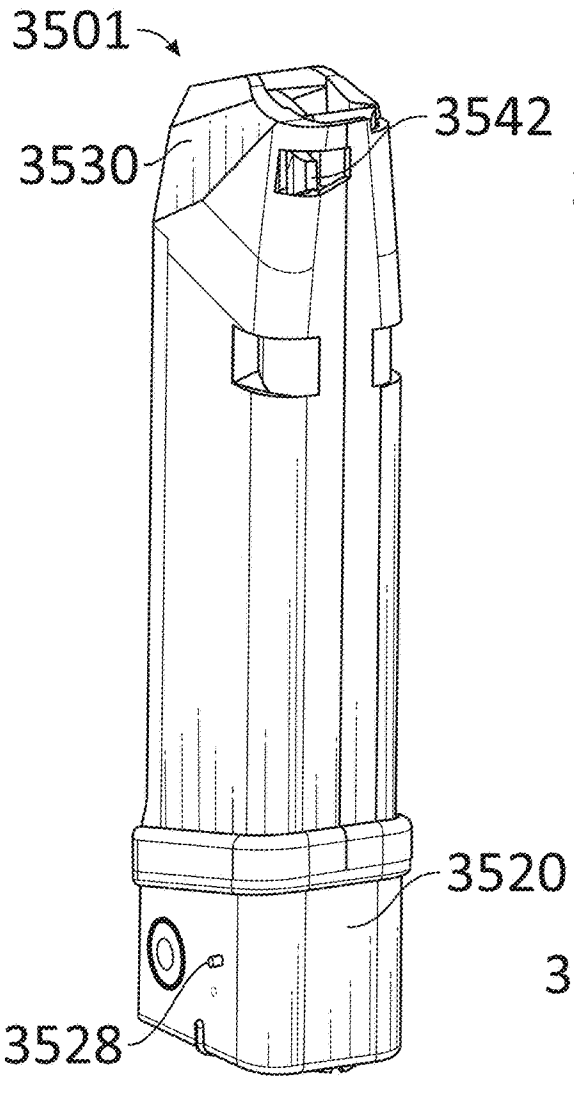
Figure 35A:
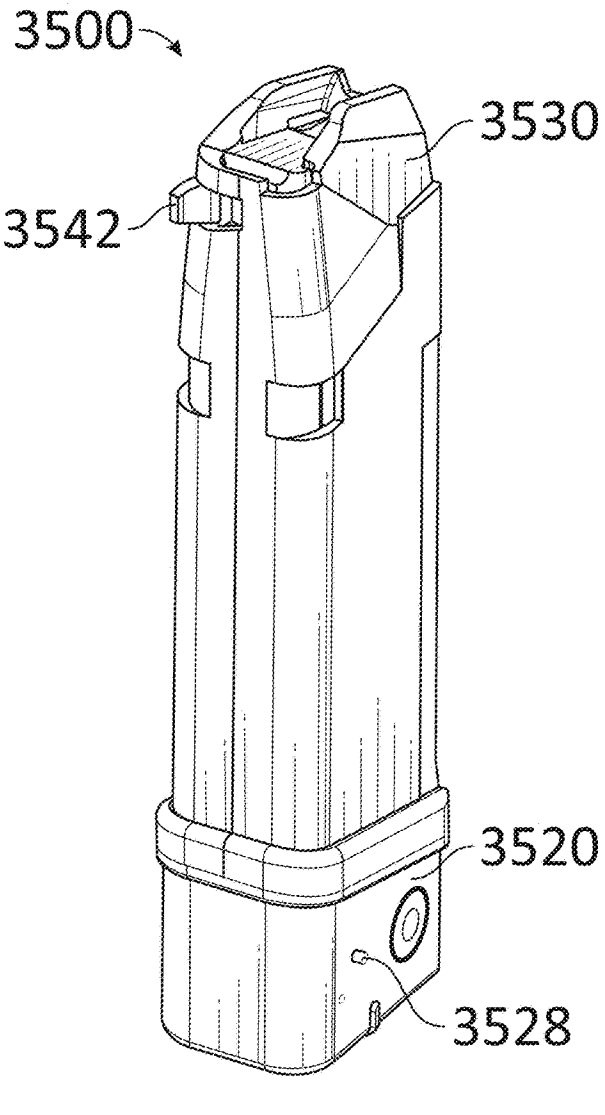

Reference is now made to FIGS. 35A, 35B, and 35C, which schematically illustrate various views of a magazine (e.g. 3300, 3301, and 3302) in a locked condition with a plurality of status indicators 3528, according to some of the various embodiments. The magazine (e.g. 3500, 3501, and 3502) may comprise an elongated tubular body. The elongated tubular body may comprise an upper end 3530 and a lower end 3520. The magazine (e.g. 3500, 3501, and 3502) may comprise a block element 3542 and the plurality of status indicators 3528. The plurality of status indicators may be movable between a first position (as shown) and a second position based on whether a locking mechanism is in a locked condition or an unlocked condition. The block element 3542 may be adapted to move between a first position when a locking mechanism is in the locked condition (as shown), and a second position when the locking mechanism is in the unlocked condition. The magazine (e.g. 3501 and 3502) may comprise a user interface 3524.

Figure 36B:
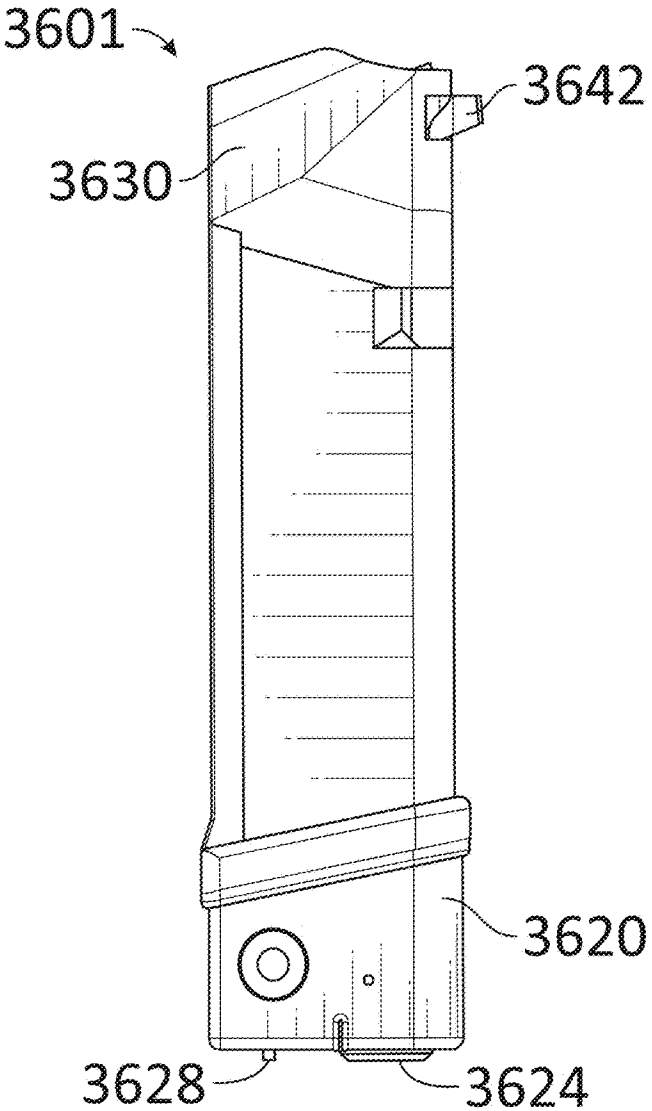
FIGS. 36A and 36B schematically illustrate various views of a magazine in a locked condition with a status indicator, according to some of the various embodiments.
Figure 36A:
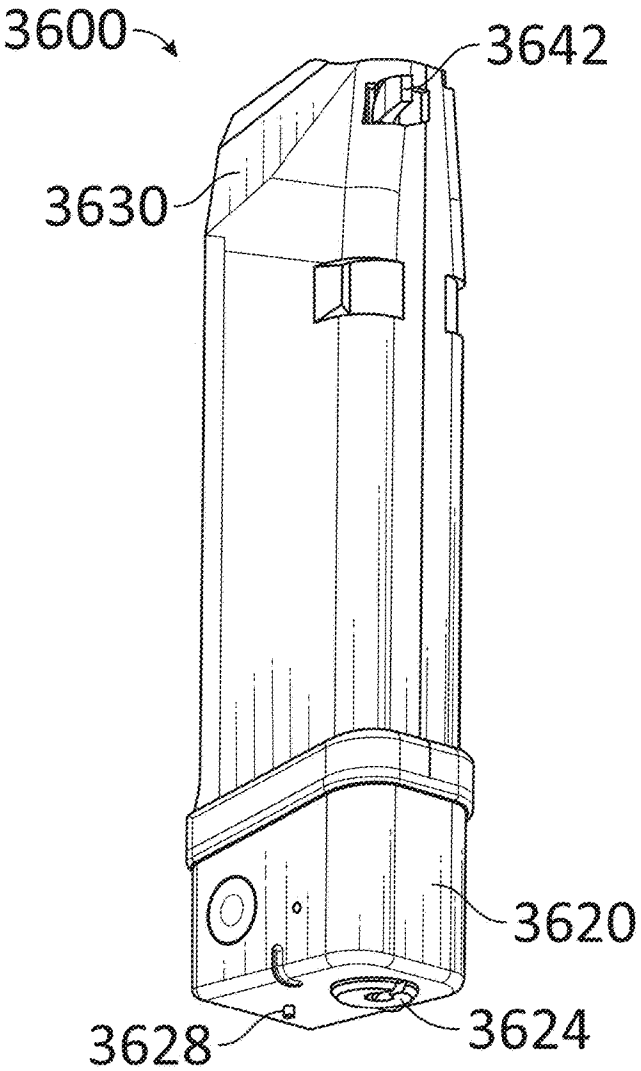

Reference is now made to FIGS. 36A and 36B, which schematically illustrate various views of a magazine (e.g. 3600 and 3601) in a locked condition with a status indicator 3628, according to some of the various embodiments. The magazine (e.g. 3600 and 3601) may comprise an elongated tubular body. The elongated tubular body may comprise an upper end 3630 and a lower end 3620. The magazine (e.g. 3600 and 3601) may comprise a block element 3642 and the status indicator 3628. The status indicator may be movable between a first position (as shown) and a second position based on whether a locking mechanism is in a locked condition or an unlocked condition. The block element 3642 may be adapted to move between a first position when a locking mechanism is in the locked condition (as shown), and a second position when the locking mechanism is in the unlocked condition. The magazine (e.g. 3600 and 3601) may comprise a user interface 3624.

Figure 37:
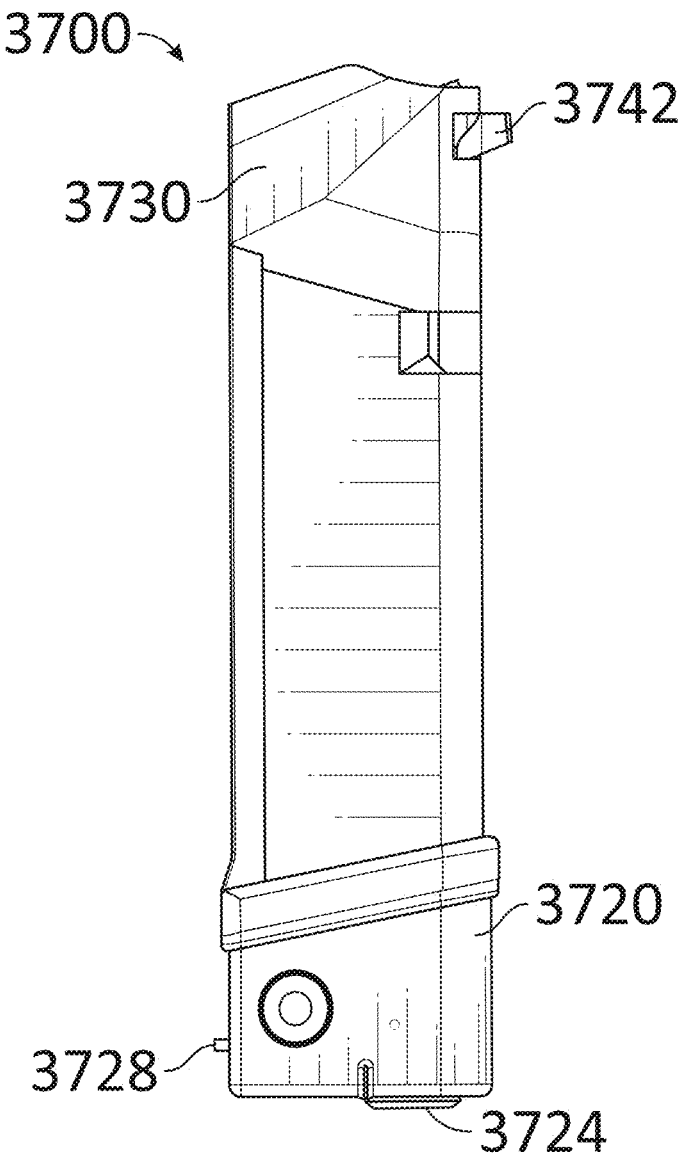
FIG. 37 schematically illustrates a side view of a magazine in a locked condition with a status indicator, according to some of the various embodiments.

Reference is now made to FIG. 37, which schematically illustrates a side view of a magazine 3700 in a locked condition with a status indicator 3728, according to some of the various embodiments. The magazine 3700 may comprise an elongated tubular body. The elongated tubular body may comprise an upper end 3730 and a lower end 3720. The magazine 3700 may comprise a block element 3742 and the status indicator 3728. The status indicator may be movable between a first position (as shown) and a second position based on whether a locking mechanism is in a locked condition or an unlocked condition. The block element 3742 may be adapted to move between a first position when a locking mechanism is in the locked condition (as shown), and a second position when the locking mechanism is in the unlocked condition. The magazine 3700 may comprise a user interface 3724.

Figure 38:
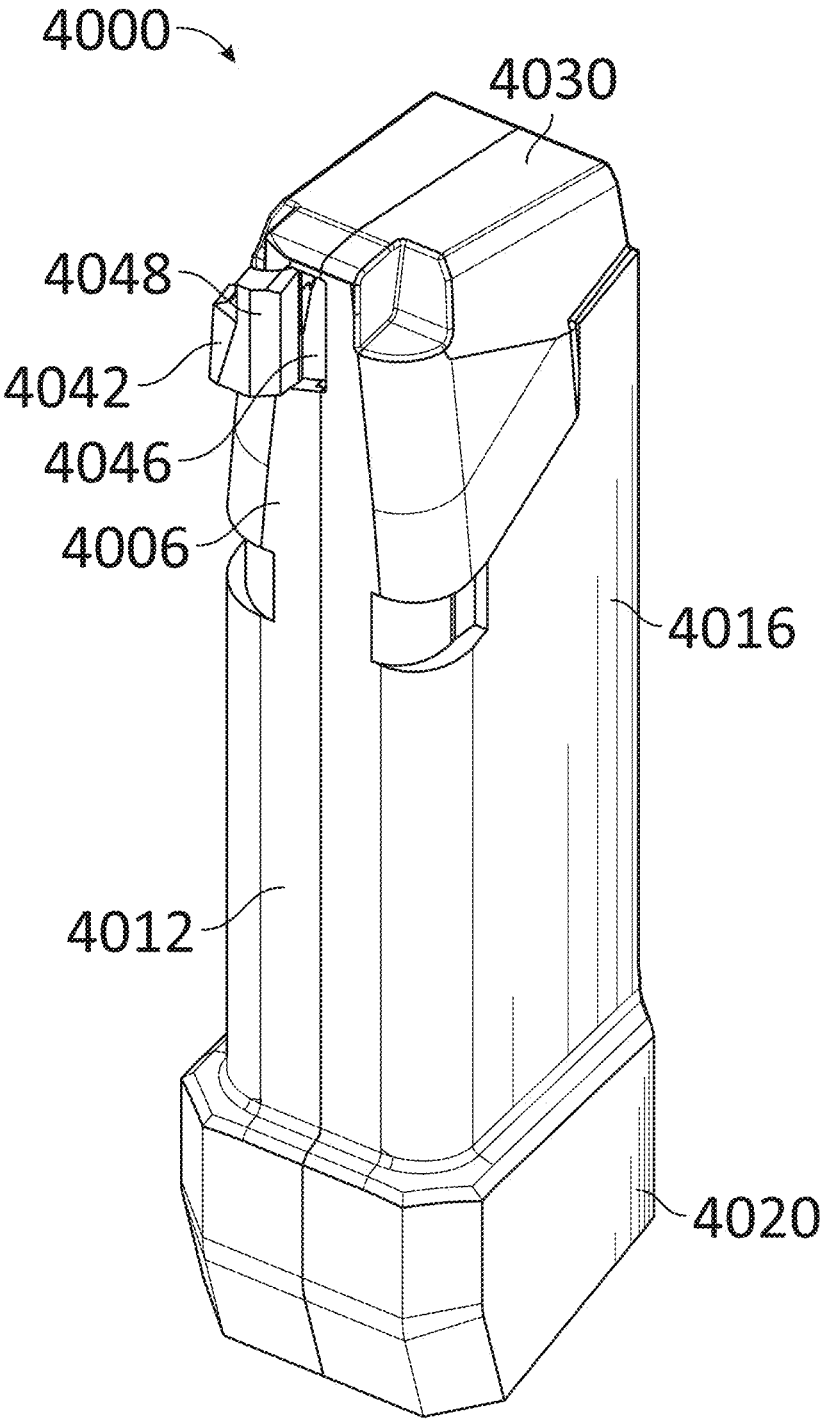
FIG. 38 schematically illustrates an isometric view of a current embodiment of a lock for a pistol in the locked condition.
Figure 40B:
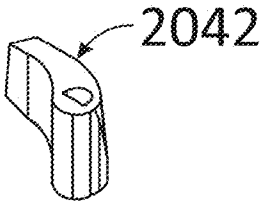
FIG. 40B schematically illustrates a rear isometric view of the block element of the magazine of FIG. 20A.
Figure 40A:
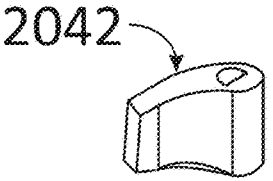
FIG. 40A schematically illustrates a front isometric view of the block element of the magazine of FIG. 20A.
Figure 40D:
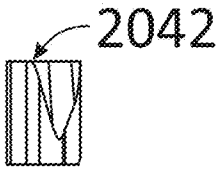
FIG. 40D schematically illustrates a rear view of the magazine of FIG. 20A.
Figure 40C:
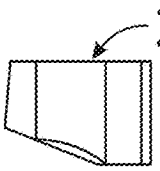
FIG. 40C schematically illustrates a side view of the magazine of FIG. 20A.
Figure 40E:
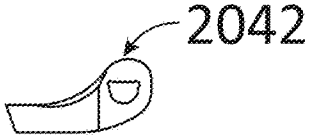
FIG. 40E schematically illustrates a bottom view of the magazine of FIG. 20A.
Figure 39B:
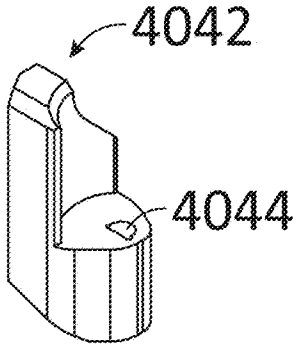
FIG. 39B schematically illustrates a rear isometric view of the block element of the lock for a pistol of FIG. 38.
Figure 39A:
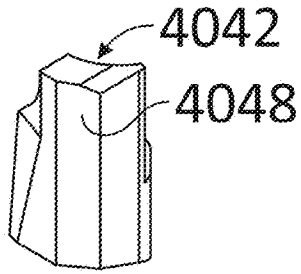
FIG. 39A schematically illustrates a front isometric view of the block element of the lock for a pistol of FIG. 38.
Figure 39D:
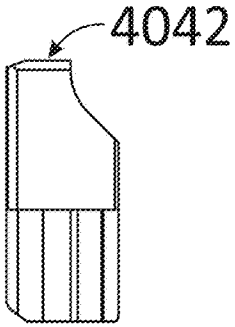
FIG. 39D schematically illustrates a rear view of the block element of the lock for a pistol of FIG. 38.
Figure 39C:
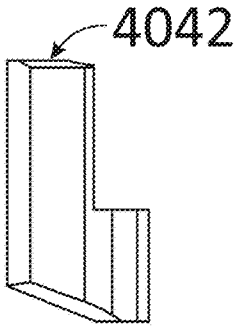
FIG. 39C schematically illustrates a side view of the block element of the lock for a pistol of FIG. 38.
Figure 39E:
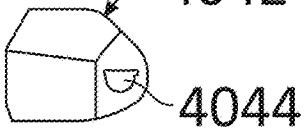
FIG. 39E schematically illustrates a bottom view of the block element of the lock for a pistol of FIG. 38.

Reference is now made to FIG. 38, which schematically illustrates a lock for a pistol 4000 of the present invention in a locked condition. The lock for a pistol 4000 may comprise an elongated tubular body. The elongated tubular body may comprise an exterior profile adapted to be closely received in a magazine well 5002 of a host firearm (pistol 5000 shown in FIGS. 41-44. The elongated tubular body may comprise an upper end 4030, a lower end 4020, and a block recess 4046. The lower end 4020 may be opposed to the upper end 4030. The elongated tubular body may comprise opposed sidewalls 4016, a front wall 4012, and a rear wall 4010 (visible in FIGS. 41-44). The lock for a pistol 4000 may comprise a block element 4042. The block element 4042 may be moved into a first position (as shown) when a locking mechanism of the lock for a pistol 4000 is in a locked condition. In the first position, the block element 4042 may protrude from the exterior profile to prevent extraction of the lock for a pistol 4000. The block element 4042 may be moved into a second position (shown in FIG. 43) when a locking mechanism of the lock for a pistol 4000 is in an unlocked condition. In the second position, the block element 4042 may be flush with or within the exterior profile to enable extraction of the lock for a pistol 4000. The block element 4042 may be a planar element comprising a major surface 4048. The major surface 4048 may be flush with an external surface 4006 of the elongated tubular body of the lock for a pistol 4000 when the block element 4042 is in the second position. The block element 4042 may define a block passage 4044. The block passage may be adapted to closely receive an elongated shaft.

Reference is now made to FIGS. 39A-40E, which schematically illustrate the block element 4042 of the lock for a pistol 4000 (FIGS. 39A-E) and block element 2042 of the magazine 2000 (FIGS. 40A-E) for comparison purposes. Both the block element 4042 and block element 2042 have functional similarities in that they prevent operation of a host firearm (pistol 5000 illustrated in FIGS. 41-44) when they are in the locked condition by blocking the movement of the trigger element 5012 of the host firearm. Both the block element 4042 and block element 2042 also enable operation of the host firearm when they are in the unlocked condition by enabling movement of the trigger element 5012 of the host firearm. Both the block element 4042 and block element 2042 also are connected proximate to the upper end of an elongated shaft, which rotates the connected block element between the locked and unlocked conditions. Both the block element 4042 and block element 2042 also prevent extraction of the lock for a pistol 4000 in the case of block element 4042 and the magazine 2000 in the case of block element 2042 from the host firearm's magazine well 5002 when in the locked condition, and enable extraction from the host firearm's magazine well 5002 when in the unlocked condition. However, it should be appreciated that the block element 4042 not only prevents movement of the trigger element of the host firearm when in the locked condition, but also prevents movement of the host firearm's barrel block 5008 to the lowered disengaged position when in the locked condition, thereby preventing movement of the host firearm's slide 5006 to the loading position. This additional functionality of keeping the slide 5006 closed is enabled in part by the greater height of block element 4042 relative to block element 2042.

Figure 41:
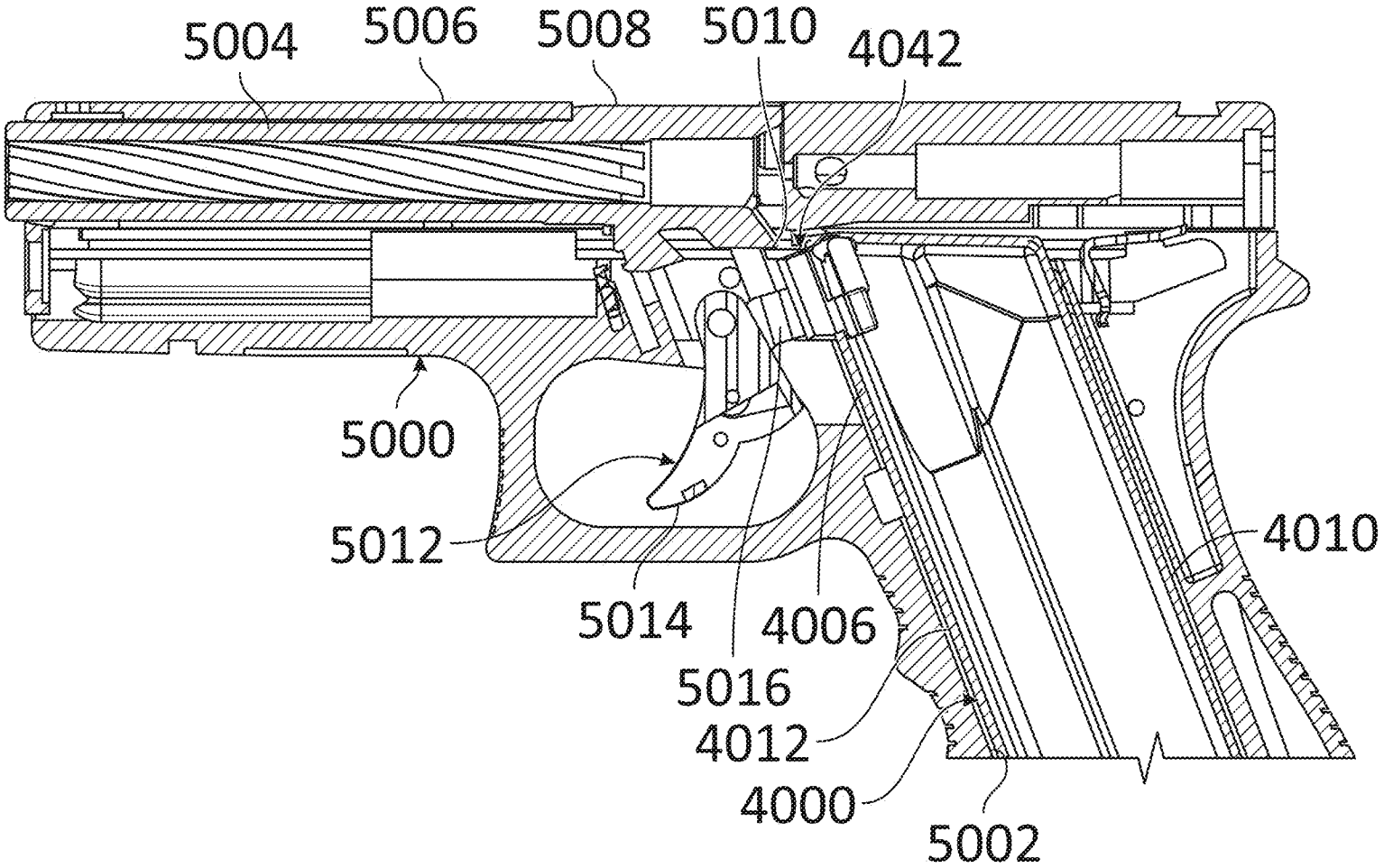
FIG. 41 schematically illustrates a cross-sectional partial view of the lock for a pistol of FIG. 38 accommodated in the magazine housing of a pistol in the locked condition with the barrel/slide in the forward battery position.
Figure 44:
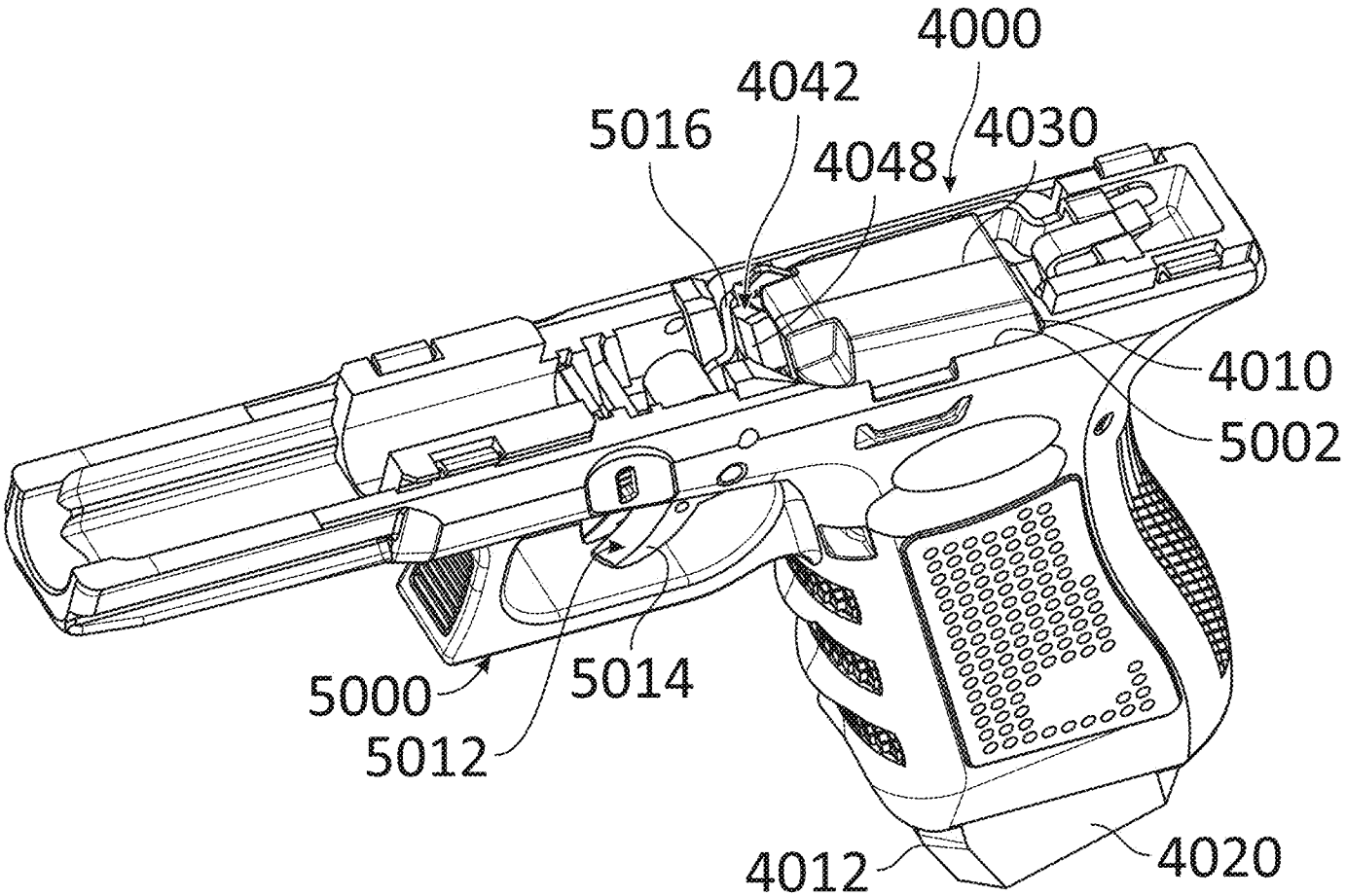
FIG. 44 schematically illustrates an isometric view of the lock for a pistol of FIG. 38 accommodated in the magazine housing of a pistol in the locked condition with the barrel/slide in battery, the block element deployed, and the trigger bar in reset position. The slide and barrel have been removed for clarity.

Reference is now made to FIGS. 41 & 44, which schematically illustrates the lock for a pistol 4000 of the present invention in a locked condition. The lock for a pistol is installed in the magazine well 5002 of a host firearm (pistol 5000). The pistol 5000 also has a barrel 5004, slide 5006, barrel block 5008 having a bottom 5010, and a trigger element 5012 including a trigger 5014 connected to a trigger bar 5016. The trigger element is movable between a rest position and a discharge position. The slide 5006 is operable to reciprocate between a forward battery position and a rear loading position. The barrel 5004 and slide 5006 are illustrated in battery with the block element 4042 deployed in the first position (the locked condition). In the first position, the block element 4042 prevents motion of the trigger element 5012 when the trigger 5014 is pulled by contacting the trigger bar 5016. Thus, the pistol 5000 is rendered inoperable even if a round is chambered in the barrel 5004. Furthermore, the block element 4042 in the first position prevents extraction of the lock for a pistol 4000 from the magazine well 5002 of pistol 5000.

Figure 42:
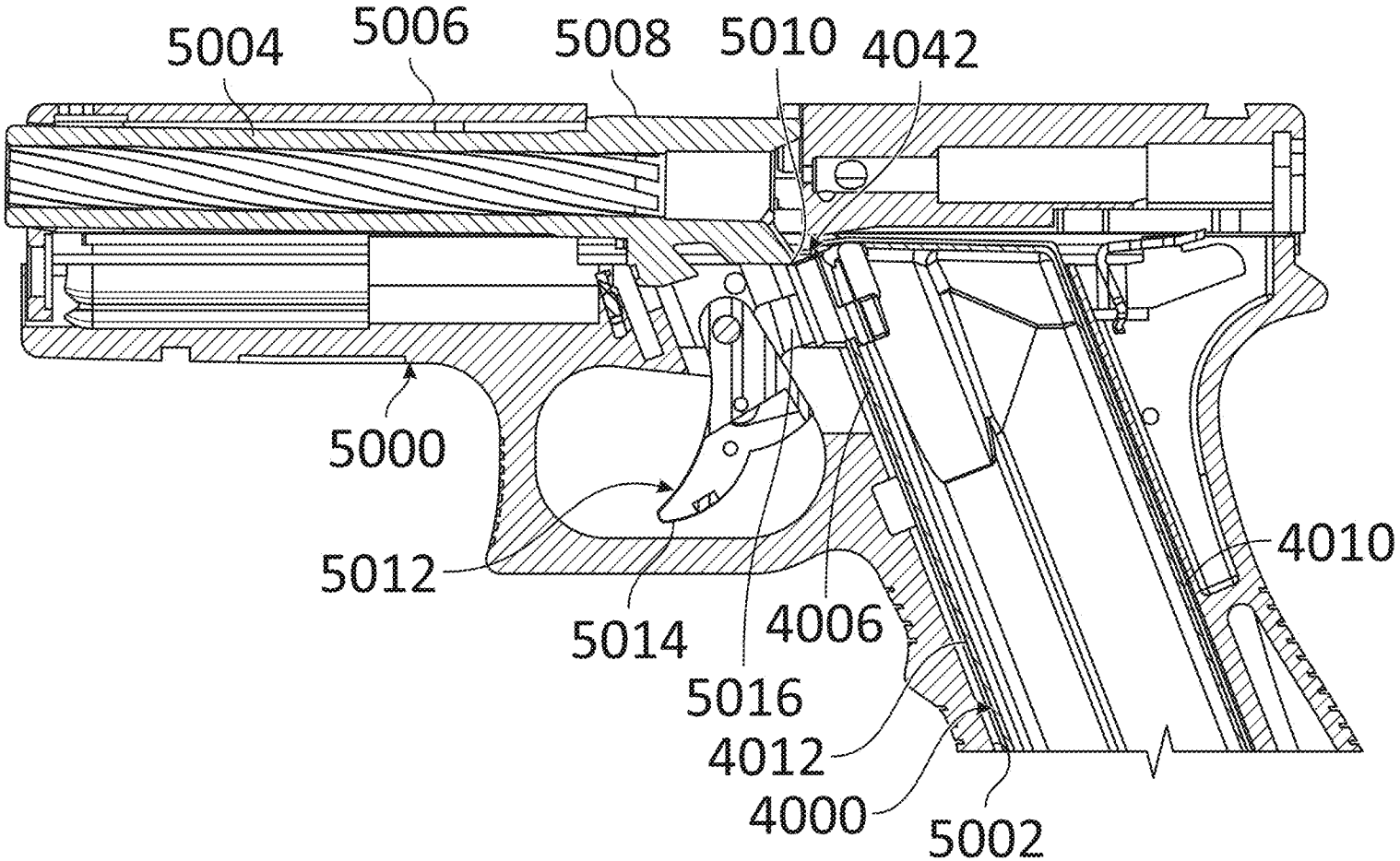
FIG. 42 schematically illustrates a cross-sectional partial view of the lock for a pistol of FIG. 38 accommodated in the magazine housing of a pistol in the locked condition with the barrel/slide partially open and the barrel lug in contact with the top of the deployed block element.

Reference is now made to FIG. 42, which schematically illustrates the lock for a pistol 4000 of the present invention in a locked condition. The lock for a pistol is installed in the magazine well 5002 of a host firearm (pistol 5000). The barrel 5004 and slide 5006 are illustrated in a partially open condition as would occur when a user attempted to manually cycle the slide 5006. The block element 4042 is deployed in the first position (the locked condition). In the first position, the block element 4042 blocks further rearward movement of the barrel 5004 and slide 5006 by contact occurring between the bottom 5010 of the barrel block 5008 and the block element 4042. This contact prevents the barrel 5004 from being movable with respect to the slide 5006 from an elevated engaged condition in which the barrel 5004 prevents movement of the slide 5006 to the rear loading position to a lowered disengaged position in which movement of the slide to the rear loading position is enabled. Thus, the pistol 5000 is further rendered inoperable because the slide cannot travel sufficiently rearward to reach the rear loading position. Furthermore, the block element 4042 in the first position prevents extraction of the lock for a pistol 4000 from the magazine well 5002 of pistol 5000.

Figure 43:
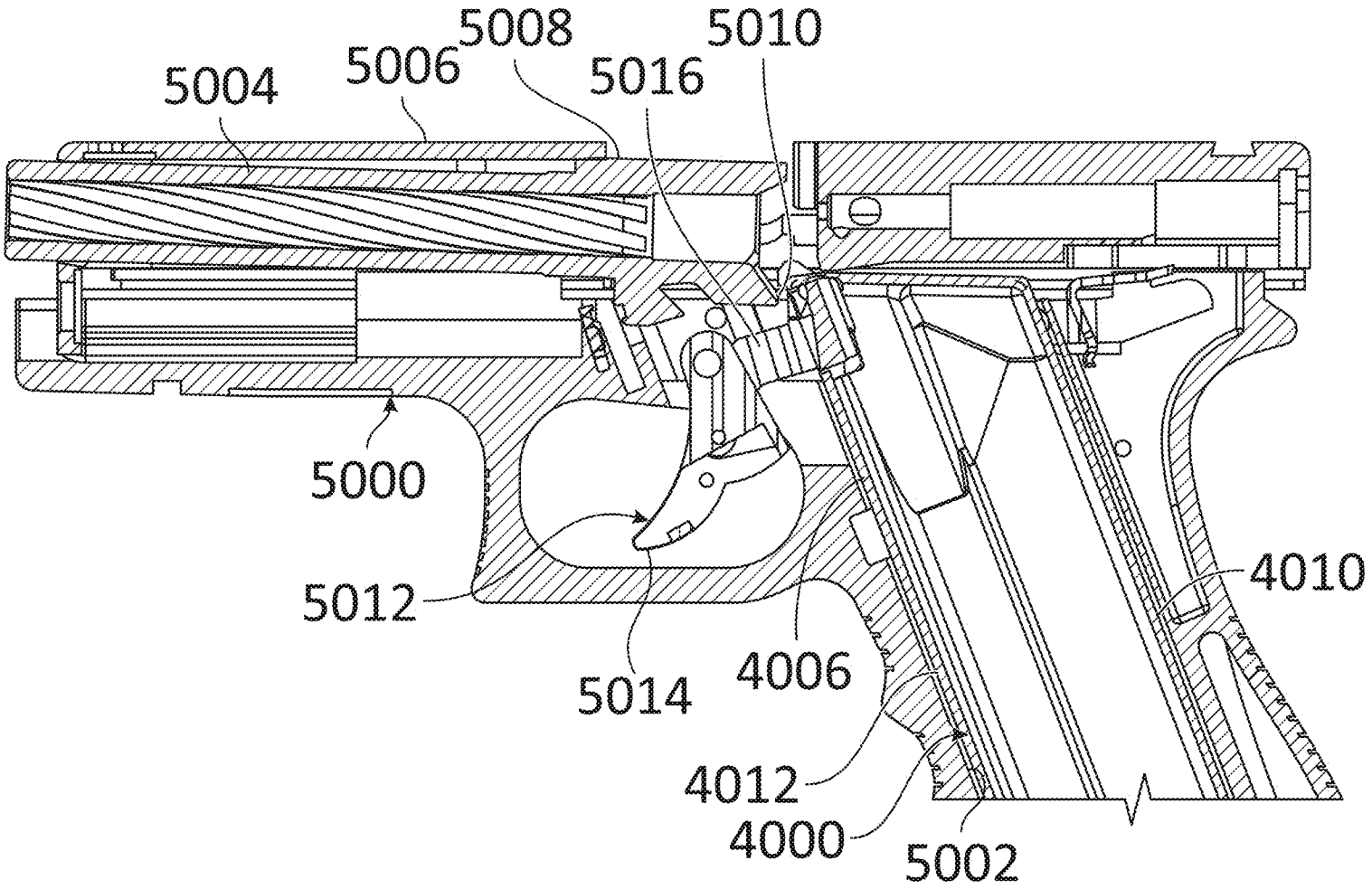
FIG. 43 schematically illustrates a cross-sectional partial view of the lock for a pistol of FIG. 38 accommodated in the magazine housing of a pistol in the unlocked condition with the barrel/slide fully unlocked and the block element retracted showing clearance with the barrel lug.

Reference is now made to FIG. 43, which schematically illustrates the lock for a pistol 4000 of the present invention in an unlocked condition. The lock for a pistol is installed in the magazine well 5002 of a host firearm (pistol 5000). The barrel 5004 and slide 5006 are illustrated in a fully unlocked position as would occur when a user successfully manually cycled the slide 5006. The block element 4042 is retracted in the second position (the unlocked condition). In the second position, the block element 4042 has rotated relative to the first position so the major surface 4048 is flush with an external surface 4006 of the clongated tubular body of the lock for a pistol 4000. With the block element 4042 in the second position, sufficient clearance exists between bottom 5010 of the barrel block 5008 and the block element 4042. Thus, the barrel 5004 can move with respect to the slide 5006 from an elevated engaged condition shown in FIGS. 41 & 42 in which the barrel 5004 prevents movement of the slide 5006 to the rear loading position to a lowered disengaged position shown in FIG. 43 in which movement of the slide to the rear loading position is enabled. Furthermore, the block element 4042 in the second position enables extraction of the lock for a pistol 4000 from the magazine well 5002 of pistol 5000. Once the lock for a pistol 4000 is extracted from the magazine well 5002, a loaded magazine can be inserted into the magazine well 5002 to make the pistol operable.

It should be appreciated that the elongated tubular body of the lock for a pistol 4000 is a lock for a pistol only, with no option to store and feed ammunition. However, despite omitting an ammunition compartment for receiving ammunition and an opening in the upper end 4030 for feeding ammunition, the lock for a pistol 4000 has a locking mechanism and user interface identical to those associated with the various embodiments of the magazine illustrated in FIGS. 1-37. Specifically the lock for a pistol 4000 may comprise a locking mechanism connected to the lower end 4020 of the elongated tubular body. The locking mechanism may comprise a locked condition and an unlocked condition. The locking mechanism may comprise a rotor. The rotor may be movable between a first rotational position when the locking mechanism is in the locked condition, and a second rotational position when the locking mechanism is in the unlocked condition. The second rotational position may be different than the first rotational position. The locking mechanism may comprise a user interface. The user interface may be adapted to enable a user to select between the locked condition and the unlocked condition. The lock for a pistol may comprise an elongated shaft. The elongated shaft may comprise a lower end and an upper end opposed to the lower end. The elongated tubular body may define a shaft passage closely receiving the elongated shaft. The elongated shaft may be proximate to one of the opposed sidewalls 4016 and to the front wall 4012. The lower end of the elongated shaft may be connected to the rotor. The upper end of the elongated shaft may be proximate the upper end 4030 of the elongated tubular body. The block element 4042 may be operably connected proximate to the upper end of the elongated shaft, thus making the block element 4042 operably connected to the locking mechanism. The block element 4042 may be an elongated element extending away from the elongated shaft. The block element 4042 may be adapted to move between a first position when the locking mechanism is in the locked condition, and a second position when the locking mechanism is in the unlocked condition.

According to some embodiments, an elongated shaft may be a straight element. An elongated shaft may be a cylindrical element. An elongated shaft may comprise a circular cross section. An upper end of the elongated shaft may be closer to an upper end of an elongated tubular body of a magazine than to a lower end of the elongated tubular body of the magazine.

According to some embodiments, a block element may extend laterally from an elongated shaft. A block element may extend radially from an elongated shaft. A block element may extend transversely from an elongated shaft. A block element may extend perpendicularly from an elongated shaft.

According to some embodiments, a user interface may be operably coupled to a locking mechanism. The user interface may comprise a user identification segment. The user interface may comprise a manual override segment, which may include use of a mechanical key in a lock cylinder. The lock cylinder may be located close the center of the elongated tube body while keeping the elongated shaft at the extremity of the elongated tube body, yet linked to and controlled by the lock cylinder.

The user interface may also include ability to control the status (rotational position) of the locking mechanism through the use of RFID (Radio-Frequency IDentification) communication and authentication. This approach would involve an item having an embedded, passive RFID tag which is preprogrammed to communicate with the user interface to establish authorization to unlock the locking mechanism. Once the user interface has detected the presence of the authorized tag, this will either trigger, or allow the user to trigger, a status change from locked to unlocked or vice versa. There are multiple options for how such a system could be set up:

Upon the RFID tag coming within a predefined radius of the user interface antennae (i.e. 18 inches), the user interface will recognize the tag's presence and change the locking mechanism's status from locked to unlocked. This method of operation could be used by a homeowner who has a loaded handgun stored in an area of their house and wants to be sure the handgun cannot be used by anyone other than those who are wearing an embedded RFID tag.

Upon the RFID tag coming within a predefined radius of the user interface antennae, the user interface will recognize the tag's presence and wait for an additional user input to change the locking mechanism's status. This version would also include one or more buttons on the portion of the user interface which protrudes from the frame of the pistol.

A RFID tag is embedded into a holster. While the pistol is holstered, the locking mechanism is locked. Upon removal from the holster, the locking mechanism will unlock and remain unlocked until the user interface can no longer communicate with the RFID tag. In the event that the pistol goes outside of a predetermined radius, the user interface will cause the locking mechanism to lock again. This could be used by a civilian or law enforcement officer user who carries a handgun and wants to have quick access to a live pistol when unholstered, but confidence that the pistol cannot be used against them if it is dropped or stolen from them.

A more specific application of the RFID functionality would be in a commercial range facility where firearms are being loaned/rented. One scenario would be that upon renting a firearm, the customer has their membership card scanned at the rental counter. This is then used to assign that customer one or more magazines. The magazines are programmed via a control station so as to only be allowed to function in a specific shooting lane at the range. This would be done similarly to how RFID room keys are programmed at hotels, except that instead of programming a code onto the magazine, the system captures the unique signature of the magazine. This information is then sent to a transmitter in the shooting lane. The customer is handed their firearm and one or more magazines which are locked. This means they cannot be inserted into the firearm and used until they are unlocked. Once the customer arrives at the shooting lane, they will sign in with their membership card, and the transmitter in the shooting lane will emit a signal which will authorize the locking mechanism in the magazine to unlock. The customer can then continue to use the magazines for a predetermined time (however much time they rented at the counter) and only in a given location as the signal transmitter will broadcast the signal at a strength which will allow the magazine to remain unlocked only when the customer is standing in the rented shooting lane. A further improvement to this system would be to include an ability to track each magazine within the facility.

In addition to controlling which shooting lane the magazine can be used in, there is an option to install a radio transmitter downrange which will send out a high frequency signal that must be received by the magazine in a predefined orientation in order to allow the locking mechanism to unlock. This will effectively enforce a narrow cone emanating from the shooting position through which the shooter will be able to fire the weapon. Any movement of the receiver inside of the baseplate of the magazine out of the acceptable signal window will cause the locking mechanism to lock the magazine and prevent the host firearm from being fired. This practice is commonly known and referred to as the "180 plane" which is an attempt to ensure that each shooter uses proper muzzle discipline and keeps their firearm pointed downrange at all times. This practice is also known to be frequently disregarded by many and is a major safety concern.

Expanding upon the RFID functionality would be the addition of Bluetooth/Wi-Fi connectivity. Some advantages to Bluetooth/Wi-Fi when compared to RFID are that they both have an increased communication range and systems using these methods would have the ability to control multiple units. Two potential scenarios are laid out below detailing how a system could be structured and used.

A training facility has a class of students where the student to instructor ratio is greater than 5:1. This type of class structure can pose significant challenges for an instructor who wants to be able to have multiple students firing at once while maintaining a safe environment. This is especially true when the students are either new to firearms entirely or are very novice shooters, and it becomes even more dangerous when the training regimen is designed to mimic real world scenarios where there are high levels of stress on the students. A Range Management System would provide the Range Safety Officer (RSO) with the ability to monitor the entire range for unsafe behavior and, with the press of a button, simultaneously disable all of the firearms on the line which are using a magazine. The instructor cadre can then provide correction to the students who need it, and the class can continue safely. This would be compared to the current system where the RSO would need to yell a command to cease fire and hope the students (who are already under stress from the training itself) hear, comprehend and respond to his command to cease fire before the unsafe act which triggered the command results in an injury.

A facility such as a school or a correctional institution is a place where the safety and security of those inside of the building is of the utmost importance. At the same time, there are certain roadblocks in place which prevent responsible employees/officers from being able to carry a firearm in each. This same situation holds true in many public places throughout society today. The magazine with Wi-Fi connectivity could provide a solution which would allow for the carrying and/or staging of loaded firearms inside the facility while ensuring that they cannot be used unless activated by a designated authority. This can be done on a facility wide scale or in a specific building, wing or even room. Further control can also be employed by requiring authorized users to wear a RFID tag which will ensure once the magazine is unlocked, the host firearm can only be used by authorized personnel.

A person of ordinary skill in the art will appreciate that components shown in and described with respect to the figures are provided by way of example only. Numerous other configurations are possible. Accordingly, embodiments of the invention should not be construed as being limited to any particular configuration. It will be appreciated that while the disclosure may in certain instances describe a single example embodiment, there may be other configurations, shapes, and orientations of features and components without departing from example embodiments of the invention. A person of ordinary skill in the art will recognize the applicability of embodiments of the invention to various firearms and magazines known in the art. A person of ordinary skill in the art may recognize that embodiments of the invention may comprise stamped, molded, and/or 3D printed parts comprising one material or a plurality of materials. Embodiments of the invention should not be construed as being limited to any particular firearm or firearm component. Additionally, it is to be recognized that, while the invention has been described above in terms of one or more embodiments, it is not limited thereto. Various features, aspects, and/or components of the above described embodiments may be used individually or jointly, and embodiments not specifically described may include various features described herein. Accordingly, the claims set forth below should be construed in view of the full breadth of the embodiments as disclosed herein.

Unless explicitly stated, the method embodiments described herein are not constrained to a particular order in time or chronological sequence. Additionally, some of the described method elements can be skipped, or they can be repeated, during a sequence of operations of a method.

We claim:

1. A magazine for a pistol having a magazine well, a slide operable to reciprocate between a forward battery position and a rear loading position, and a barrel with a barrel block movable with respect to the slide between an elevated engaged condition in which the barrel prevents movement of the slide to the rear loading position and a lowered disengaged position in which movement of the slide to the rear loading position is enabled, the magazine comprising:

an elongated body configured to be closely and removably received in the magazine well;

the elongated body defining an ammunition passage configured to receive a supply of ammunition;

the elongated body having feed lips at an upper end configured to retain the supply of ammunition;

a locking mechanism connected to the elongated body and having a locked condition and an unlocked condition;

a follower within the ammunition passage;

the locking mechanism being below the follower;

the locking mechanism having a user interface operable to enable a user to select between the locked condition and the unlocked condition;

a block element operably connected to the locking mechanism; and the block element operable to move between a first position when the locking mechanism is in the locked condition in which movement of a firearm trigger is prevented, and a second position when the locking mechanism is in the unlocked condition in which movement of the trigger is enabled.

2. The magazine according to claim 1 wherein the block element is operable to prevent extraction of the lock from the magazine well when the locking mechanism is in the locked condition.

3. The magazine according to claim 1 wherein the locking mechanism has a rotor movable between a first rotational position when the locking mechanism is in the locked condition and a second rotational position when the locking mechanism is in the unlocked condition, the second rotational position different than the first rotational position.

4. The magazine according to claim 1 including an elongated shaft having a first end connected to the locking mechanism and an opposed second end connected to the block element.

5. The magazine according to claim 4, wherein the elongated shaft is a straight element.

6. The magazine according to claim 4, wherein the elongated shaft is a cylindrical element.

7. The magazine according to claim 4, wherein the elongated shaft has a circular cross section.

8. The magazine according to claim 4, wherein the opposed second end of the elongated shaft is proximate an upper end of the elongated body.

9. The magazine according to claim 4, wherein the opposed second end of the elongated shaft is closer to an upper end of the elongated body than to a lower end of the elongated body.

10. The magazine according to claim 4, wherein the elongated body defines a shaft passage receiving the elongated shaft.

11. The magazine according to claim 4, wherein the elongated body has opposed sidewalls, a front wall, and a rear wall, and wherein the elongated shaft is proximate to one of the opposed sidewalls and to the front wall.

12. The magazine according to claim 4, wherein the elongated body has opposed sidewalls, a front wall, and a rear wall, and wherein the elongated shaft is proximate to the rear wall.

13. The magazine according to claim 4, wherein the elongated body has an exterior profile adapted to be closely received in a firearm magazine well, and wherein the block element is within the exterior profile to enable extraction of the lock when in the second position and protrudes from the exterior profile to prevent extraction of the lock when in the first position.

14. The magazine according to claim 4, wherein the block element is an elongated element extending away from the elongated shaft.

15. The magazine according to claim 4, wherein the block element is a planar element having a major surface flush with an external surface of the elongated body when the block element is in the second position.

16. The magazine according to claim 4, wherein the block element extends laterally from the elongated shaft.

17. The magazine according to claim 4, wherein the block element extends radially from the elongated shaft.

18. The magazine according to claim 4, wherein the block element extends transversely from the elongated shaft.

19. The magazine according to claim 4, wherein the block element extends perpendicularly from the elongated shaft.

20. The magazine according to claim 4, wherein the block element defines a block passage receiving the elongated shaft.

* * * * *